US012071272B2

(12) United States Patent
Minnette et al.

(10) Patent No.: US 12,071,272 B2
(45) Date of Patent: Aug. 27, 2024

(54) FUSION PACKAGING

(71) Applicant: Nypro Inc., Clinton, MA (US)

(72) Inventors: Jeffrey C. Minnette, Clinton, MA (US); Ryan P. Davidson, Clinton, MA (US)

(73) Assignee: Nypro Inc., Clinton, MA (US)

( * ) Notice: Subject to any disclaimer, the term of this patent is extended or adjusted under 35 U.S.C. 154(b) by 270 days.

(21) Appl. No.: 17/412,837

(22) Filed: Aug. 26, 2021

(65) Prior Publication Data

US 2022/0048669 A1 Feb. 17, 2022

Related U.S. Application Data

(63) Continuation-in-part of application No. PCT/US2021/022726, filed on Mar. 17, 2021.
(Continued)

(51) Int. Cl.
*B65D 17/28* (2006.01)
*B65D 6/00* (2006.01)
(Continued)

(52) U.S. Cl.
CPC ..... *B65D 17/28* (2018.01); *B65D 11/02* (2013.01); *B65D 11/10* (2013.01); *B65D 11/22* (2013.01);
(Continued)

(58) Field of Classification Search
CPC ..... B65D 17/28; B65D 11/02; B65D 11/10; B65D 11/22; B65D 17/12; B65D 25/04;
(Continued)

(56) References Cited

U.S. PATENT DOCUMENTS 3,317,109 A 5/1967 Palmer
4,143,764 A * 3/1979 Moss, III ..... C12M 23/48 220/676
(Continued)

FOREIGN PATENT DOCUMENTS

DE 8434358 U1 2/1985
EP 2236264 A1 10/2010
(Continued)

OTHER PUBLICATIONS

Extended European Search Report dated Oct. 31, 2023 from corresponding European Application No. 21772427.7.
(Continued)

*Primary Examiner* — Kareen K Thomas
(74) *Attorney, Agent, or Firm* — Young Basile Hanlon & MacFarlane, P.C.

(57) ABSTRACT

Disclosed herein are fusion packaging and fusion packages. A package includes a frame which provides structure, a sidewall fused to the frame, and a cap connected to one end of the frame. Another package includes a sleeve, a cap fused to one end of the sleeve, and a seal configured to be fused to a remaining end of the sleeve after filling with content. Another package includes a frame, a film fused to the frame, a cap connected to one end of the frame, and a seal connected to another end of the frame, where one of the cap and seal are connected to the frame after material placement. Sealed edges are formed at junctures between a frame, sleeve, or cap and a sidewall or film when frame, sleeve, or cap material embeds with sidewall or film material.

20 Claims, 53 Drawing Sheets

Related U.S. Application Data

(60) Provisional application No. 62/990,551, filed on Mar. 17, 2020.

(51) Int. Cl.

| | |
|---|---|
| ***B65D 6/34*** | (2006.01) |
| ***B65D 8/00*** | (2006.01) |
| ***B65D 17/00*** | (2006.01) |
| ***B65D 25/04*** | (2006.01) |
| ***B65D 25/36*** | (2006.01) |
| ***B65D 47/08*** | (2006.01) |
| ***B65D 55/16*** | (2006.01) |
| ***B65D 77/20*** | (2006.01) |

(52) U.S. Cl.
CPC ..... *B65D 17/12* (2013.01); *B65D 25/04* (2013.01); *B65D 25/36* (2013.01); *B65D 47/0852* (2013.01); *B65D 55/16* (2013.01); *B65D 77/2032* (2013.01)

(58) Field of Classification Search
CPC .... B65D 25/36; B65D 47/0852; B65D 55/16; B65D 77/2032; B65D 47/0885; B65D 83/08
See application file for complete search history.

(56) References Cited

U.S. PATENT DOCUMENTS

| | | | | |
|---|---|---|---|---|
| 4,665,713 | A * | 5/1987 | Delatte | B01L 9/06 62/382 |
| 4,905,822 | A * | 3/1990 | Bosco | B65D 11/188 220/4.24 |
| 7,568,590 | B1 | 8/2009 | Gross et al. | |
| D645,754 | S | 9/2011 | Corbett et al. | |
| 8,430,262 | B2 | 4/2013 | Corbett et al. | |
| D692,768 | S | 11/2013 | Corbett et al. | |
| D692,769 | S | 11/2013 | Corbett et al. | |
| D694,635 | S | 12/2013 | Corbett et al. | |
| 8,663,419 | B2 | 3/2014 | Corbett et al. | |
| 8,746,489 | B2 * | 6/2014 | Boehler | B65D 21/0213 220/62.12 |
| 8,807,377 | B2 | 8/2014 | Corbett et al. | |
| 8,991,635 | B2 | 3/2015 | Myerscough | |
| 9,126,717 | B2 | 9/2015 | Myerscough | |
| 9,126,719 | B2 | 9/2015 | Corbett et al. | |
| 9,145,251 | B2 | 9/2015 | Minnette et al. | |
| 9,302,832 | B2 * | 4/2016 | Park | B65D 15/08 |
| 9,452,857 | B2 | 9/2016 | Corbett et al. | |
| 9,463,894 | B2 | 10/2016 | Minnette et al. | |
| 9,574,307 | B2 | 2/2017 | Corbett et al. | |
| 9,604,769 | B2 | 3/2017 | Minnette et al. | |
| 9,884,716 | B2 | 2/2018 | Minnette et al. | |
| 10,005,222 | B2 | 6/2018 | Corbett et al. | |
| 10,005,605 | B2 | 6/2018 | Corbett et al. | |
| 10,532,872 | B2 | 1/2020 | Minnette et al. | |
| 11,167,904 | B2 | 11/2021 | Corbett et al. | |
| 11,286,104 | B2 | 3/2022 | Corbett et al. | |
| 11,383,887 | B2 | 7/2022 | Corbett et al. | |
| 2003/0218017 | A1 | 11/2003 | Schmidtner et al. | |
| 2006/0011635 | A1 * | 1/2006 | Shibata | B65D 3/30 220/485 |
| 2007/0164095 | A1 * | 7/2007 | Schuetz | B65B 7/2878 229/125.05 |
| 2008/0110920 | A1 | 5/2008 | Hlista et al. | |
| 2008/0169297 | A1 | 7/2008 | Kelly | |
| 2010/0108693 | A1 | 5/2010 | Zhang et al. | |
| 2010/0140129 | A1 | 6/2010 | Sanfilippo et al. | |
| 2011/0290798 | A1 | 12/2011 | Corbett et al. | |
| 2012/0012586 | A1 | 1/2012 | Rinderer et al. | |
| 2012/0024897 | A1 | 2/2012 | Corbett et al. | |
| 2012/0145710 | A1 | 6/2012 | Corbett et al. | |
| 2013/0001233 | A1 | 1/2013 | Hylton | |
| 2014/0252032 | A1 | 9/2014 | Corbett et al. | |
| 2014/0367296 | A1 * | 12/2014 | Berger | B65D 21/0233 220/834 |
| 2015/0314916 | A1 | 11/2015 | Corbett et al. | |
| 2016/0000269 | A1 | 1/2016 | Van Puijenbroek et al. | |
| 2016/0159530 | A1 | 6/2016 | Minnette et al. | |
| 2016/0159545 | A1 | 6/2016 | Corbett et al. | |
| 2018/0022534 | A1 | 1/2018 | McCormick | |
| 2019/0135479 | A1 | 5/2019 | Corbett et al. | |
| 2019/0161236 | A1 * | 5/2019 | Knob | B65D 43/0204 |
| 2021/0284418 | A1 | 9/2021 | Corbett et al. | |
| 2022/0169437 | A1 | 6/2022 | Corbett et al. | |
| 2022/0340335 | A1 | 10/2022 | Corbett et al. | |
| 2023/0054953 | A1 | 2/2023 | Graham et al. | |
| 2023/0055756 | A1 * | 2/2023 | Brown | A61L 2/10 |
| 2023/0331449 | A1 | 10/2023 | Graham et al. | |
| 2023/0371675 | A1 | 11/2023 | Graham et al. | |

FOREIGN PATENT DOCUMENTS

| | | | |
|---|---|---|---|
| FR | 2289394 | A1 | 5/1976 |
| GB | 2510643 | A | 8/2014 |
| JP | H10-058482 | A | 3/1998 |
| JP | 2013534496 | A | 9/2013 |
| WO | 2008134174 | A1 | 11/2008 |
| WO | 2014031869 | A1 | 2/2014 |
| WO | 2014193608 | A1 | 12/2014 |
| WO | 2022055921 | A1 | 3/2022 |

OTHER PUBLICATIONS

Office Action issued in corresponding U.S. Appl. No. 17/911,773, dated Apr. 18, 2024.

* cited by examiner

3200

3400

3300

FUSION PACKAGING

CROSS REFERENCE TO RELATED APPLICATIONS

This application is a continuation-in-part of International Patent Application Ser. No. PCT/US2021/022726, filed on Mar. 17, 2021, which claims the benefit of U.S. Provisional Patent Application Ser. No. 62/990,551, filed on Mar. 17, 2020, the entire contents of which are incorporated by reference herein.

TECHNICAL FIELD

This disclosure relates to packaging and in particular, packages having rigid and flexible components which are fused or bonded together.

BACKGROUND

Pouches or structureless packages commonly used for snacks, chips, yogurt, liquids, and the like have numerous issues or disadvantages. These types of packages are generally not recyclable. They are unable to go through the grinding, cleaning, bleaching, and other processing to produce recycled materials. Contents in these types of packages are subject to increased breakage. Shipping is inefficient due to inability to stack these types of packages. Presentation or display of the packages on store shelves result in similar issues.

SUMMARY

Disclosed herein are methods and systems for fusion packaging.

In implementations, a package includes a frame configured to provide structure for the package, a sidewall fused to the frame, and a tethered cap connected to one end of the frame. In implementations, the frame includes a retainment locking element for retaining a retaining element of the tethered cap and the tethered cap includes a tether mechanism connected to the retaining element. In implementations, the tethered cap includes a tab element configured to enable access to content in the package, a tearable membrane portion configured to be peeled away by the tab element to expose an opening to access the content, a tether mechanism configured to connect the tearable membrane portion to a remaining portion of the tethered cap, and a tab element retainer configured to retain the tab element away from the opening. In implementations, the tethered cap includes a tab element configured to enable access to content in the package, wherein the tab element is configured to partly fuse with an outer surface of the sidewall, a peelable portion configured to be peeled away by the tab element to expose an opening to access the content, and a tether mechanism configured to connect the peelable portion to a remaining portion of the tethered cap. In implementations, the frame includes a rim having a narrow section and a wide section, the tether mechanism configured to be fused to the wide section. In implementations, the tethered cap is configured to be pivotable between an open position and a closed position, wherein the tethered cap includes an opening configured to dispense content when the tethered cap is in the open position. In implementations, the tethered cap includes pins configured to engage pin openings on the frame to go from an open position to a close position and a partially openable seal including a perforated portion configured to allow access to content when the perforated portion is removed and the tethered cap is in the open position, the partially openable seal configured to be fused to the frame, where the tethered cap can be placed in a closed position after accessing the content. In implementations, the frame includes a content holding and guiding structure positioned below the perforated portion, the content holding and guiding structure configured to present the content to a user for removal from the package. In implementations, the package further including a divider structure configured to establish two compartments in the package. The divider structure including an access divider configured to provide access to each compartment, where the access divider is connected to a neck of the frame; and a compartment divider configured to divide the frame into the two compartments, wherein the compartment divider is connected to diagonally opposite legs of the frame. In implementations, the divider structure and the injection molded frame are integrated. In implementations, the package further including a seal configured to be fused with another end of the frame, where one of the tethered seal and the seal is fused after filling the package with content.

In implementations, a package includes a sleeve configured to provide structure for the package, a tethered cap fused to one end of the sleeve, and a seal configured to be fused to a remaining end of the sleeve after the package is filled with content. In implementations, the tethered cap includes a peelable portion configured to provide an opening for access to the content in the package, the peelable portion including a retain groove, and a tethered portion fused to the sleeve and connected to the peelable portion by a hinge portion, the tethered portion including a retain projection, where the retain projection and the retain groove lock the peelable portion away from the opening during access to the content.

In implementations, a package includes a frame configured to provide structure for the package, a film fused to the frame, a cap connected to one end of the frame, the cap including a structure to retain the cap after removal from the frame, and a seal connected to another end of the frame, where one of the cap and seal are connected to the frame after material placement. In implementations, the cap further includes a peel portion, a retain portion, and a hinge portion configured to connect the peel portion and the retain portion, where the peel portion is retained to the retain portion after peeling the peel portion away from the package. In implementations, the peel portion can be configured to be detached from the retain portion.

In implementations, a package includes a frame configured to provide structure for the package, the frame including an integrated cap, a film fused to the frame, and a seal connected to one end of the frame after material placement. In implementations, where the integrated cap includes a structure to retain a portion of the integrated cap after removal from the frame. In implementations, where the portion of the integrated cap can be configured to be detached from the integrated cap. In implementations, where a peelable portion of the integrated cap can be configured to be detached from the integrated cap. In implementations, where the integrated cap further includes a peel portion, a retain portion, and a hinge portion configured to connect the peel portion and the retain portion, wherein the peel portion is retained to the retain portion after peeling the peel portion away from the package. In implementations, where the peel portion can be configured to be detached from the hinge portion.

In implementations, a package includes a sleeve configured to provide structure for the package, a cap portion fused to one end of the sleeve, the cap portion including a peel portion, a retain portion, and a hinge portion configured to connect the peel portion and the retain portion, wherein the peel portion is retained to the retain portion after peeling the peel portion from the cap portion, and a seal configured to be fused to a remaining end of the sleeve after the package is filled with content. In implementations, where the peel portion includes a retain element and the retain portion includes a mated retain element configured to maintain the peel portion away from an opening created when peeling the peel portion away from the cap portion. In implementations, where the peel portion can be configured to be detached from the hinge portion.

BRIEF DESCRIPTION OF THE DRAWINGS

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figures 1A, 1B:
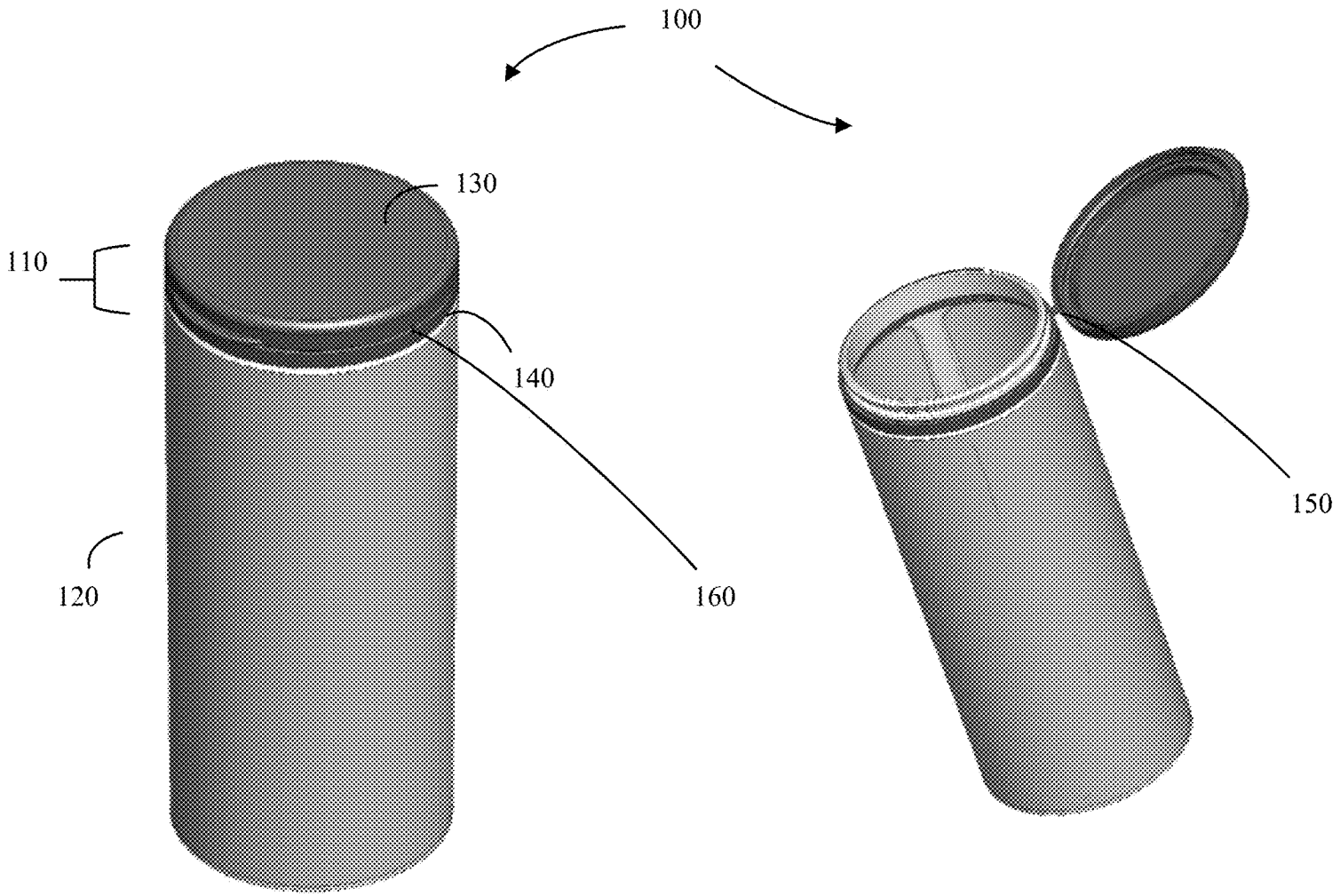
FIG. 1A and FIG. 1B are diagrams of a fusion package in a closed position and an open position, respectively, in accordance with implementations.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions, and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

The non-limiting embodiments described herein are with respect to fusion packages. The fusion packages and methods for making the fusion packages may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the fusion packages and the methods for making the fusion packages.

Disclosed herein are implementations of fusion packaging. The implementations shown are illustrative and other implementations are within the scope of the specification and claims described herein. For purposes of illustration, certain aspects, features, and the like are described with respect to implementations. These aspects, features, and the like are appropriately applicable to and interchangeable with other implementations described herein.

In implementations, the fusion packages described herein provide structure to the packaging by using a combination of injection molding (IM), in-mold labeling (IML), die cutting, compression blow molding, thermoform molding, and the like processing (collectively "structure forming process") to form a frame, ribbed frame, vertical frame, cap, neck or collar structure, and the like (collectively "structure" or "molded part or portion") with injection molding (IM), in-mold labeling (IML), heat, induction, mechanical, staking, ultrasonic, and adhesive or chemical bonding (collectively "join processing") to fuse, weld, or bond (collectively "fuse") the structure with a flexible part to create a sealed package which can hold content or materials. In implementations, the fusing can include application of pressure, temperature, and/or combinations thereof. In implementations, the sealed package is an integrally, hermetically sealed package. In implementations, the sealed package can be configured to contain liquid or non-dry content or materials.

In implementations, the frame, ribbed frame, and/or vertical frame (collectively "frame") can have a rectangular, square, oval, circular, and/or like profile or footprint. In implementations, the frame can have any number of legs or ribs connecting a base portion and a neck portion. In implementations, the structure can be made from polymers, biopolymers, sustainable materials, recyclable materials, biodegradable materials, bio-based resins, weight-optimized biodegradable plastic, and the like.

In implementations, the flexible part can be or can be made from heavy film, paperboard, pressed pulp, compostable coated paper, and the like. In implementations, the flexible part can include a barrier layer or film on an internal or inside surface, where the barrier layer is impervious to the content or material in the fusion package and chemically inert with respect to the content or material in the fusion package. In implementations, the flexible part can be an integrated or integrally formed barrier layer or film with the heavy film, paperboard, pressed pulp, and the like. In implementations, the flexible part can be or can be made from recyclable, sustainable, degradable, biodegradable, and like materials.

In implementations, the fusion packages and/or the components of the fusion packages can be of paper, fiber based, pressed fiber, and/or plastic construction, which can be sustainable materials, recyclable materials, degradable materials, degradable plastic, biodegradable materials, bio-based resins, and/or weight-optimized biodegradable plastic. The fusion packages and/or the components of the fusion packages can efficiently use recyclable, biodegradable, and the like materials for improved sustainability.

In implementations, the fusion packages described herein provide structure to the packaging by fusing a neck part to a tubular or conical sleeve. In implementations, the sleeve can be or can be made from heavy film, paperboard, pressed pulp, and the like. In implementations, the sleeve can include a barrier layer or film on an internal or inside surface. In implementations, the sleeve can be an integrated or integrally formed barrier layer or film with the heavy film, paperboard, pressed pulp, and the like. In implementations, the sleeve can be or can be made from recyclable, sustainable, degradable, biodegradable, and like materials.

The fusion packages described herein provide structural integrity to the package at minimal weight cost and permits the package to flex, stretch, and the like during pressure and temperature variations. The fusion packages are stackable and nestable during shipping and for store shelving. The fusion packages can efficiently use recyclable, biodegradable, and the like materials for improved sustainability.

FIG. 1A and FIG. 1B are diagrams of a fusion package 100 in a closed position and an open position, respectively, in accordance with implementations. The fusion package 100 includes a cap 110 and a package body 120. The cap 110 includes a lid 130, a retaining element 140, a tether mechanism 150, and a plurality of rupture members 160 which connect the lid 130, the retaining element 140, and the tether mechanism 150 together in a closed position.

Figure 2:
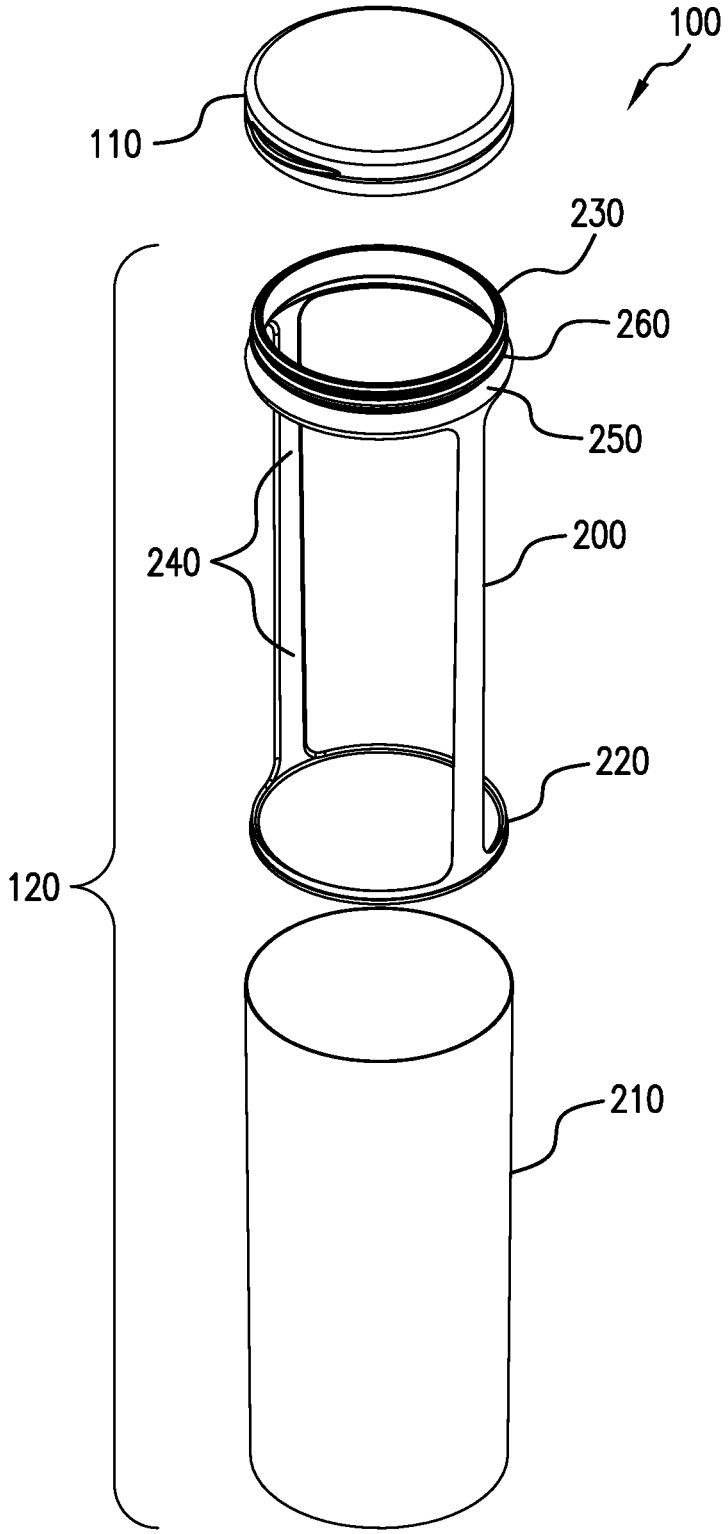
FIG. 2 is an exploded view of the fusion package of FIG. 1A in accordance with implementations.
Figure 3:
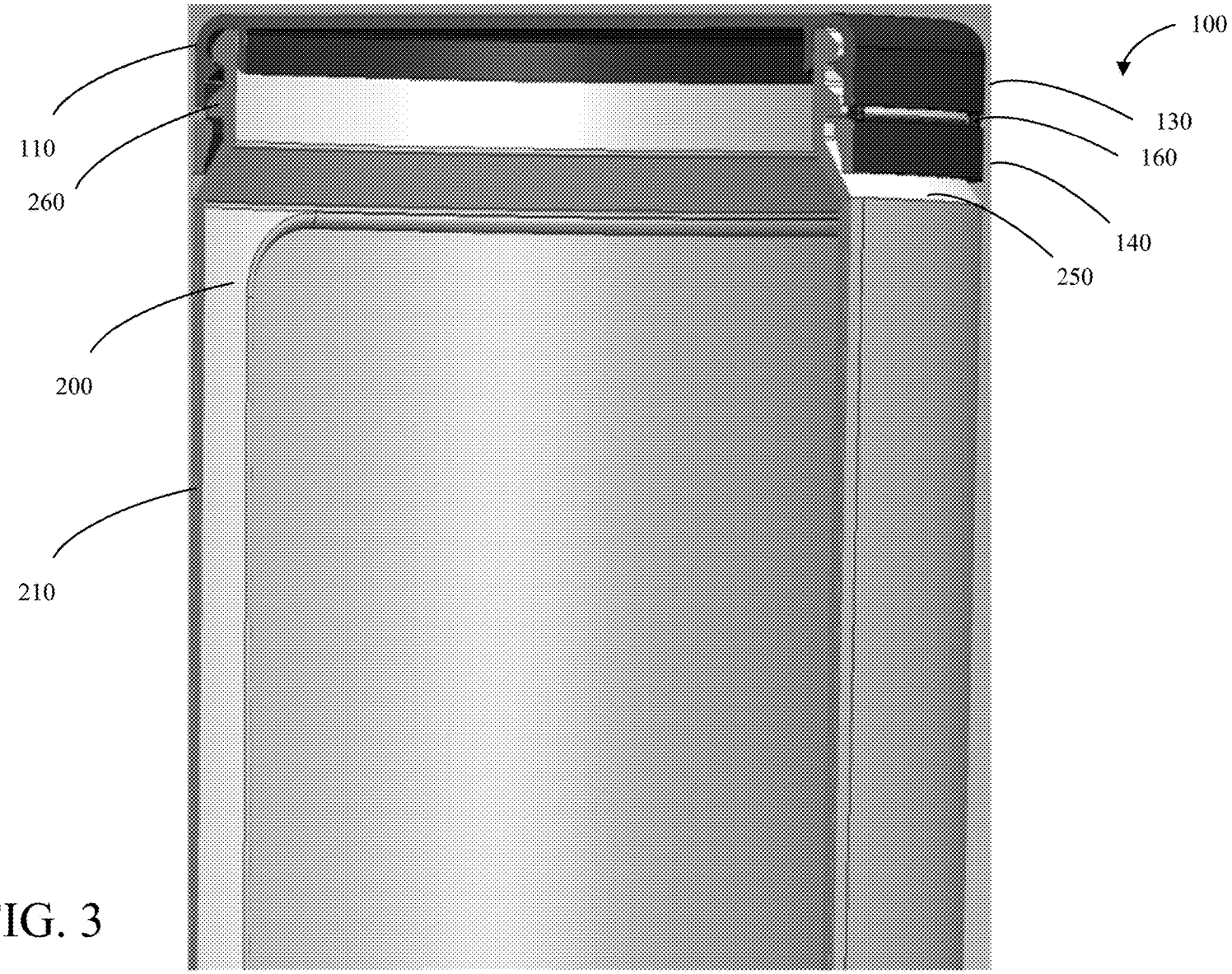
FIG. 3 is a cross-sectional view of the fusion package of FIG. 1A in accordance with implementations.

FIG. 2 is an exploded view of the fusion package 100 of FIG. 1A in accordance with implementations. FIG. 3 is a cross-sectional view of the fusion package 100 of FIG. 1A in accordance with implementations. The package body 120 includes a frame 200 and a sidewall 210. The frame 200 includes a bottom 220, a neck 230, and legs 240 for connecting the bottom 220 and the neck 230. The neck 230 includes a rim 250 and a retaining element lock mechanism 260 for engaging the retaining element 140. In implementations, the sidewall 210 can be made from heavy film, paperboard, pressed pulp, and the like materials as described herein. In implementations, the sidewall 210 can include a barrier layer or film on an internal or inside surface. In implementations, the sidewall 210 can include an integrated barrier layer, film, and/or material. In implementations, the frame 200 can be made using the structure forming processes described herein using the materials described herein.

The fusion package 100 uses the join processing to fuse the frame 200 with the sidewall 210. In implementations, the fusion package 100 includes a liner or foil. In implementations, the fusion package 100 is linerless or foilless. The fusion package 100 is filled from a top and then the cap 110 is snap fitted onto the neck 230. The fusion package 100 is opened by flipping the lid 130 and tearing the plurality of rupture members 160. The retaining element 140 and the tether mechanism 150 secure the lid 130 to prevent environmental disposal issues and enable sustainability.

Figure 4B:
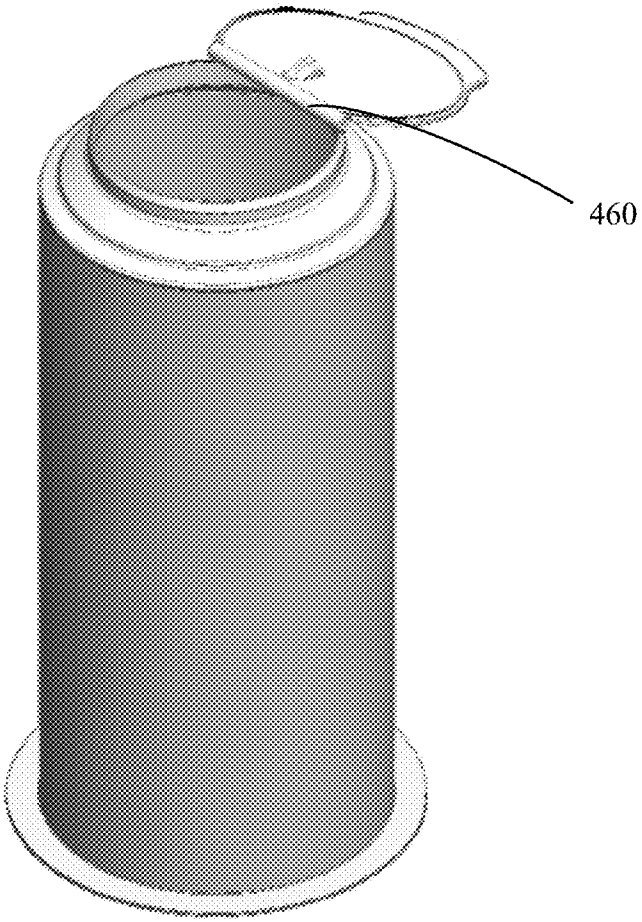
FIG. 4A and FIG. 4B are diagrams of a fusion package in a closed position and an open position, respectively, in accordance with implementations.
Figure 4A:
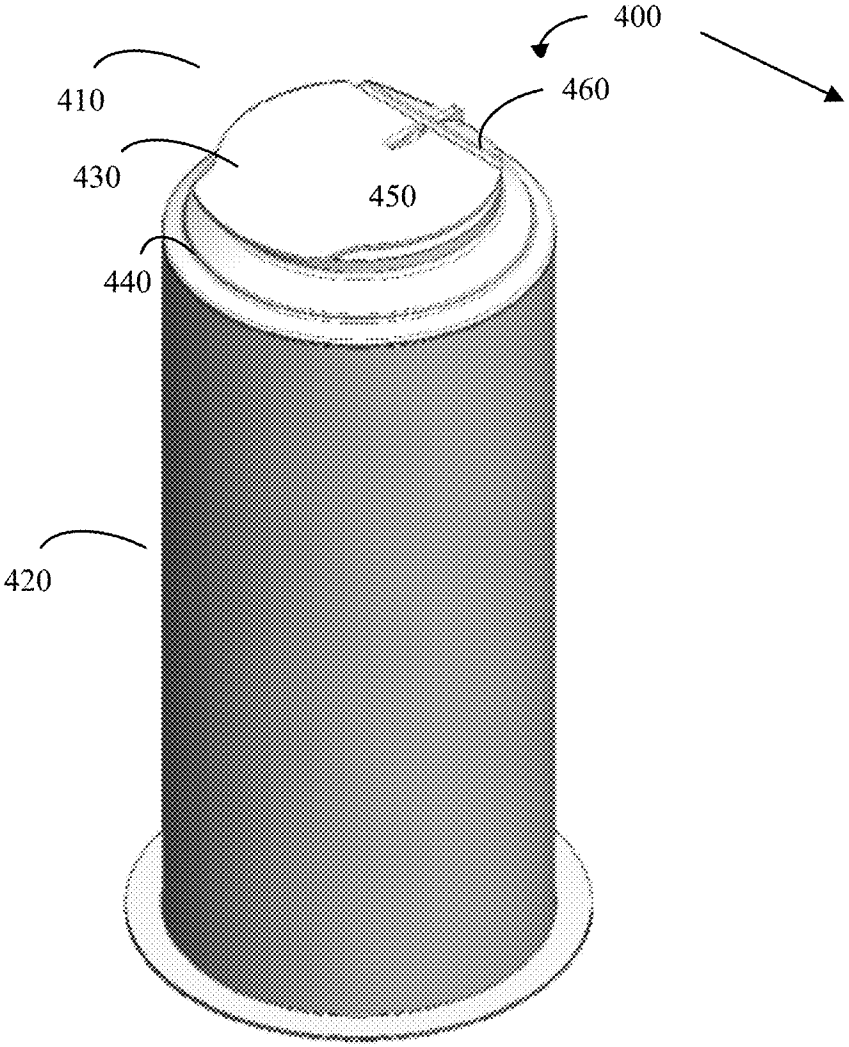

FIG. 4A and FIG. 4B are diagrams of a fusion package 400 in a closed position and an open position, respectively, in accordance with implementations. The fusion package 400 includes a cap portion 410, a package body 420, and a seal (shown in FIG. 5). The cap portion 410 includes a lid 430 and a neck 440. The lid 430 includes a peel portion 450 and a retain portion 460. In implementations, the package body 420 can be made from heavy film, paperboard, pressed pulp, and the like materials as described herein. In implementations, the package body 420 can include a barrier layer or film on an internal or inside surface. In implementations, the package body 420 can include an integrated barrier layer, film, and/or material. In implementations, the package body 420 is tubular shaped. In implementations, the cap portion 410 can be made using the structure forming processes described herein using the materials described herein.

Figure 5:
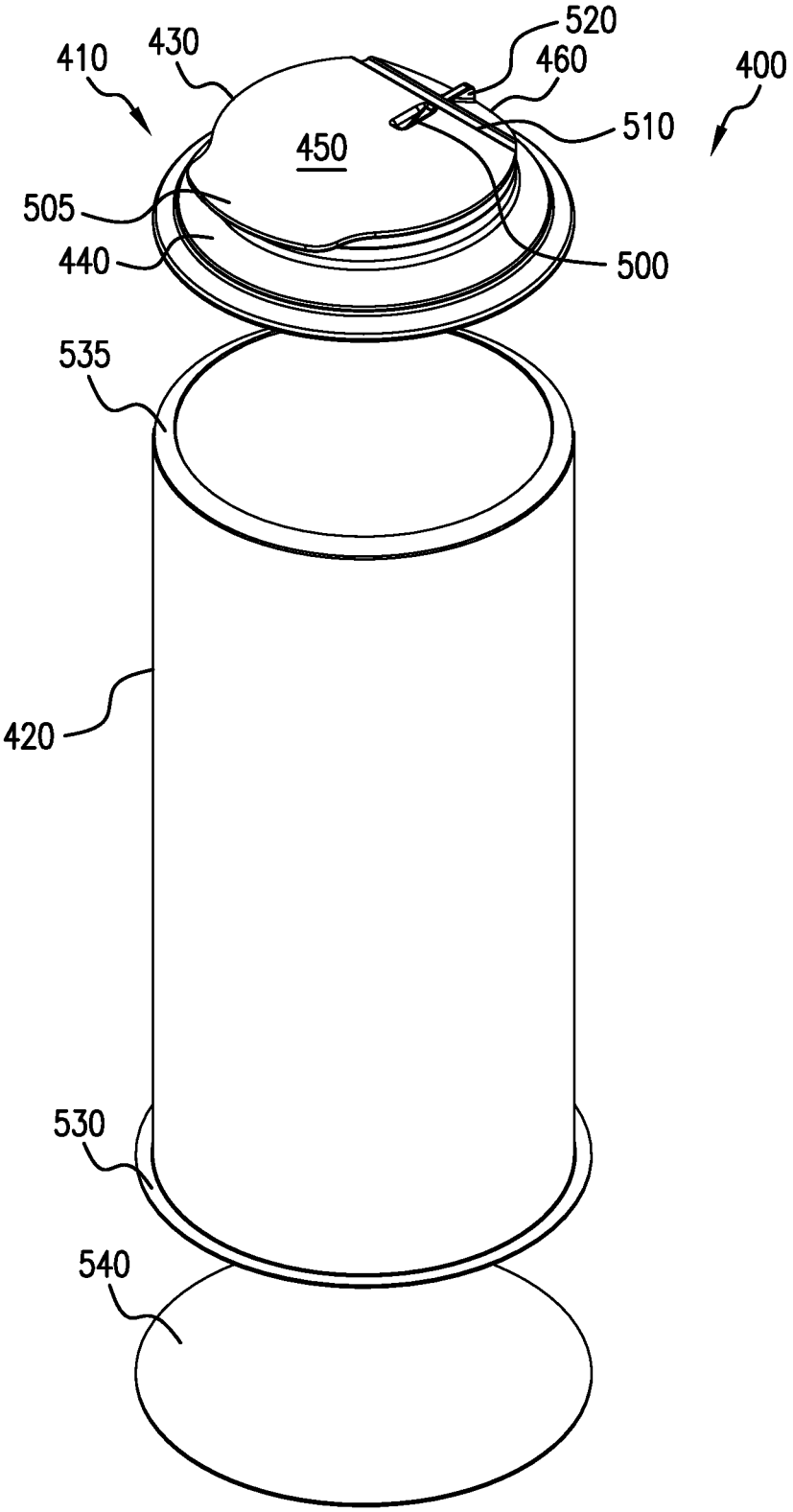
FIG. 5 is an exploded view of the fusion package of FIG. 4A in accordance with implementations.
Figure 6:
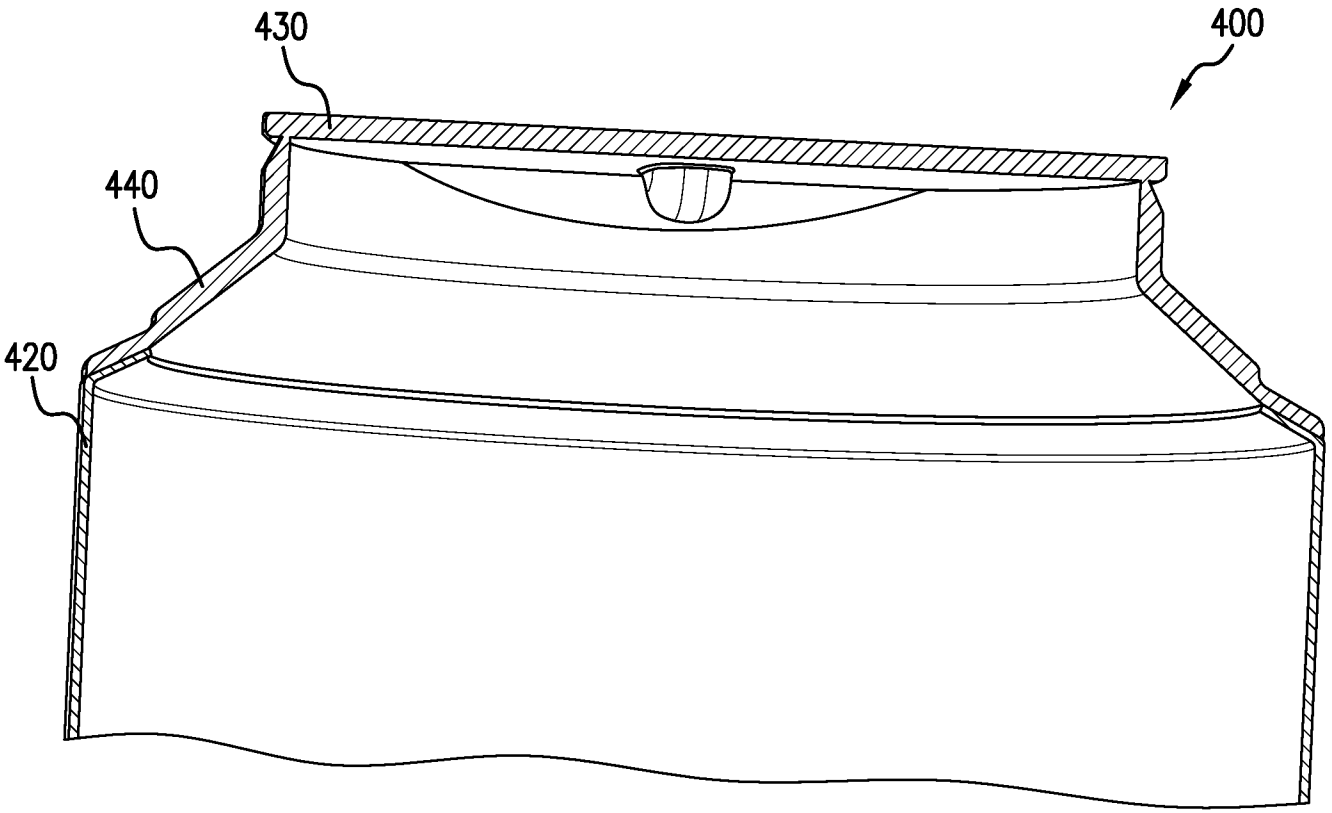
FIG. 6 is a cross-sectional view of the fusion package of FIG. 4A in accordance with implementations.
Figure 7A:
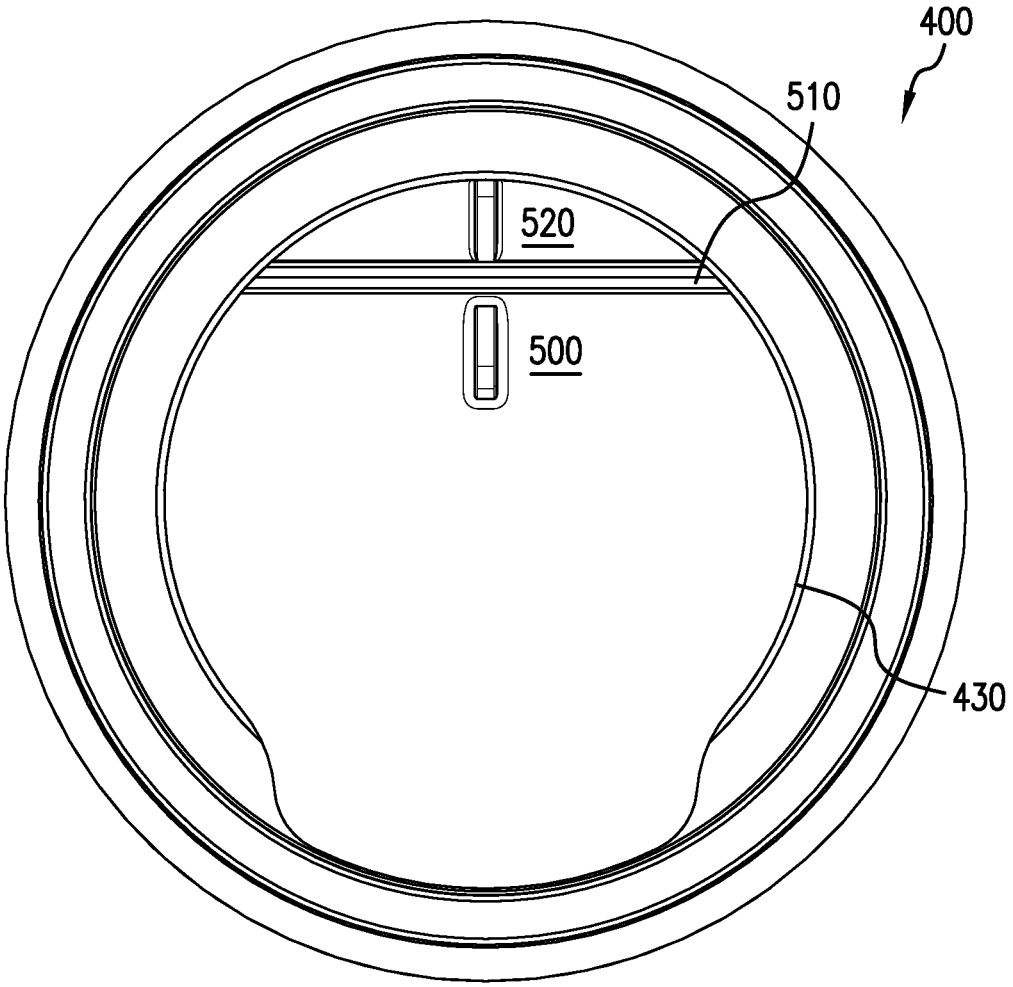
FIG. 7A is a top view of the fusion package of FIG. 4A in accordance with implementations.
Figure 7B:
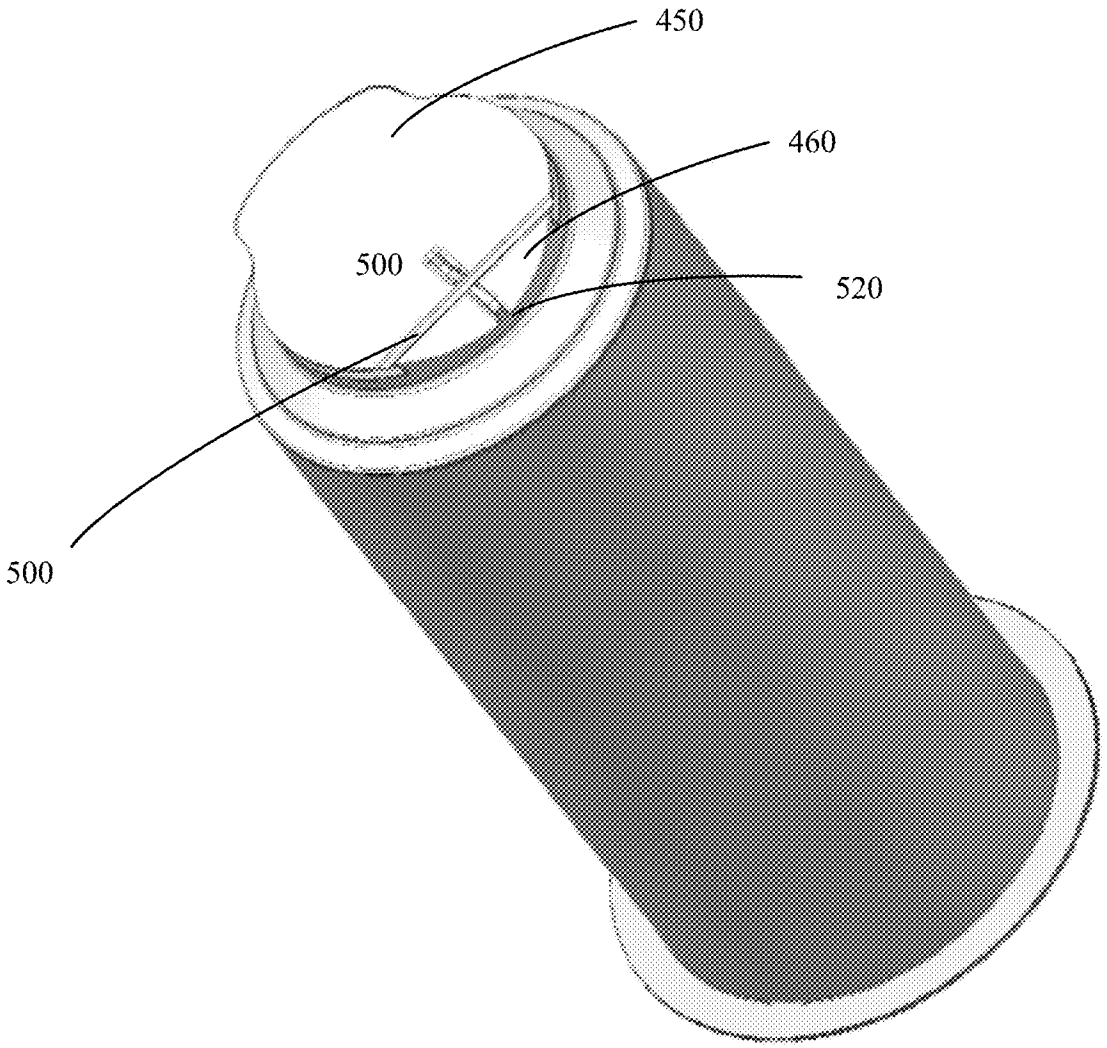
FIG. 7B is a perspective view of the fusion package of FIG. 4A in accordance with implementations.

FIG. 5 is an exploded view of the fusion package 400 of FIG. 4A in accordance with implementations, FIG. 6 is a cross-sectional view of the fusion package 400 of FIG. 4A in accordance with implementations, FIG. 7A is a top view of the fusion package of FIG. 4A in accordance with implementations, and FIG. 7B is a perspective of the fusion package of FIG. 4A in accordance with implementations. The peel portion 450 includes a retain groove 500 and tab portion 505. The retain portion 460 includes a retain projection 520 for engagement with the retain groove 500. A hinge portion 510 portion flexibly or hingedly connects the retain portion 460 and the peel portion 450. The package body 420 includes a flange 530 and a rim 535. A seal 540 is configured to engage the flange 530 when closing or sealing the fusion package 400.

The fusion package 400 uses the join processing to fuse the cap portion with the rim 535 of the package body 420. The fusion package 400 is filled from a bottom and then the seal 540 is fused to the flange 530 using the join processing processes. In implementations, fusing of the seal 540 can be done at a content or material production site. That is, a non-sealed fusion package 400 can be shipped to a manufacturer of the material, who can then fill and seal the fusion package 400. The fusion package 400 is opened by pulling up on the tab portion 505 to peel the peel portion 450 away from the neck 440 until hitting the hinge portion 510, which prevents environmental disposal issues and enables sustainability. In implementations, the retain groove 500 can engage the retain projection 520 to keep peel portion 450 from interfering in accessing the content or material in the fusion package 400. In implementations, the peel portion 450 can be torn away at the hinge portion 510 with only the retain portion 460 remaining.

Figures 8A, 8B:
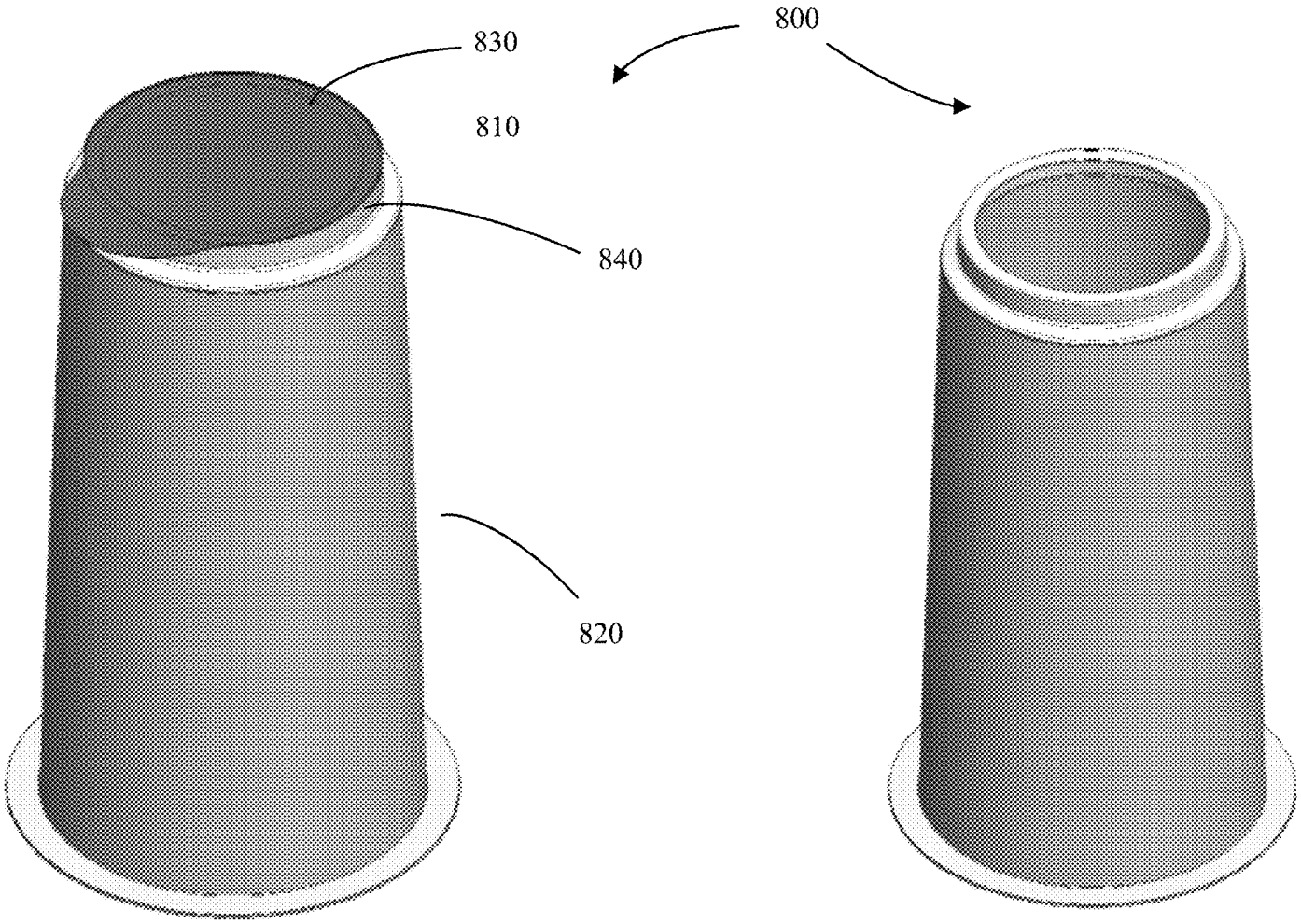
FIG. 8A and FIG. 8B are diagrams of a fusion package in a closed position and an open position, respectively, in accordance with implementations.

FIG. 8A and FIG. 8B are diagrams of a fusion package 800 in a closed position and an open position, respectively, in accordance with implementations. The fusion package 800 includes a cap portion 810, a package body 820, and a seal (shown in FIG. 9). The cap portion 810 includes a peelable seal 830 and a neck 840. In implementations, the package body 820 can be made from heavy film, paperboard, pressed pulp, and the like materials as described herein. In implementations, the package body 820 can include a barrier layer or film on an internal or inside surface. In implementations, the package body 820 can include an integrated barrier layer, film, and/or material. In implementations, the package body 820 is tubular, conical, and other shapes as described herein. In implementations, the cap portion 810 can be made using the structure forming processes described herein using the materials described herein.

Figure 9:
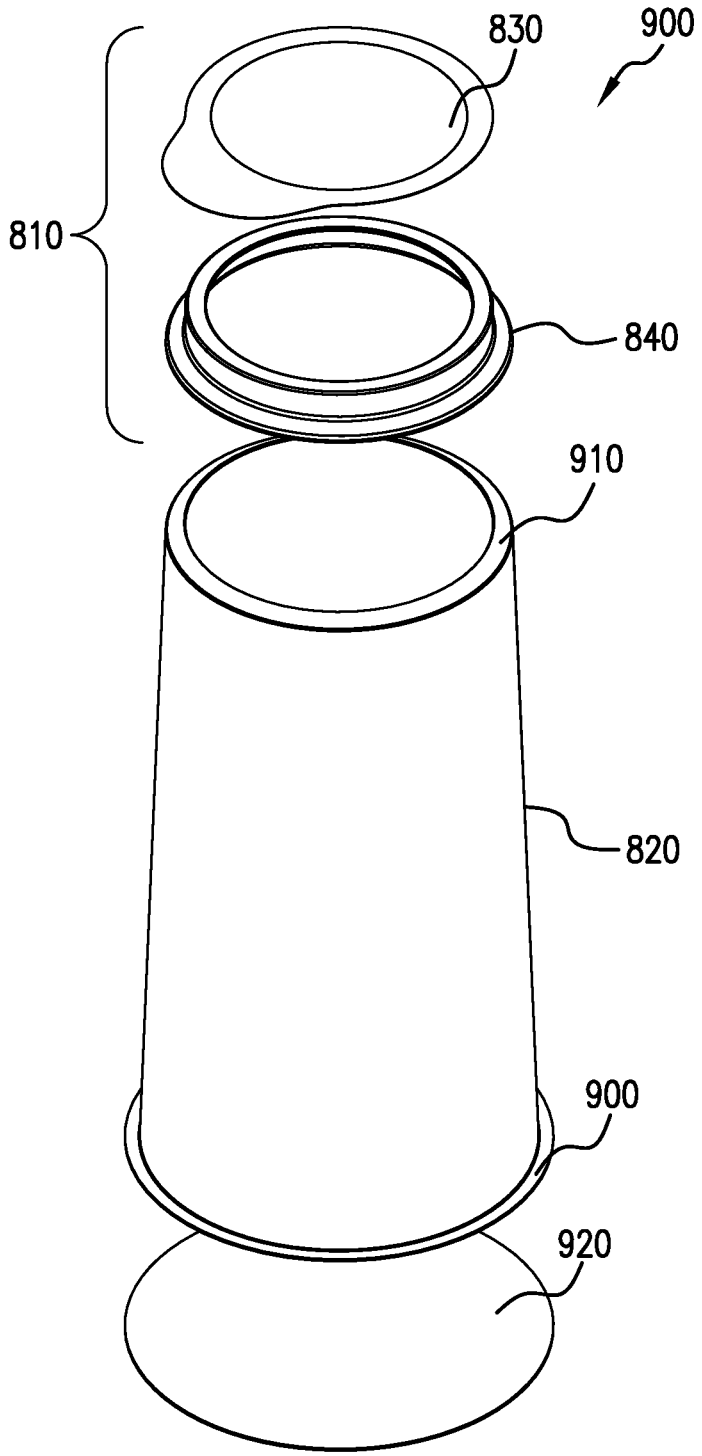
FIG. 9 is an exploded view of the fusion package of FIG. 8A in accordance with implementations.
Figure 10:
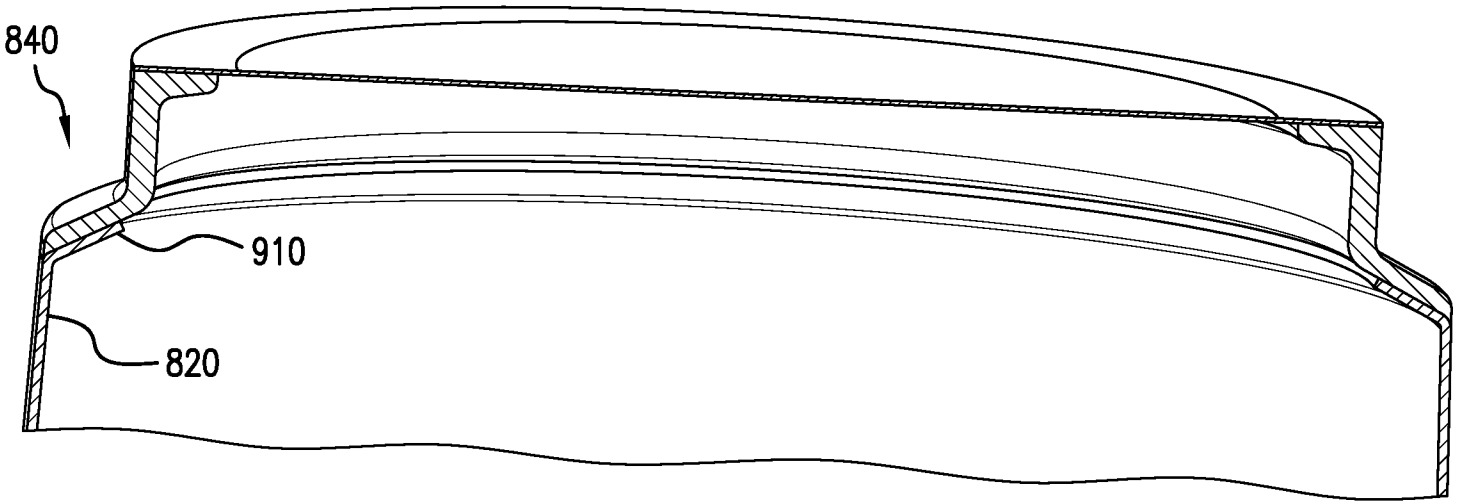
FIG. 10 is a cross-sectional view of the fusion package of FIG. 8A in accordance with implementations.

FIG. 9 is an exploded view of the fusion package 800 of FIG. 8A in accordance with implementations and FIG. 10 is a cross-sectional view of the fusion package 800 of FIG. 8A in accordance with implementations. The package body 820 includes a flange 900 and a rim 910. A seal 920 is configured to engage the flange 900 when closing the fusion package 800.

The fusion package 800 uses the join processing to fuse the peelable seal 830 to the neck 840 and the cap portion 810 with the rim 910 of the package body 820. The fusion package 800 is filled from a bottom and then the seal 920 is fused to the flange 900. In implementations, fusing of the seal 920 can be done at a content or material production site. That is, a non-sealed fusion package 800 can be shipped to a manufacturer of the material, who can then fill and seal the fusion package 800. The fusion package 800 is opened by tearing the peelable seal 830.

Figures 11A, 11B:
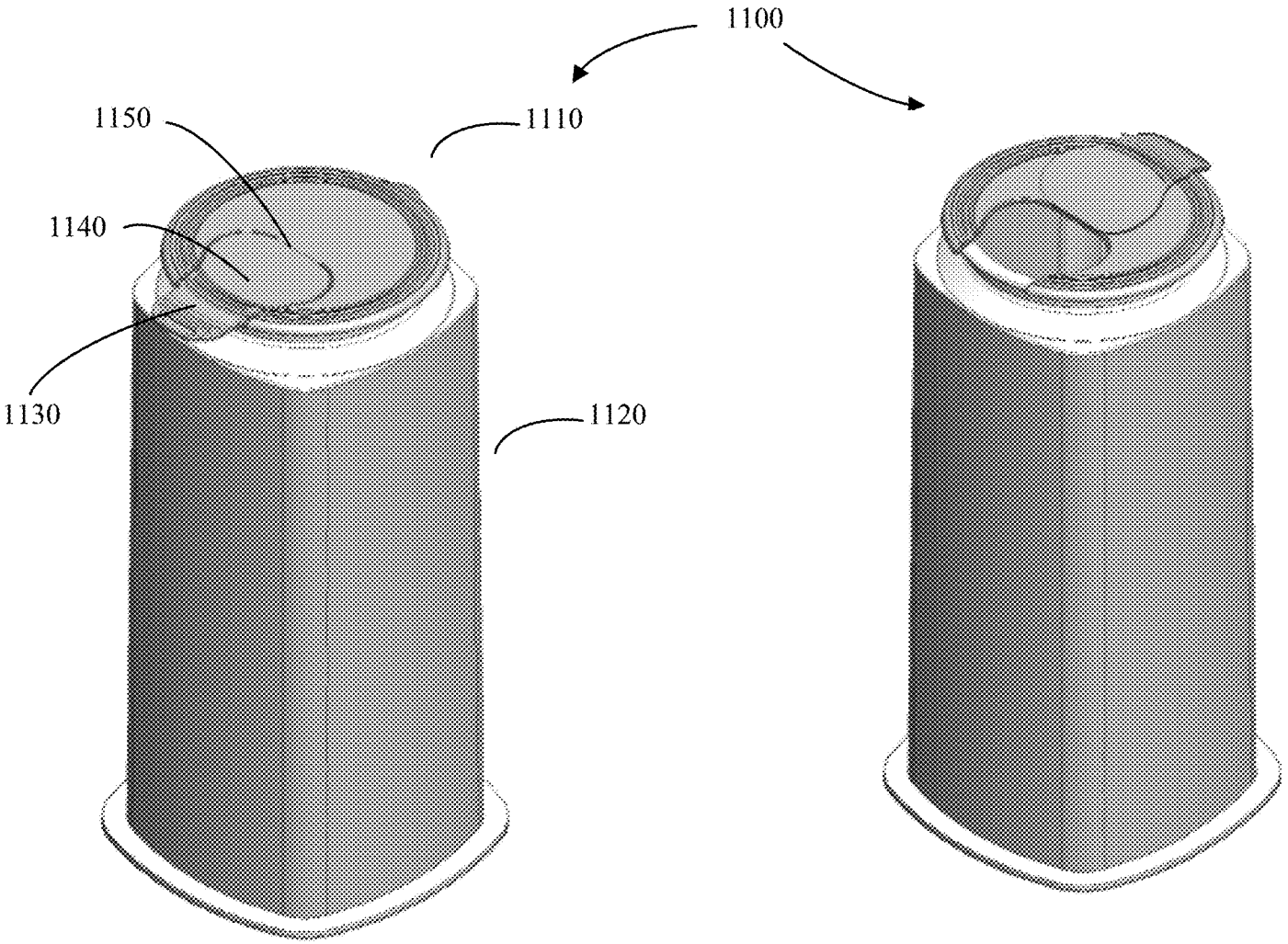
FIG. 11A and FIG. 11B are diagrams of a fusion package in a closed position and an open position, respectively, in accordance with implementations.

FIG. 11A and FIG. 11B are diagrams of a fusion package 1100 in a closed position and an open position, respectively, in accordance with implementations. The fusion package 1100 includes a cap 1110 and a package body 1120. The cap 1110 includes a tab element 1130, a tearable membrane portion 1140, and a retain portion or tether mechanism 1150. In implementations, the tether mechanism 1150 is a hinge-like mechanism.

Figure 12:
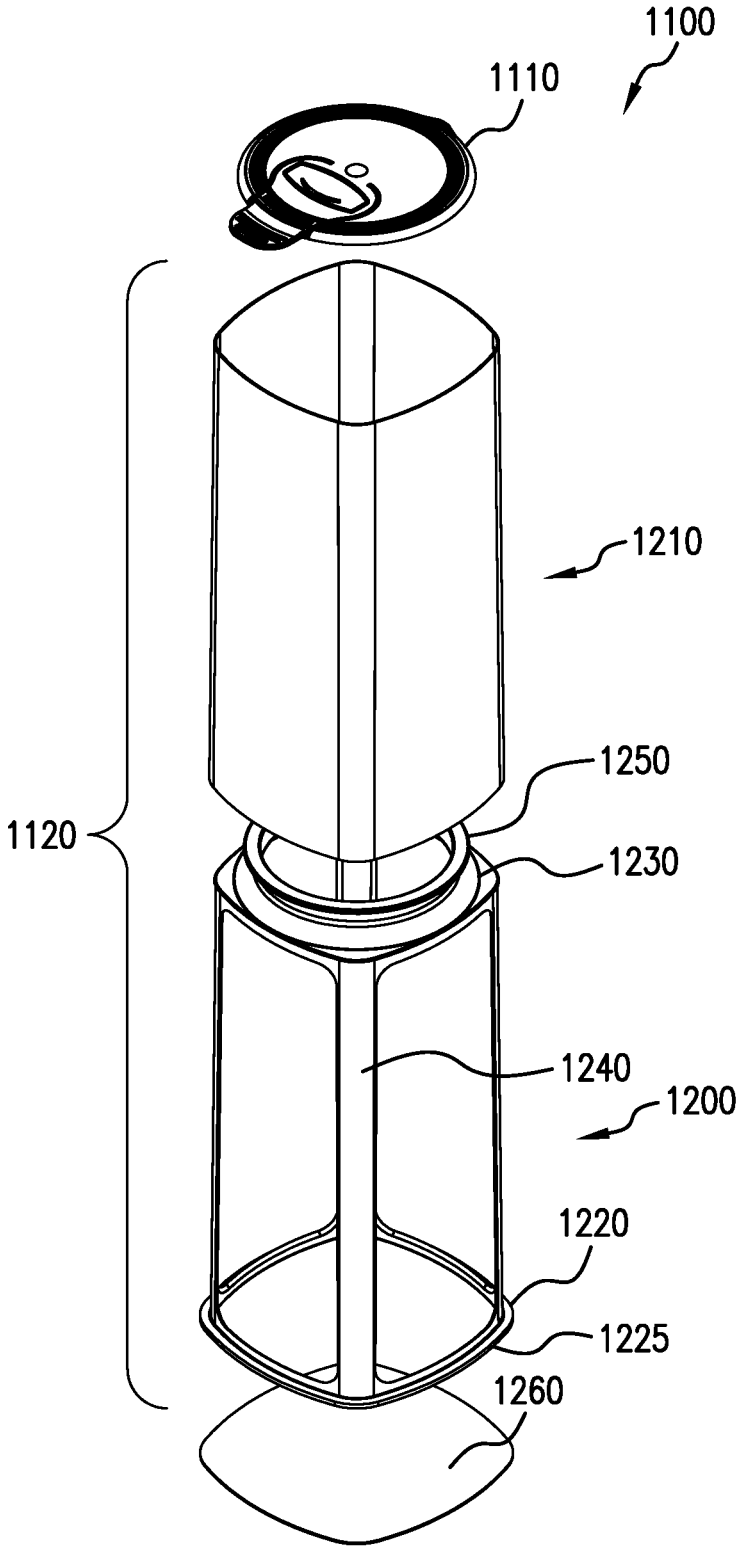
FIG. 12 is an exploded view of the fusion package of FIG. 11A in accordance with implementations.
Figure 13:
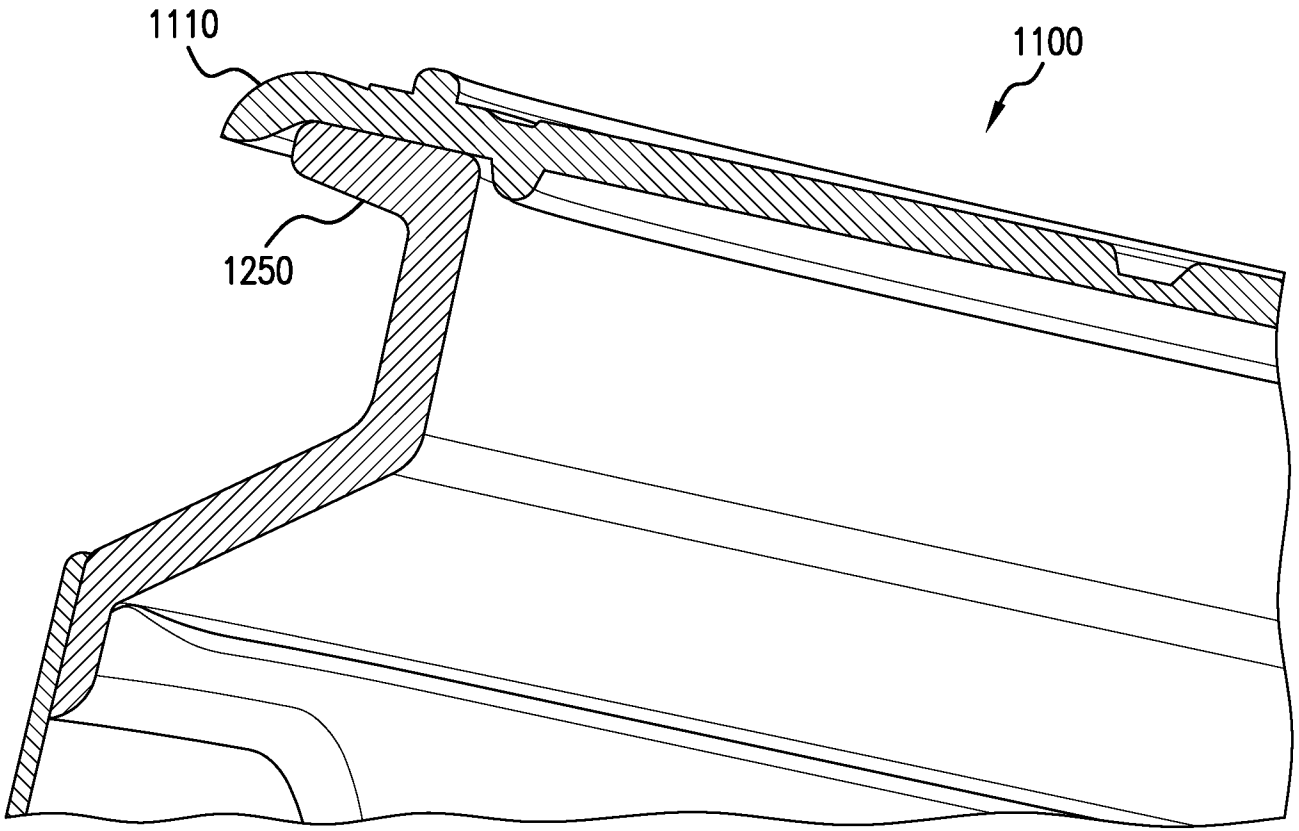
FIG. 13 is a cross-sectional view of the fusion package of FIG. 11A in accordance with implementations.
Figure 14:
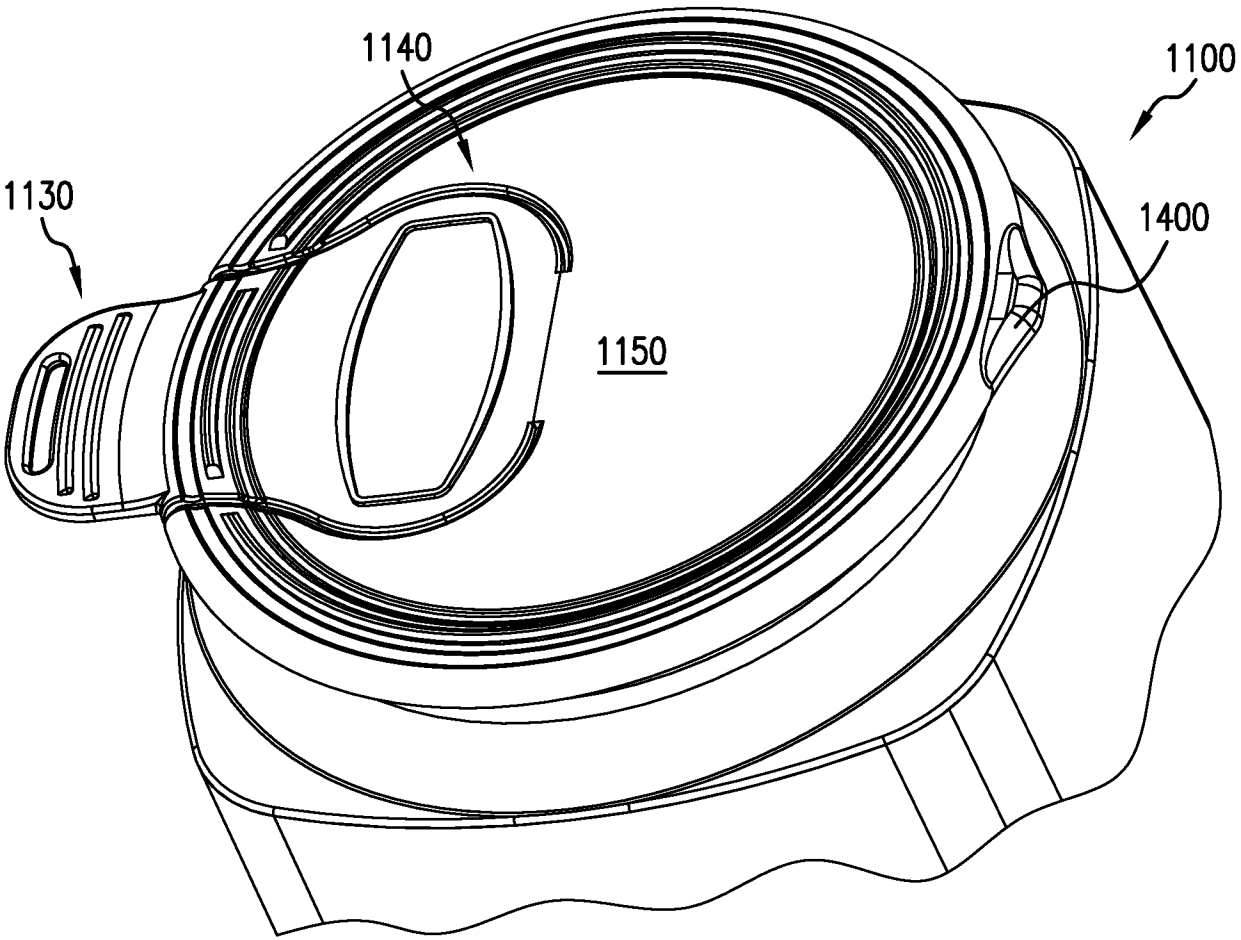
FIG. 14 is a top view of the fusion package of FIG. 11A in accordance with implementations.
Figure 15:
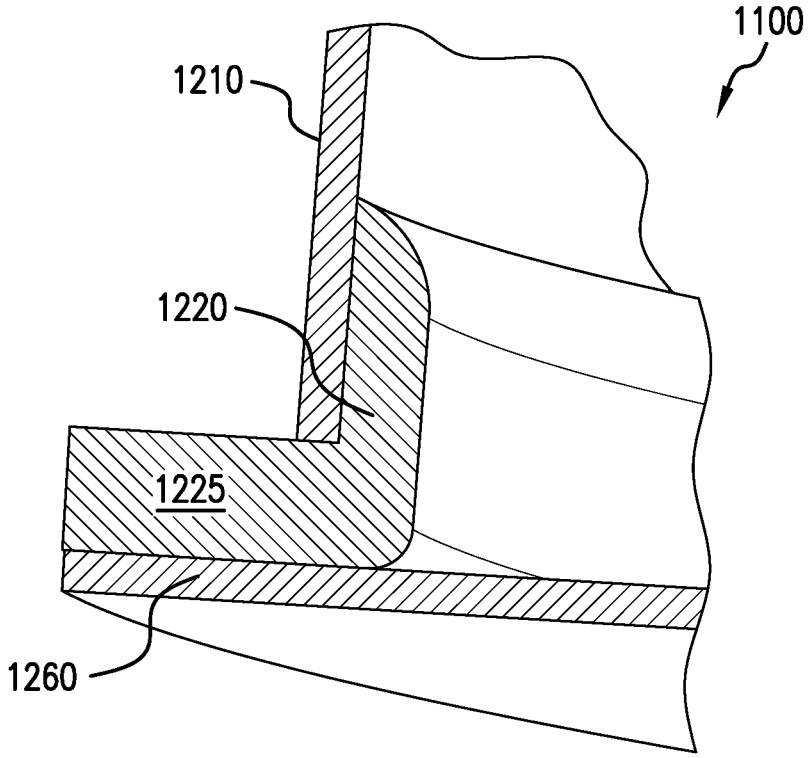
FIG. 15 is a cross-sectional view of the fusion package of FIG. 11A in accordance with implementations.

FIG. 12 is an exploded view of the fusion package 1100 of FIG. 11A in accordance with implementations, FIG. 13 is a cross-sectional view of the fusion package 1100 of FIG. 11A in accordance with implementations, FIG. 14 is a top view of the fusion package 1100 of FIG. 11A in accordance with implementations, and FIG. 15 is a cross-sectional view of the fusion package 1100 of FIG. 11A in accordance with implementations. The package body 1120 includes a frame 1200 and a sidewall 1210. The frame 1200 includes a bottom 1220, a neck 1230, and legs 1240 for connecting the bottom 1220 and the neck 1230. The bottom 1220 includes a flange 1225. The neck 1230 includes a rim 1250. A seal 1260 is configured to engage the flange 1225 when closing the fusion package 1100. The cap 1110 includes a tab element retainer 1400 configured to engage the tab element 1130. In implementations, the sidewall 1210 can be made from heavy film, paperboard, pressed pulp, and the like materials as described herein. In implementations, the sidewall 1210 can include a barrier layer or film on an internal or inside surface. In implementations, the sidewall 1210 can include an integrated barrier layer, film, and/or material. In implementations, the frame 1200 can be made using the structure forming processes described herein using the materials described herein.

The fusion package 1100 uses the join processing to fuse the sidewall 1210 with the frame 1200 and the cap 1110 to the rim 1250. The fusion package 1100 is filled from a bottom and then the seal 1260 is fused to the flange 1225. In implementations, fusing of the seal 1260 can be done at a content or material production site. That is, a non-sealed fusion package 1100 can be shipped to a manufacturer of the material, who can then fill and seal the fusion package 1100. The fusion package 1100 is opened by pulling the tab element 1130 which tears the tearable membrane portion 1140 until hitting the tether mechanism 1150, which prevents environmental disposal issues and enables sustainability. The tab element 1130 engages the tab element retainer 1400 to prevent interference with disposal of the content or material.

Figures 16A, 16B:
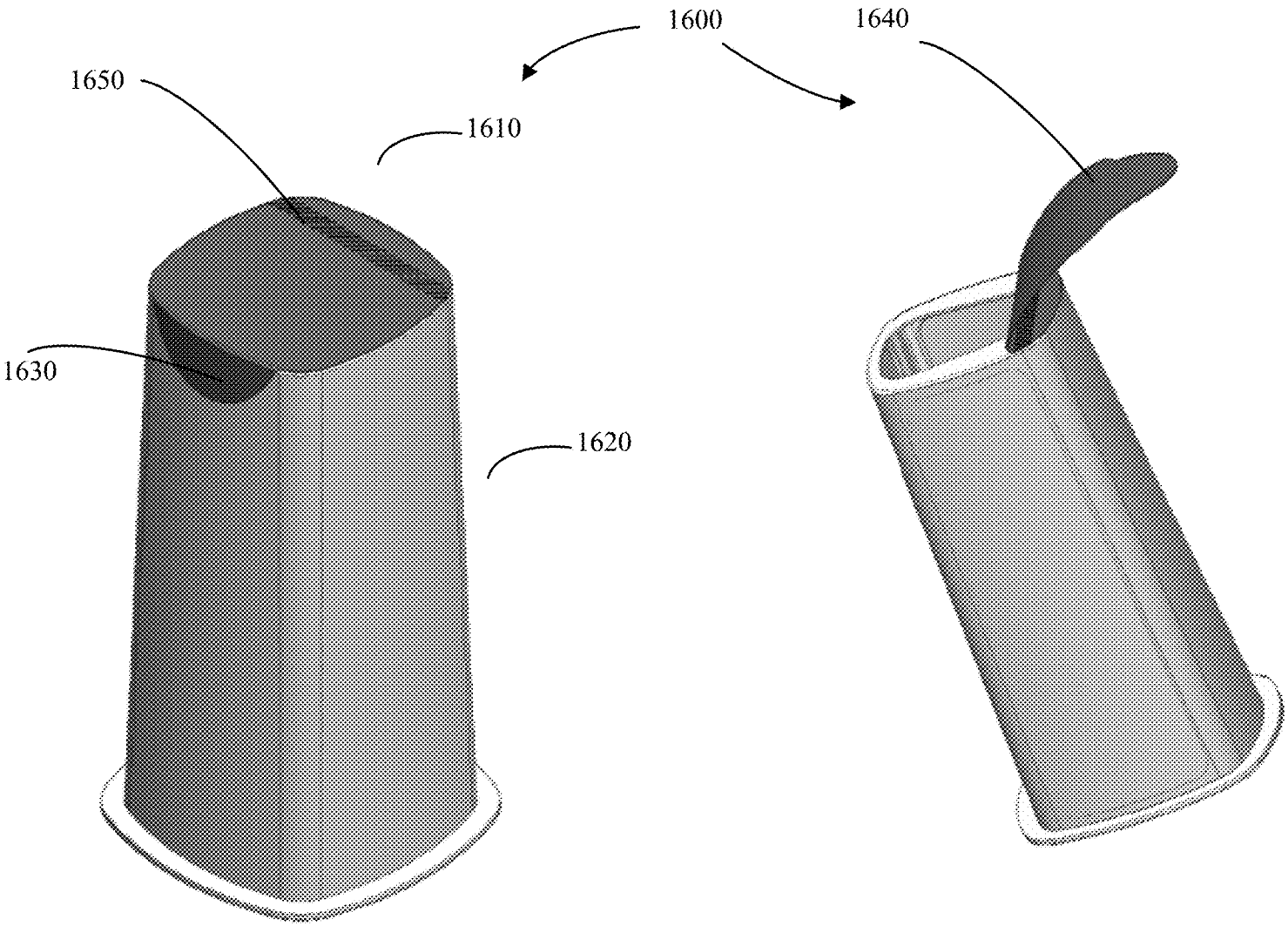
FIG. 16A and FIG. 16B are diagrams of a fusion package in a closed position and an open position, respectively, in accordance with implementations.

FIG. 16A and FIG. 16B are diagrams of a fusion package 1600 in a closed position and an open position, respectively, in accordance with implementations. The fusion package 1600 includes a seal 1610 and a package body 1620. The seal 1610 includes a tab element 1630, a peelable portion 1640, and a retain portion or tether mechanism 1650. In implementations, the tether mechanism 1650 is a hinge-like mechanism.

Figure 17:
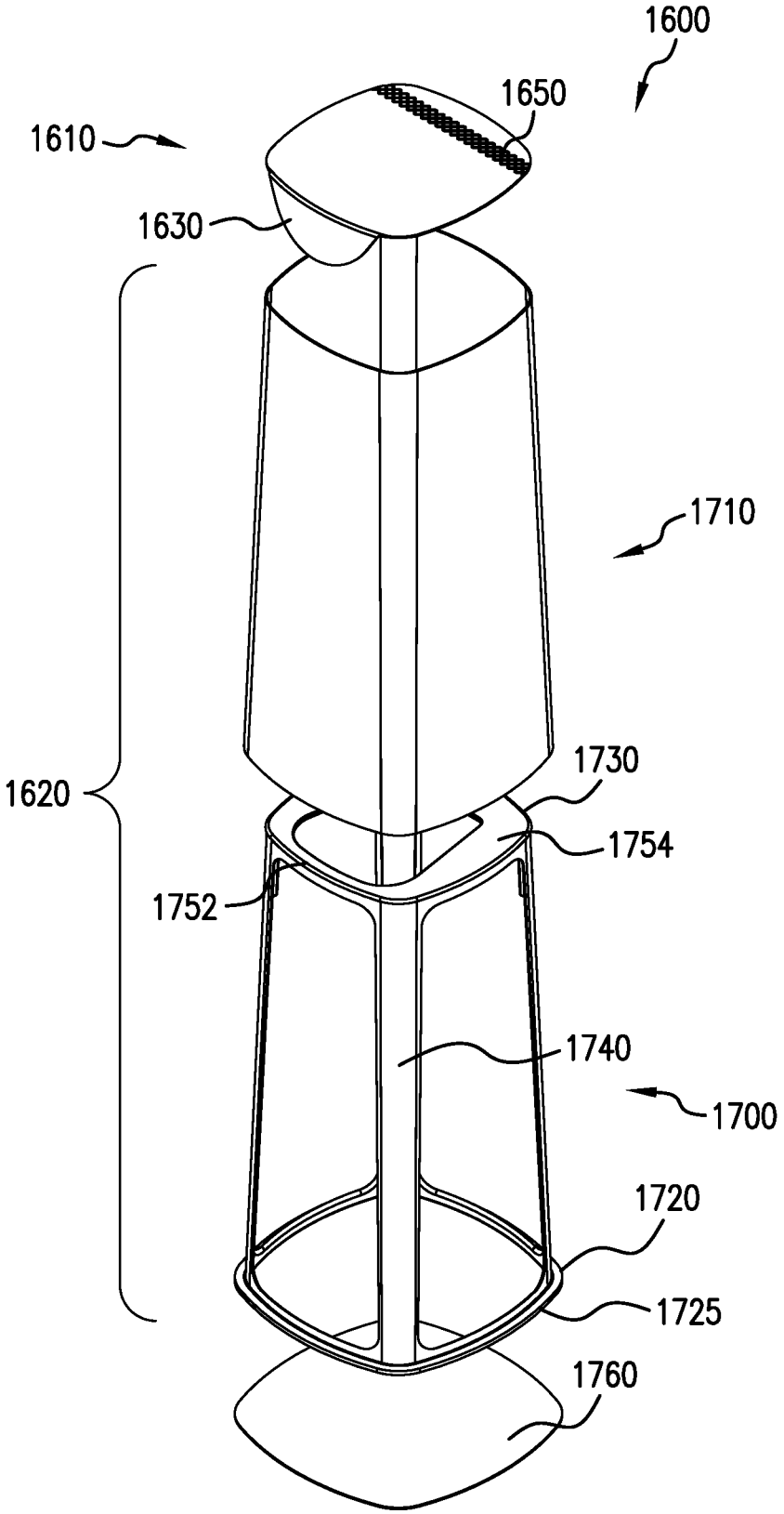
FIG. 17 is an exploded view of the fusion package of FIG. 16A in accordance with implementations.
Figure 18:
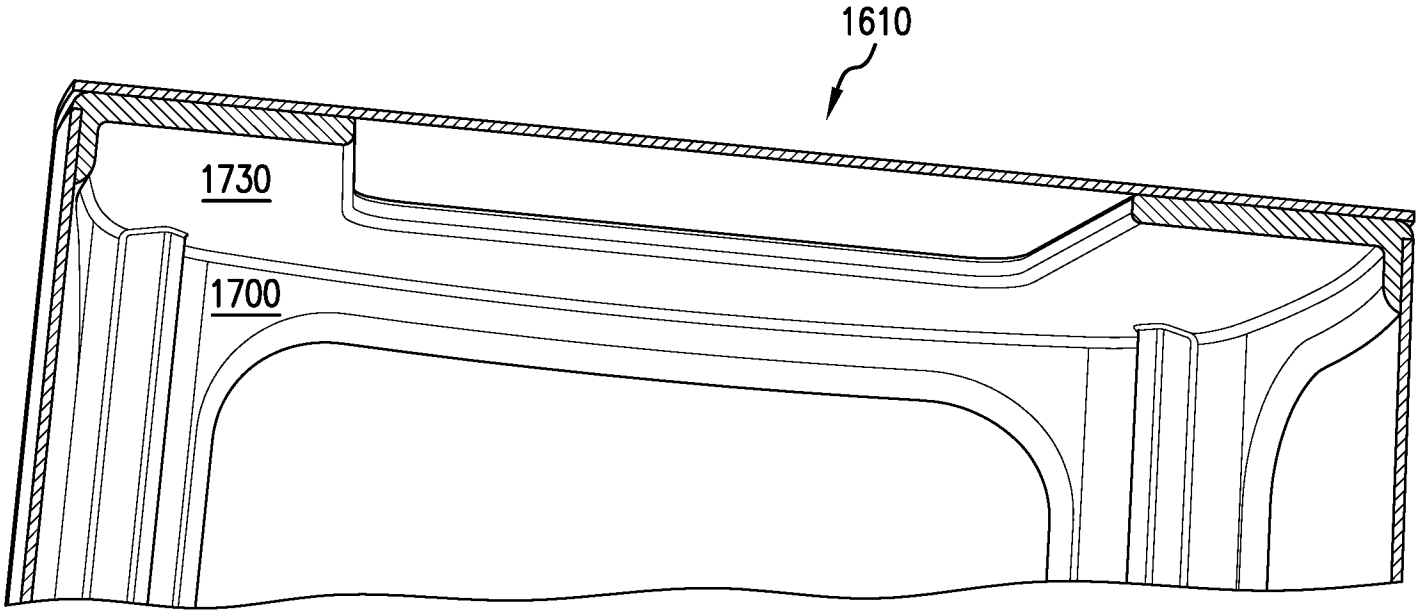
FIG. 18 is a cross-sectional view of the fusion package of FIG. 16A in accordance with implementations.
Figure 19A:
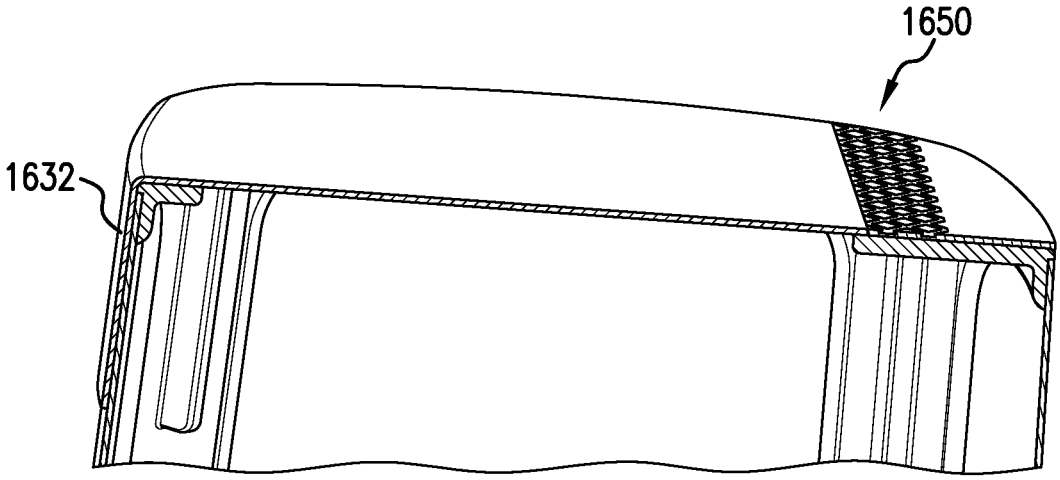
FIG. 19A and FIG. 19B are cross-sectional views of the fusion package of FIG. 16A in accordance with implementations.
Figure 19B:
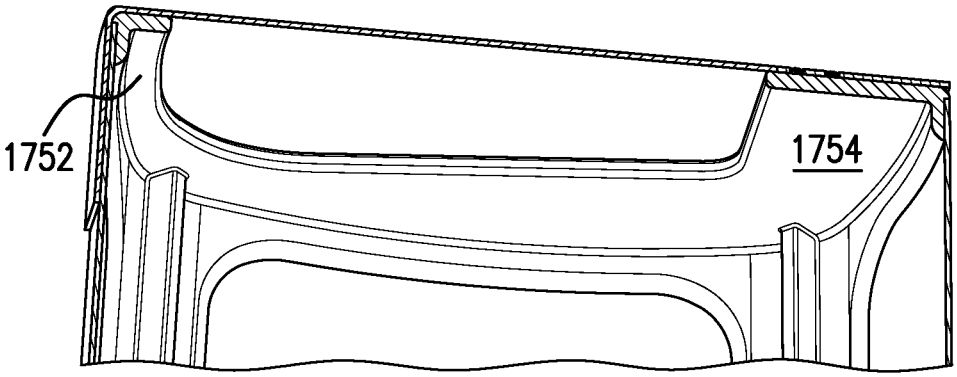

FIG. 17 is an exploded view of the fusion package 1600 of FIG. 16A in accordance with implementations, FIG. 18 is a cross-sectional view of the fusion package 1600 of FIG. 16A in accordance with implementations, FIG. 19A is a top cross-sectional view of the fusion package 1600 of FIG. 16A in accordance with implementations, and FIG. 19B is a top cross-sectional view of the fusion package 1600 of FIG. 16A in accordance with implementations. The package body 1620 includes a frame 1700 and a sidewall 1710. The frame 1700 includes a bottom 1720, a neck 1730, and a pair of legs 1740 for connecting the bottom 1720 and the neck 1730. The bottom 1720 includes a flange 1725. The neck 1730 includes a rim 1750 having a narrow section 1752 and a wide section 1754. A seal 1760 is configured to engage the flange 1725 when closing the fusion package 1600. As shown in FIG. 19A and FIG. 19B, the tether mechanism 1650 is situated on the wide section 1754 of the rim 1750. In implementations, the sidewall 1710 can be made from heavy film, paperboard, pressed pulp, and the like materials as described herein. In implementations, the sidewall 1710 can include a barrier layer or film on an internal or inside surface. In implementations, the sidewall 1710 can include an integrated barrier layer, film, and/or material. In implementations, the frame 1700 can be made using the structure forming processes described herein using the materials described herein.

The fusion package 100 uses the join processing to fuse the sidewall 1710 with the frame 1700, a portion of the peelable portion 1640 to portions of the rim 1750, and a portion 1632 of the tab element 1630 with the sidewall 1710, as shown in FIG. 19A. The fusion package 1700 is filled from a bottom and then the seal 1760 is fused to the flange 1725. In implementations, fusing of the seal 1760 can be done at a content or material production site. That is, a non-sealed fusion package 1600 can be shipped to a manufacturer of the material, who can then fill and seal the fusion package 1600. The fusion package 1600 is opened by pulling the portion 1632 of the tab element 1630 and the tab element 1130 which peels the peelable portion 1640 until hitting the tether mechanism 1650, which prevents environmental disposal issues and enables sustainability.

Figure 20:
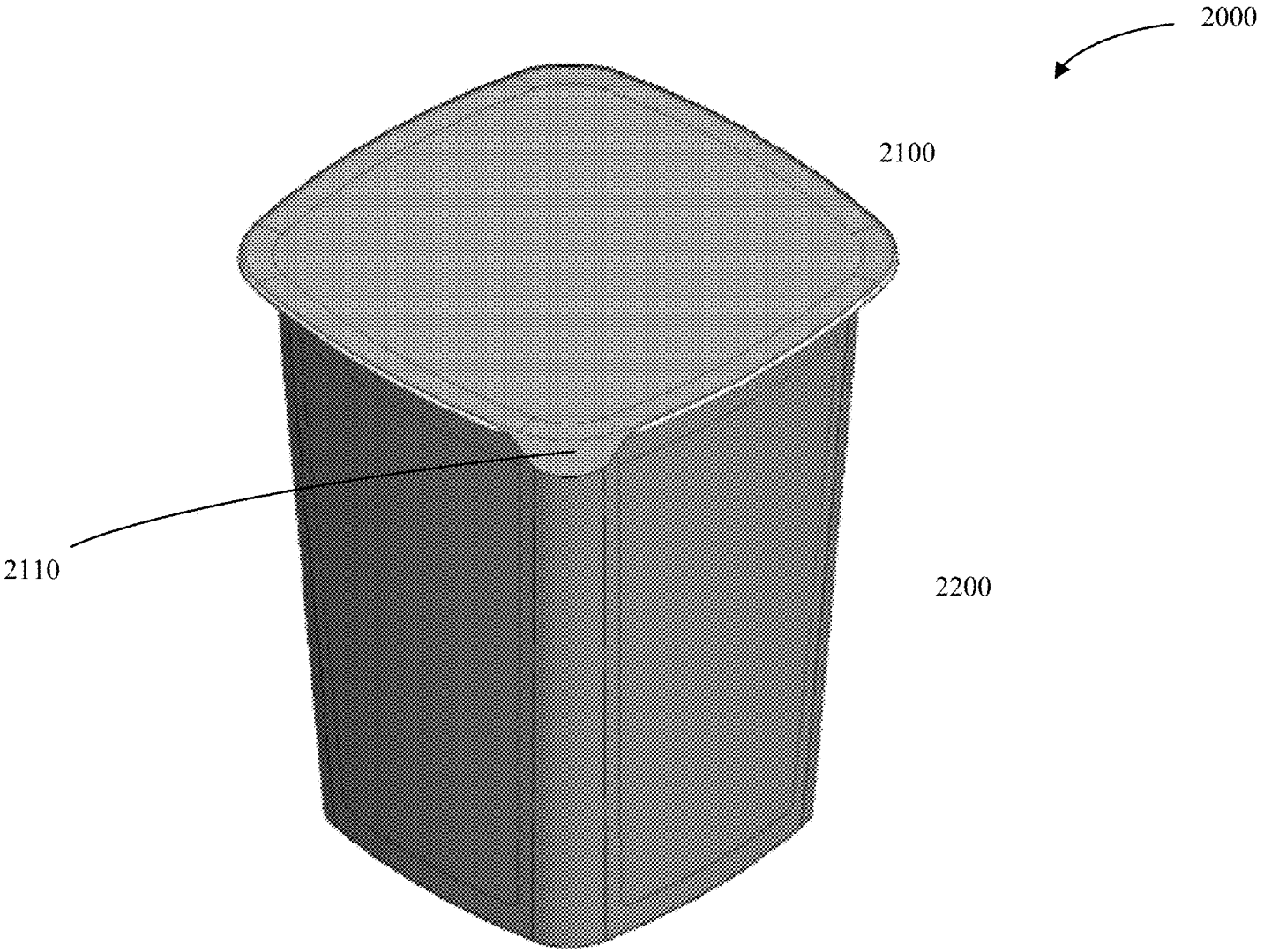
FIG. 20 is a diagram of a fusion package in a closed position in accordance with implementations.
Figure 21:
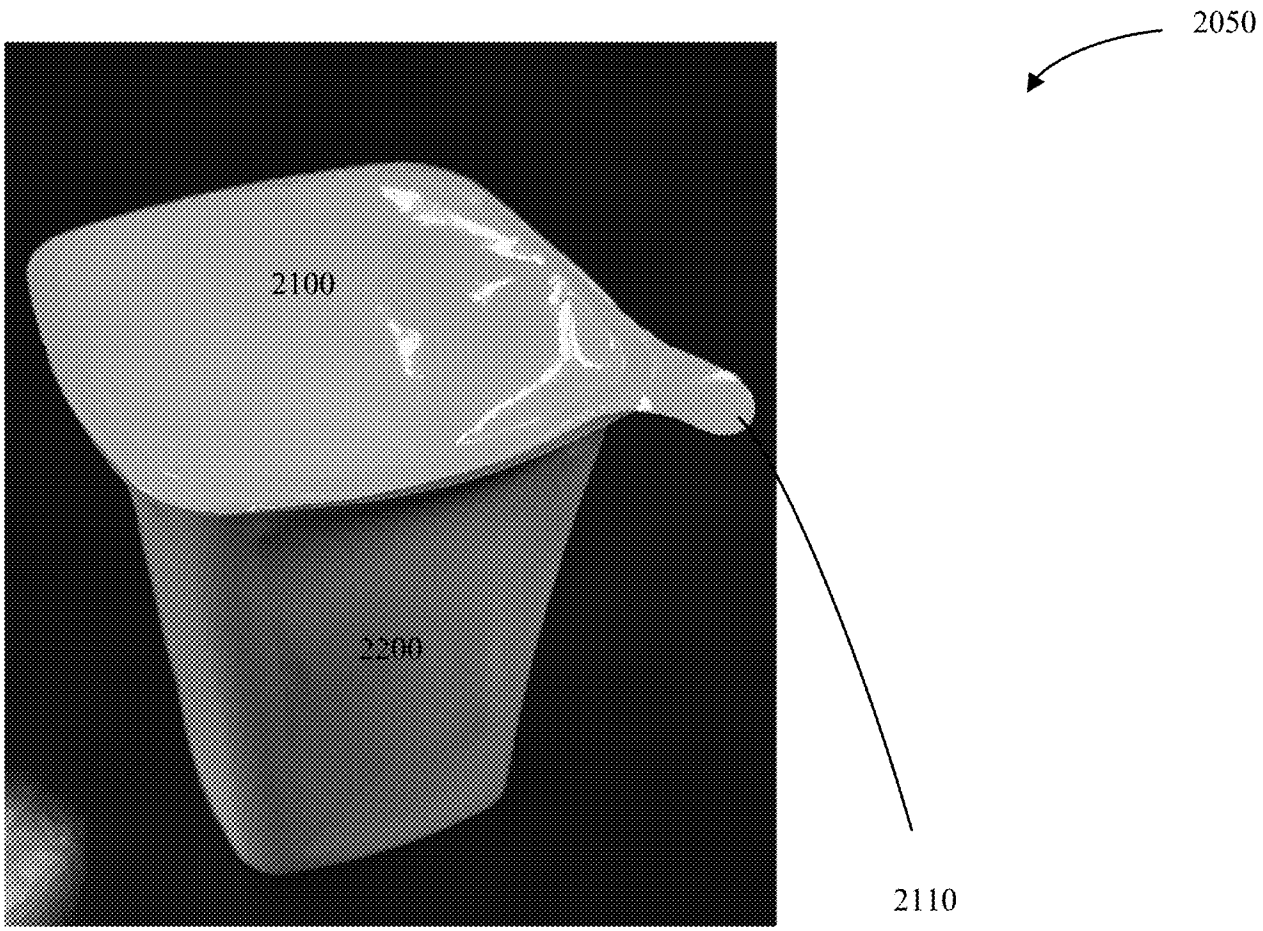
FIG. 21 is an example photo of the fusion package of FIG. 20 in accordance with implementations.
Figure 22:
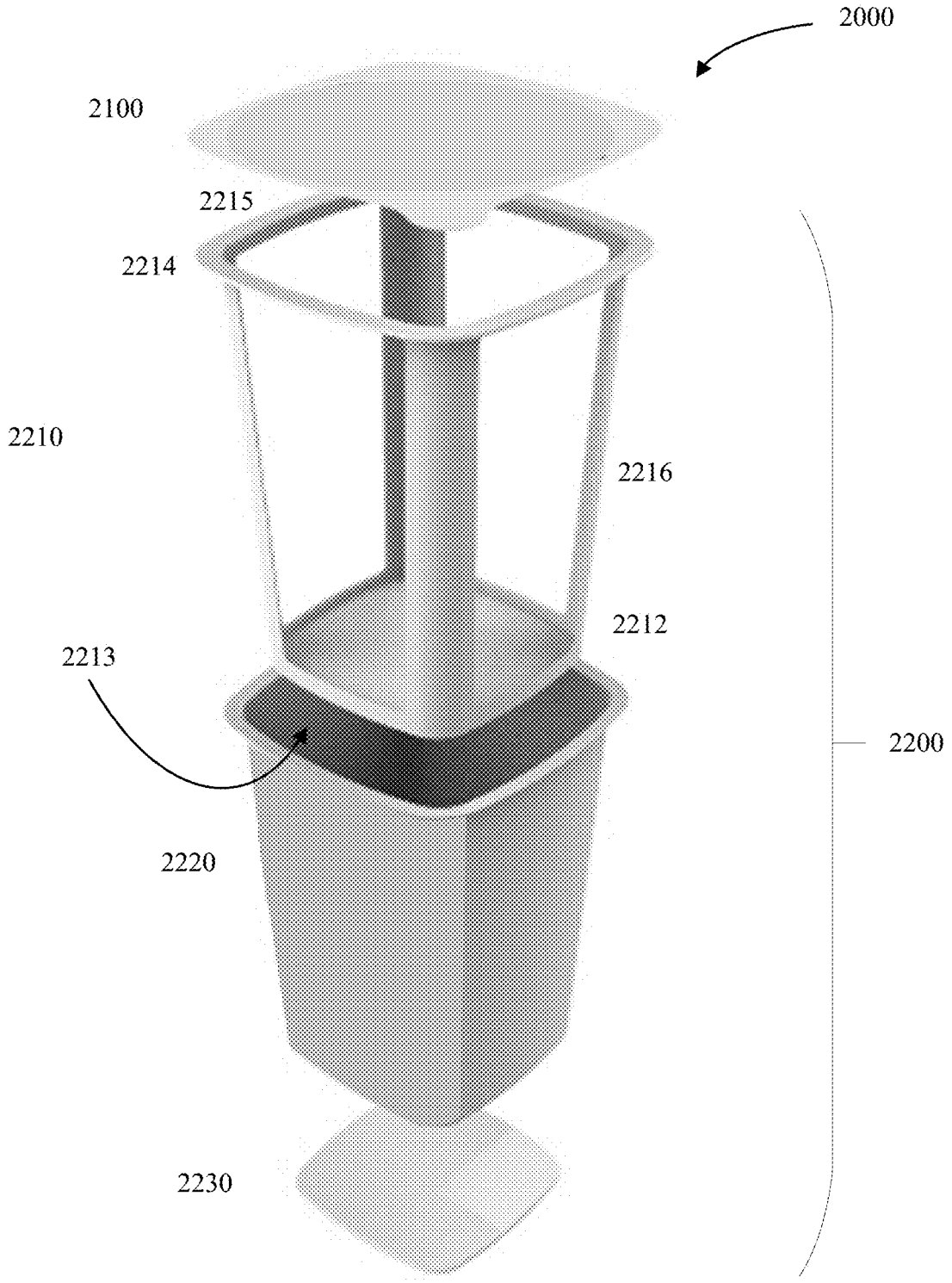
FIG. 22 is an exploded view of the fusion package of FIG. 20 in accordance with implementations.

FIG. 20 is a diagram of a fusion package 2000 in a closed position in accordance with implementations. FIG. 21 is an example photo 2050 of the fusion package 2000 in accordance with implementations. FIG. 22 is an exploded view of the fusion package 2000 in accordance with implementations. The fusion package 2000 includes a seal 2100 and a package body 2200. The seal 2100 includes a pull tab 2110. The package body 2200 a frame 2210, a sidewall 2220 and a seal 2230. The frame 2210 includes a bottom 2212, a neck 2214, and legs 2216 for connecting the bottom 2212 and the neck 2214. The bottom 2212 includes a surface 2213. The neck 2214 includes a rim 2215. In implementations, the sidewall 2220 can be made from heavy film, paperboard, pressed pulp, and the like materials as described herein. In implementations, the sidewall 2220 can include a barrier layer or film on an internal or inside surface. In implementations, the sidewall 2220 can include an integrated barrier layer, film, and/or material. In implementations, the frame 2210 can be made using the structure forming processes described herein using the materials described herein.

The fusion package 100 uses the join processing to fuse the sidewall 2220, the frame 2210, and the seal 2230 together. The fusion package 2000 is filled from a top and then the seal 2100 is fused to the rim 2215. In implementations, fusing of the cap 2100 can be done at a content or material production site. That is, a non-sealed fusion package 2000 can be shipped to a manufacturer of the material, who can then fill and seal the fusion package 2000. The fusion package 2000 is opened by peeling the cap 2100.

Figures 23A, 23B:
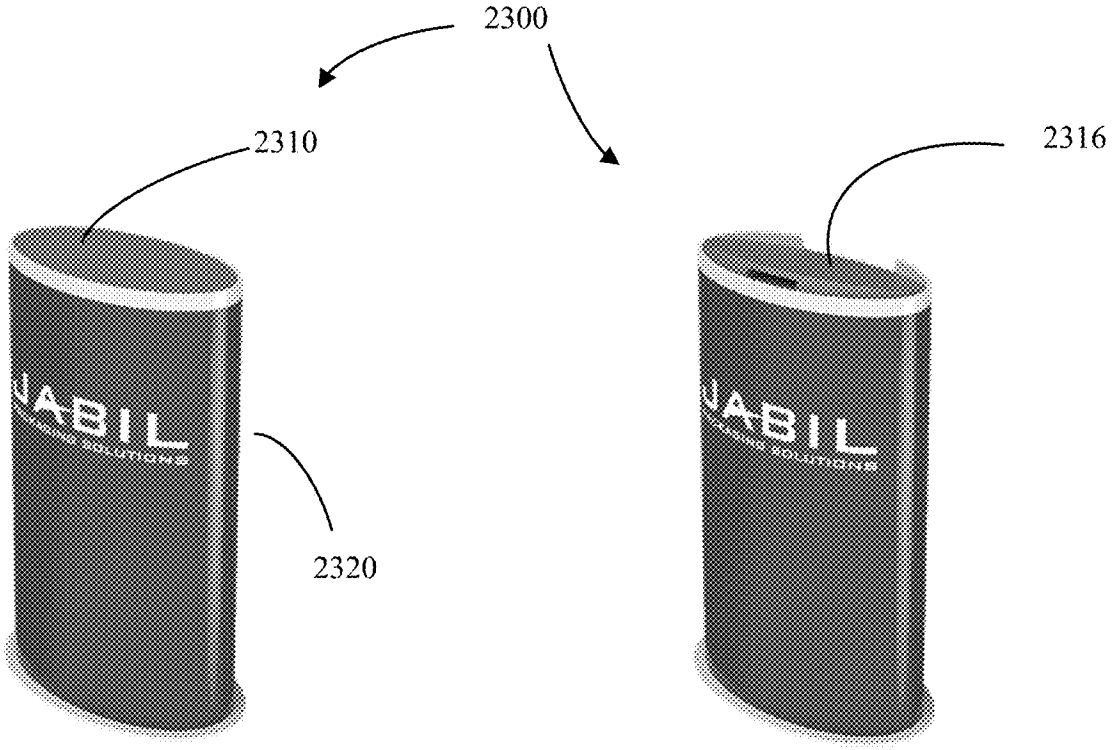
FIG. 23A and FIG. 23B are diagrams of a fusion package in a closed position and an open position, respectively, in accordance with implementations.

FIG. 23A and FIG. 23B are diagrams of a fusion package 2300 in a closed position and an open position, respectively, in accordance with implementations. The fusion package 2300 includes a cap 2310 and a package body 2320. The cap 2310 includes an opening 2312 for dispensing the content or material contained in the fusion package 2300. For example, the package body 2320 can be squeezed to cause expulsion of the content or material via the opening 2312.

Figure 24:
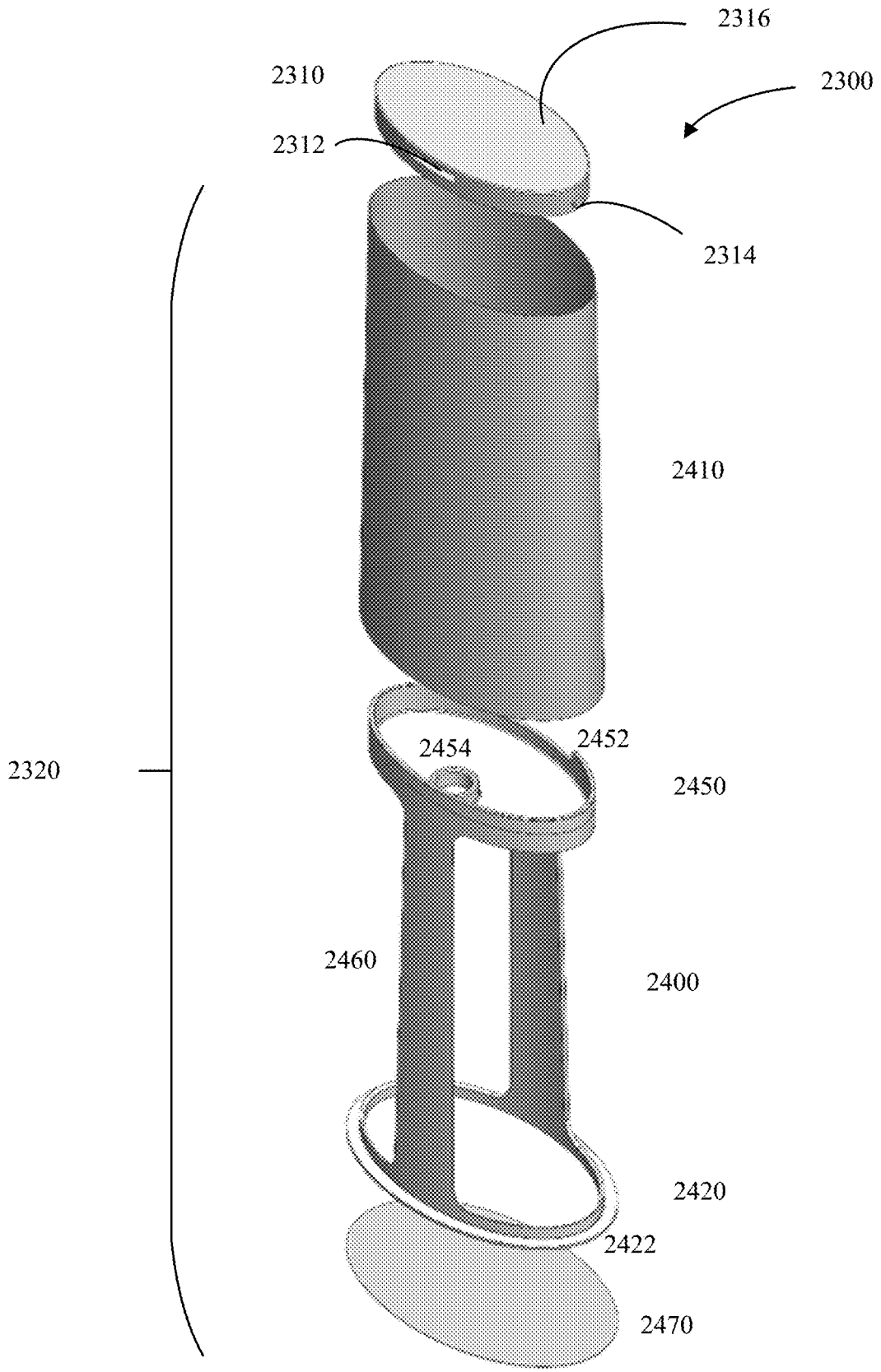
FIG. 24 is an exploded view of the fusion package of FIG. 23A in accordance with implementations.

FIG. 24 is an exploded view of the fusion package 2300 of FIG. 23A in accordance with implementations. The package body 2320 includes a frame 2400 and a sidewall 2410. The frame 2400 includes a bottom 2420, a neck 2450, and a pair of legs 2460 for connecting the bottom 2420 and the neck 2450. The bottom 2420 includes a flange 2422. The neck 2450 includes an opening 2452 and a ring structure 2454 extending into an internal portion of the frame 2400. A seal 2470 is configured to engage the flange 2422 when closing the fusion package 2300. In implementations, the sidewall 2410 can be made from heavy film, paperboard, pressed pulp, and the like materials as described herein. In implementations, the sidewall 2410 can include a barrier layer or film on an internal or inside surface. In implementations, the sidewall 2410 can include an integrated barrier layer, film, and/or material. In implementations, the frame 2400 can be made using the structure forming processes described herein using the materials described herein.

The cap 2310 includes an opening 2312 and a pair of pivot arms 2314 on opposite ends of the cap 2310. The pivot arms 2314 are configured to engage a mating structure on an internal surface of the neck 2450. The cap 2310 can pivot between a closed position as shown in FIG. 23A and a closed position as shown in FIG. 23B by pressing the cap 2310 at a spot 2316 which is proximate the opening 2452.

The fusion package 100 uses the join processing to fuse the sidewall 2410 with the frame 2400. The cap 2310 is snapped into place on the frame 2400. The fusion package 100 is filled from a bottom and then the seal 2470 is fused to the flange 2422. The fusion package 2300 is opened by pushing on the spit 2316 of the cap 2310. This enables content to be disposed via the ring 2454 and the opening 2312.

Figure 26:
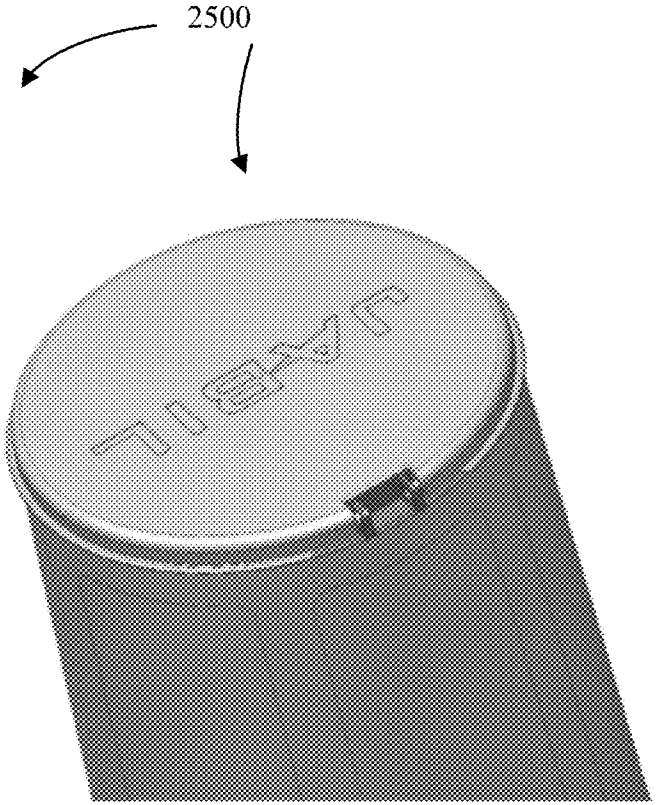
FIG. 26 is a reverse view of the fusion package of FIG. 25 in accordance with implementations.
Figure 25:
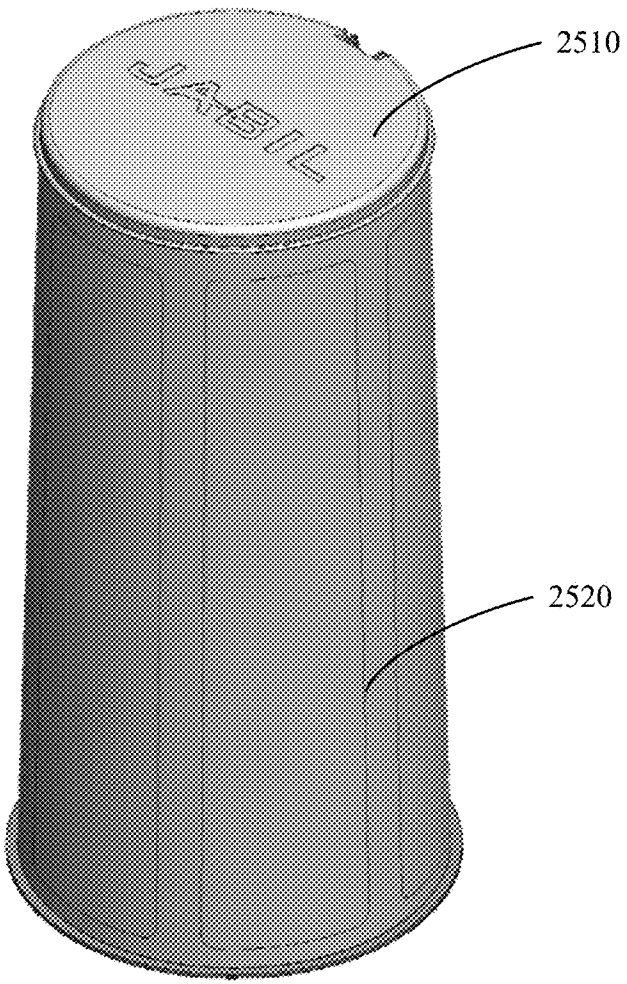
FIG. 25 is a diagram of a fusion package in a closed position in accordance with implementations.

FIG. 25 is a diagram of a fusion package 2500 in a closed position in accordance with implementations. FIG. 26 is a reverse view of the fusion package 2500 in accordance with implementations. The fusion package 2500 includes a cap 2510 and a package body 2520. The cap 2510 and the package body 2520 include a hinge mechanism to hingedly connect the cap 2510 and the package body 2520 so that the cap 2510 can be opened and closed as needed.

Figure 27:
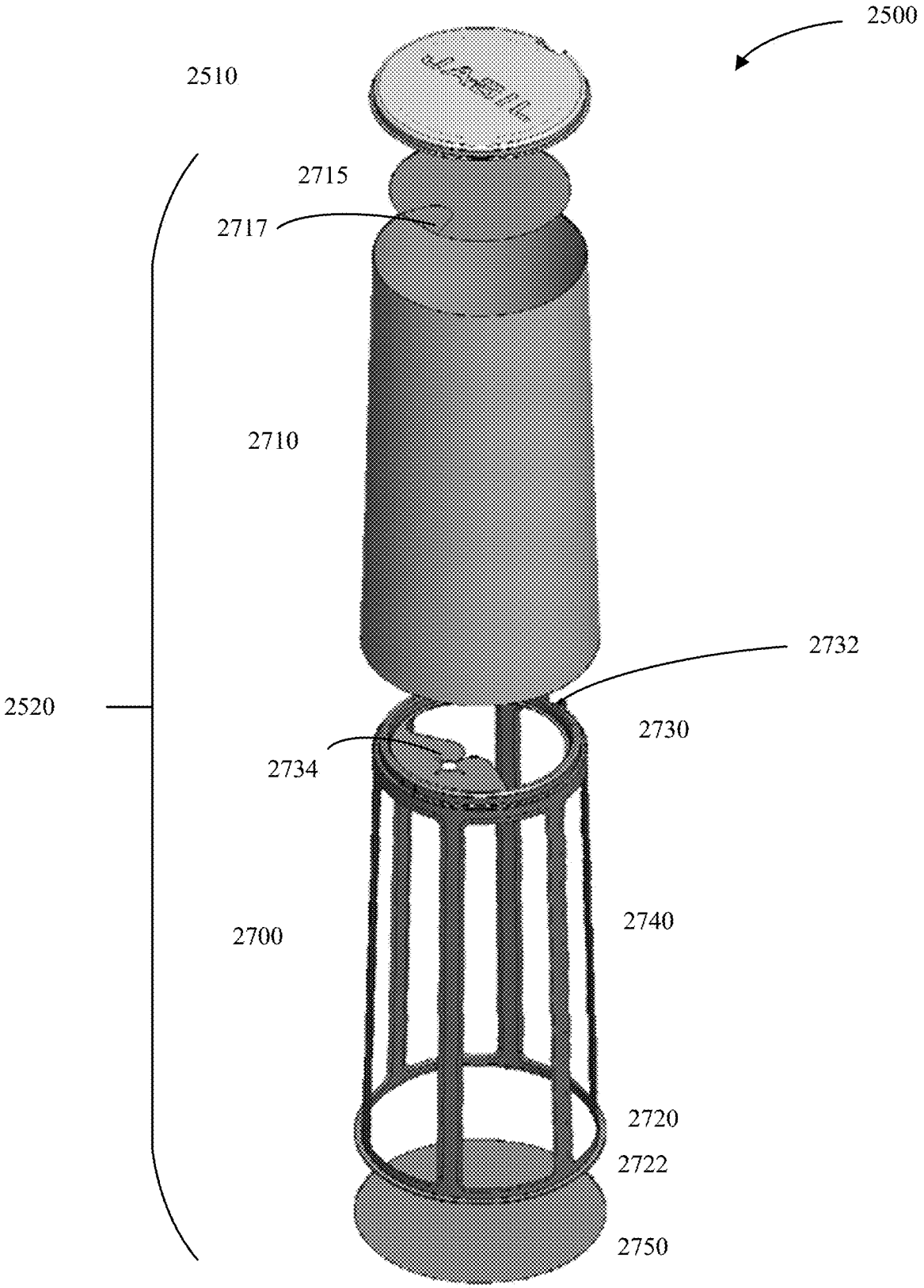
FIG. 27 is an exploded view of the fusion package of FIG. 25 in accordance with implementations.
Figure 28:
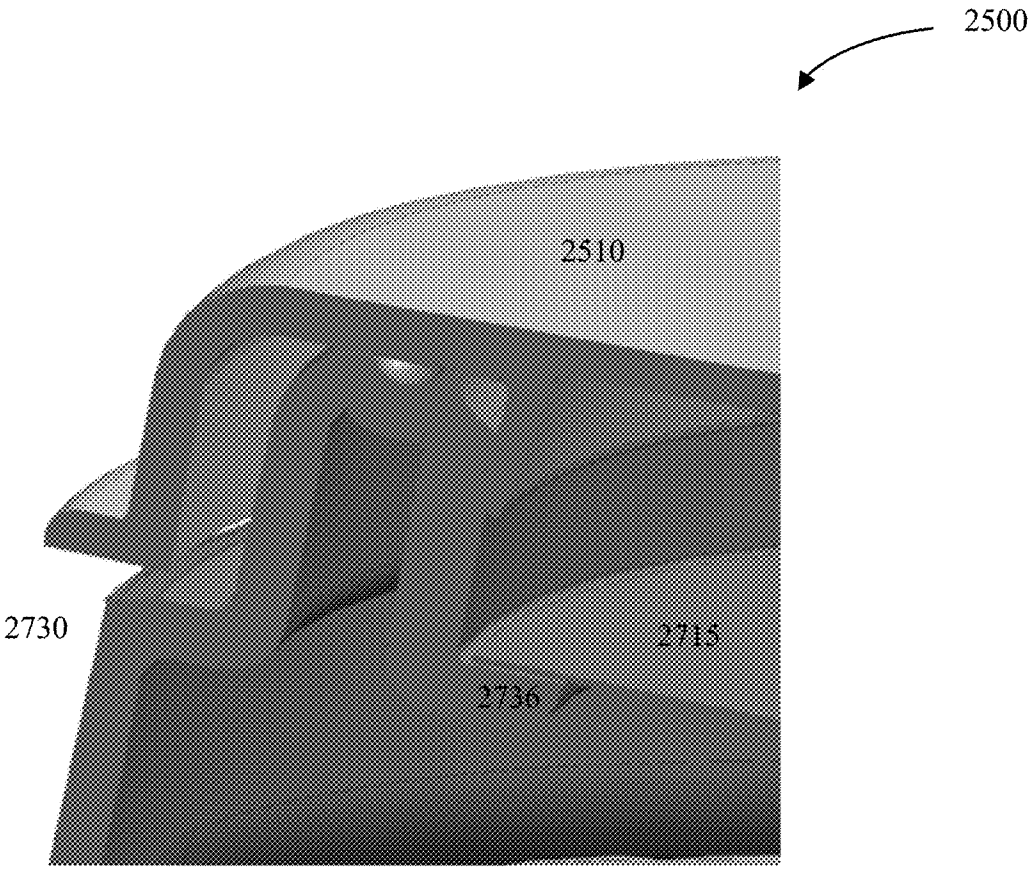
FIG. 28 is a cross-sectional view of the fusion package of FIG. 25 in accordance with implementations.

FIG. 27 is an exploded view of the fusion package 2500 in accordance with implementations. FIG. 28 is a cross-sectional view of the fusion package 2500 in accordance with implementations. The package body 2520 includes a frame 2700, a sidewall 2710, and a dispensing seal 2715. The frame 2700 includes a bottom 2720, a neck 2730, and legs 2740 for connecting the bottom 2720 and the neck 2730. The bottom 2720 includes a flange 2722. The neck 2730 includes a hinge mechanism 2732 and a dispensing structure 2734 extending into an internal portion of the frame 2500. In implementations, the dispensing structure 2734 is configured to hold and guide tissues, wipes, and the like out of the fusion package 2500. In implementations, the dispensing structure 2734 is a flexible structure including an opening 2900 connected to leaf openings 2910. A seal 2750 is configured to engage the flange 2722 when closing the fusion package 2700. The dispensing seal 2715 includes a perforated portion 2717 to permit access to the content.

In implementations, the sidewall 2710 can be made from heavy film, paperboard, pressed pulp, and the like materials as described herein. In implementations, the sidewall 2710 can include a barrier layer or film on an internal or inside surface. In implementations, the sidewall 2710 can include an integrated barrier layer, film, and/or material. In implementations, the frame 2700 can be made using the structure forming processes described herein using the materials described herein.

Figure 29:
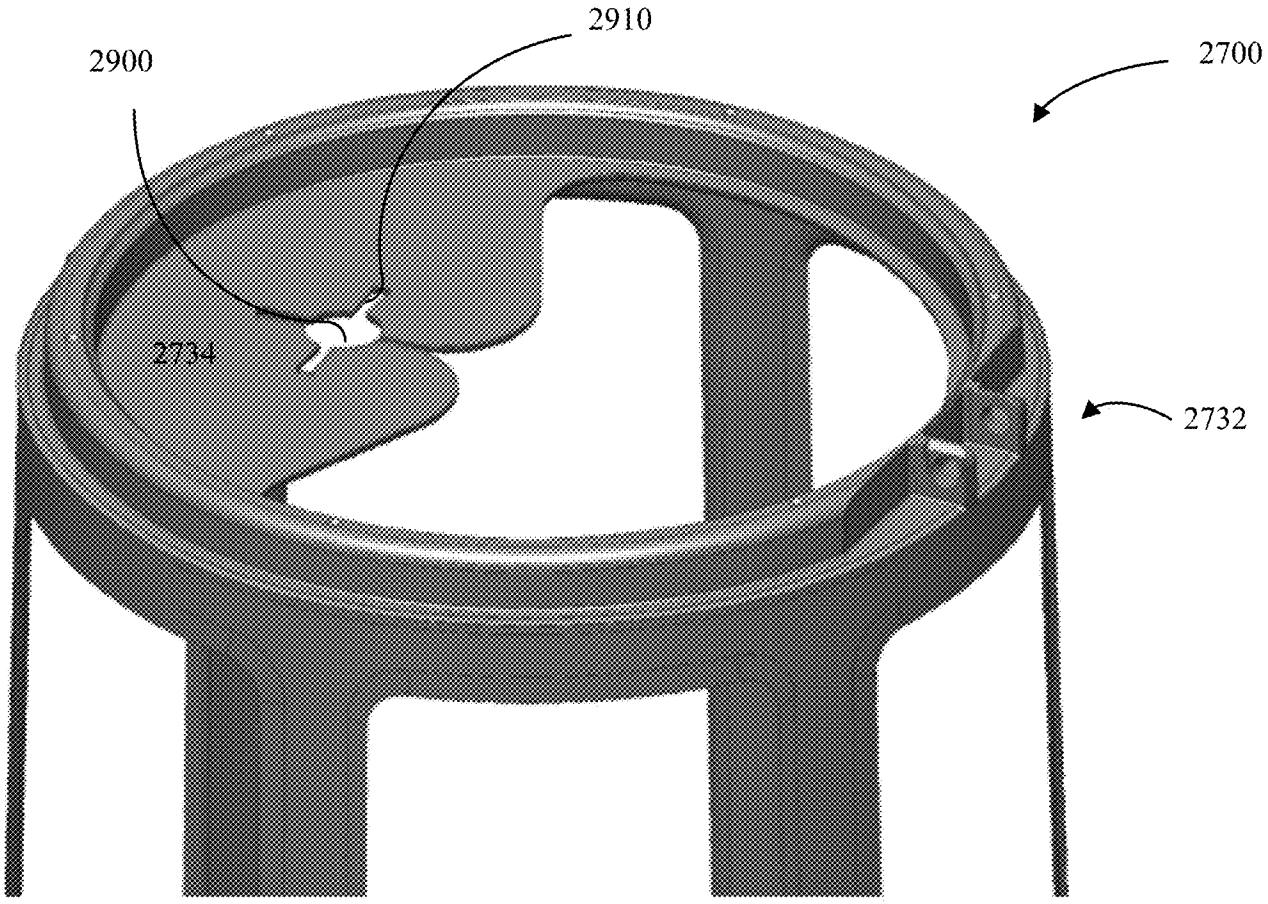
FIG. 29 is an enlarged view of the frame of FIG. 27 in accordance with implementations.
Figure 30:
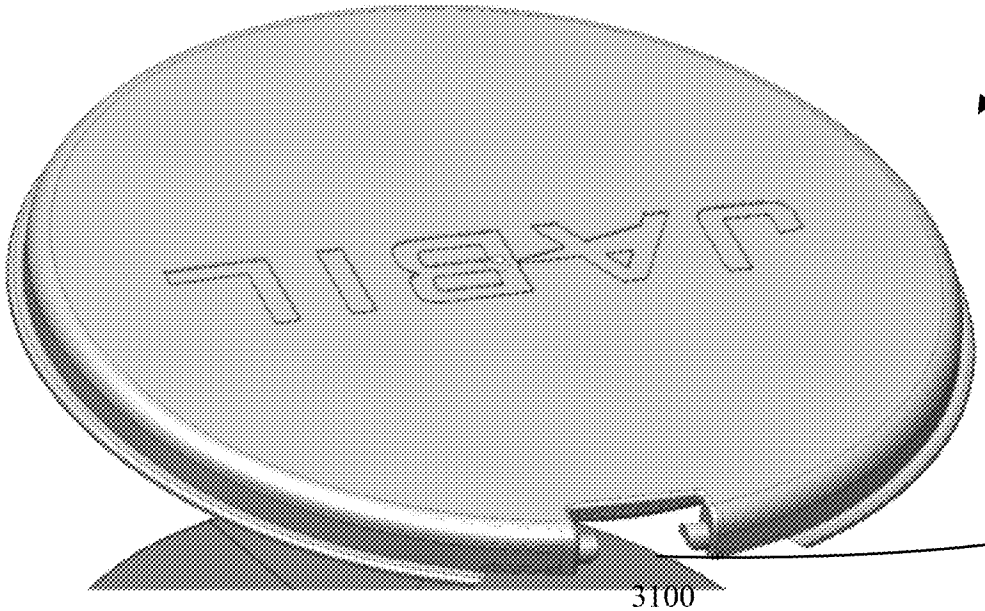
FIG. 30 is a perspective view of the lid of FIG. 25 in accordance with implementations.
Figure 31:
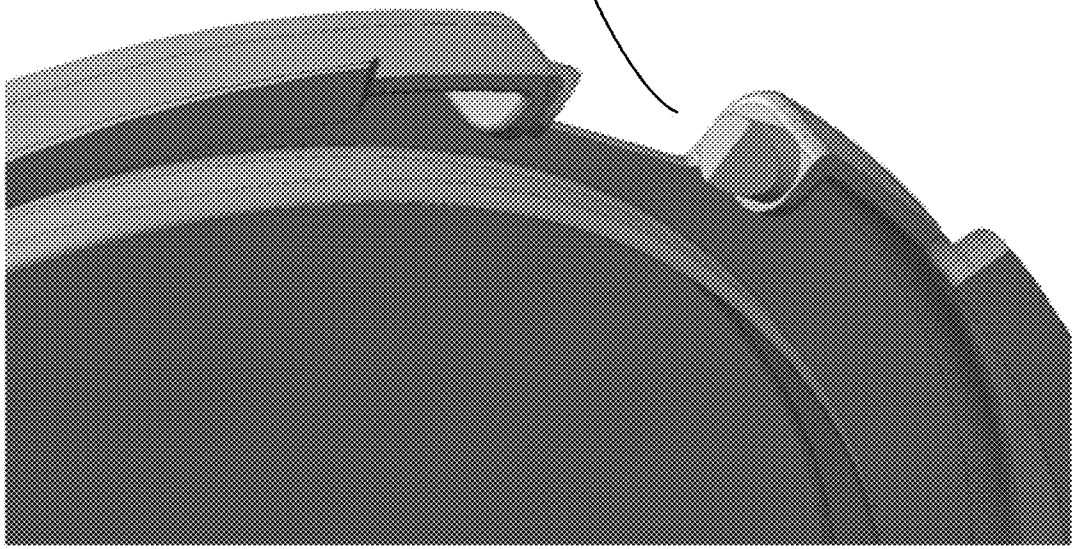
FIG. 31 is a reverse perspective view of the lid of FIG. 25 in accordance with implementations.

FIG. 29 is an enlarged view of the frame 2700 in accordance with implementations. FIG. 30 is a perspective view of the cap 2510 in accordance with implementations. FIG. 31 is a reverse perspective view the cap 2510 in accordance with implementations. The cap 2510 includes a hinge mechanism 3000 which is a pair of arms 3100. As noted, the neck 2730 includes a hinge mechanism 2732. The hinge mechanism 2732 is a pair of holes 2900 for coupling with the pair of arms 3100.

Figure 32:
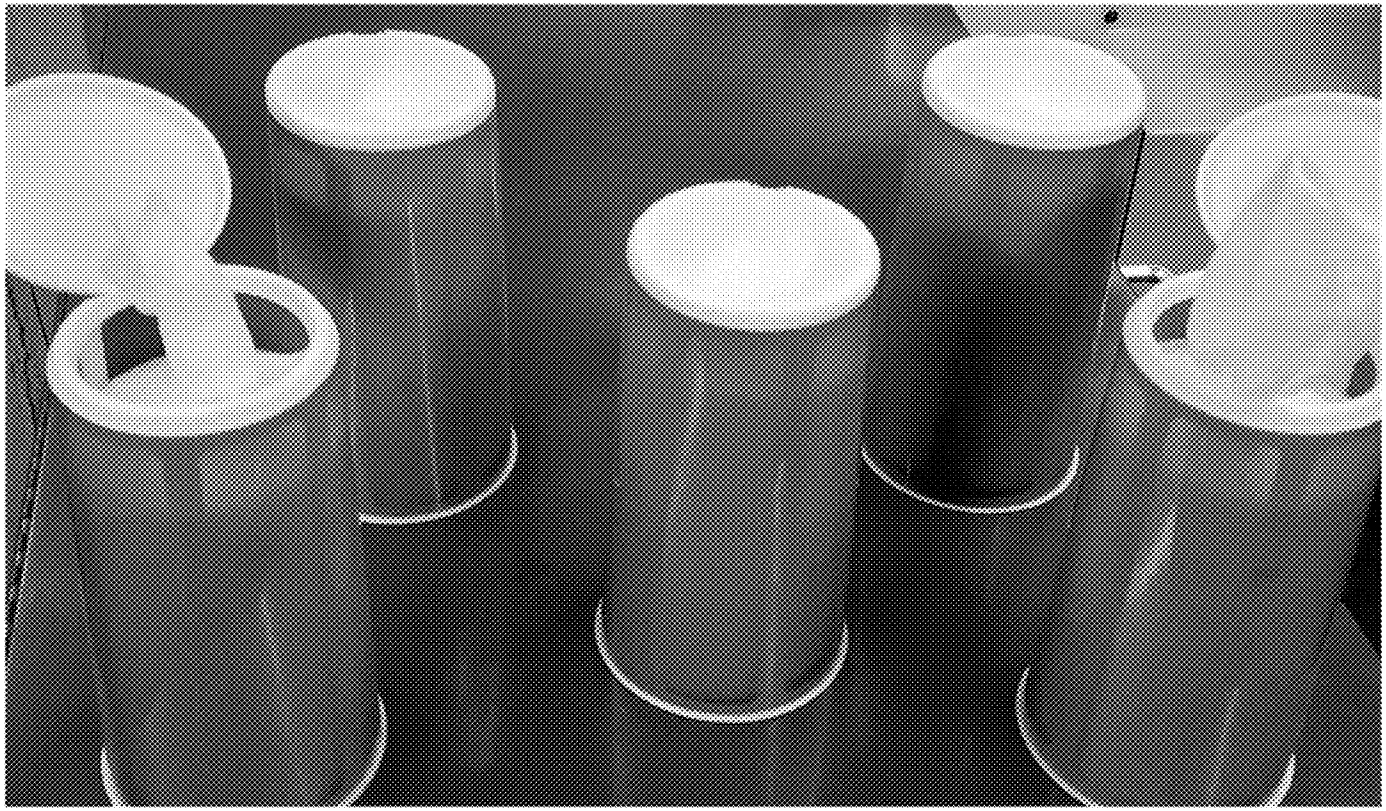
FIG. 32 are photos of example fusion packages of FIG. 25 in accordance with implementations.
Figure 34:
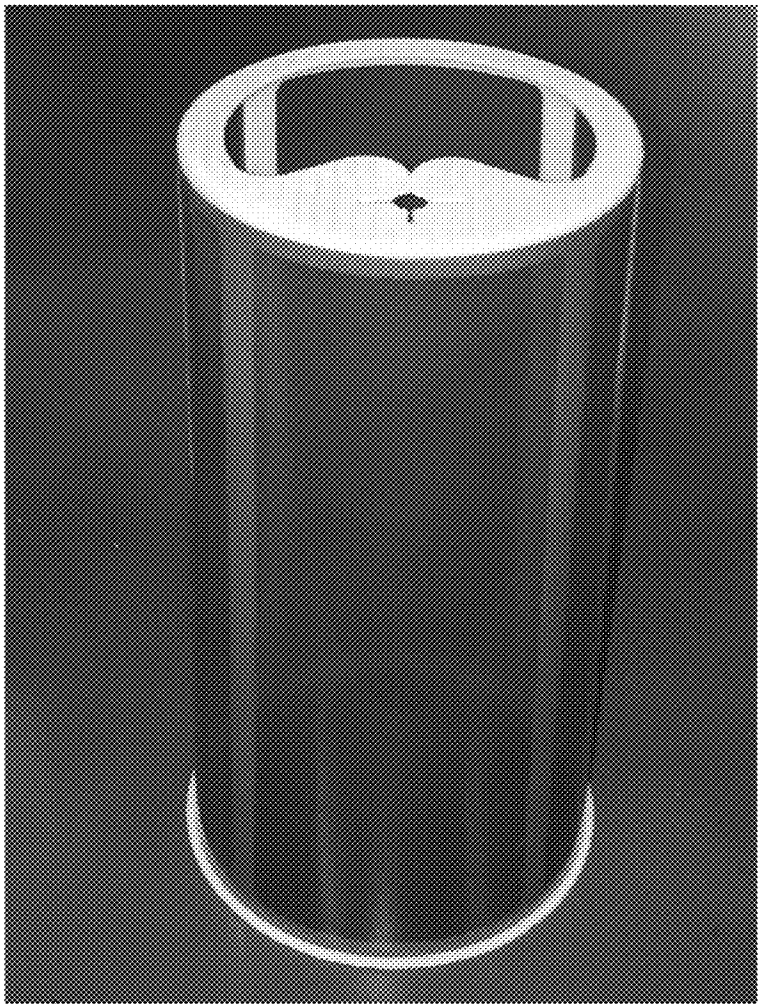
FIG. 34 is a photo of an example frame with sidewall of FIG. 27 in accordance with implementations.
Figure 33:
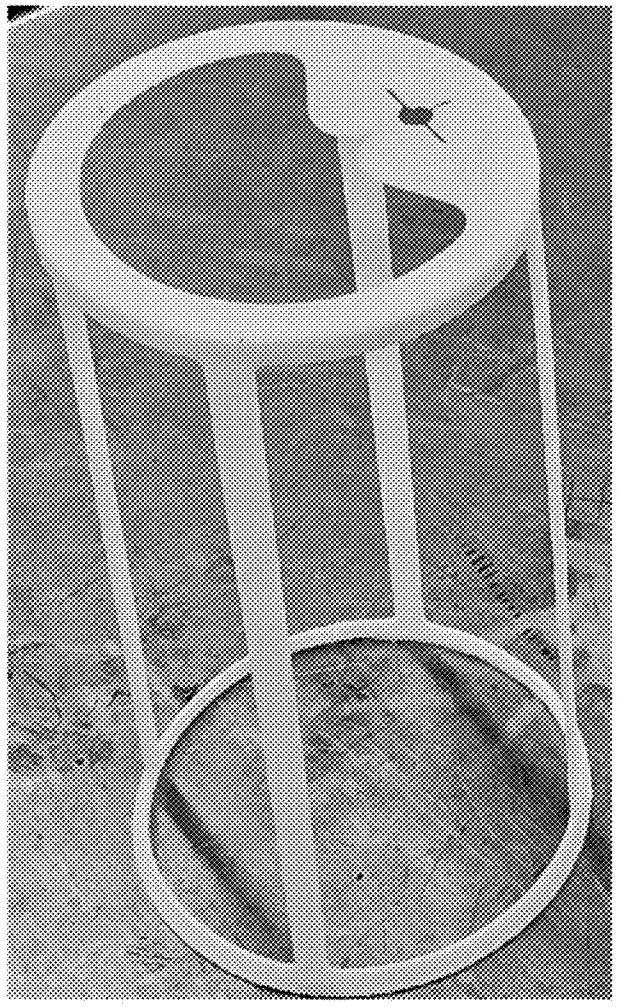
FIG. 33 is a photo of an example frame of FIG. 27 in accordance with implementations.

FIG. 32 are photos 3200 of example of the fusion packages 2500 in accordance with implementations. The photos 3200 show fusion packages 2500 which include content, such as tissue, which can be pulled from the fusion package 2500. The cap, frame, and sidewall are shown. FIG. 33 is a photo 3300 of an example frame 2700 in accordance with implementations. The photo 3300 shows a frame 2700 with four legs. FIG. 34 is a photo 3400 of an example frame 2700 with sidewall 2710 in accordance with implementations.

The fusion package 100 uses the join processing to fuse the sidewall 2710 with the frame 2700 and the dispensing seal 2715 to a flange 2736 of the neck 2730. The cap 2510 is snapped into place on the frame 2700. The fusion package 2700 is filled from a bottom and then the seal 2750 is fused to the flange 2722. The fusion package 2700 is opened by opening the cap 2510. The perforated portion 2717 is removed to obtain access to the content. The cap 2510 can be closed after obtaining the content.

Figure 35B:
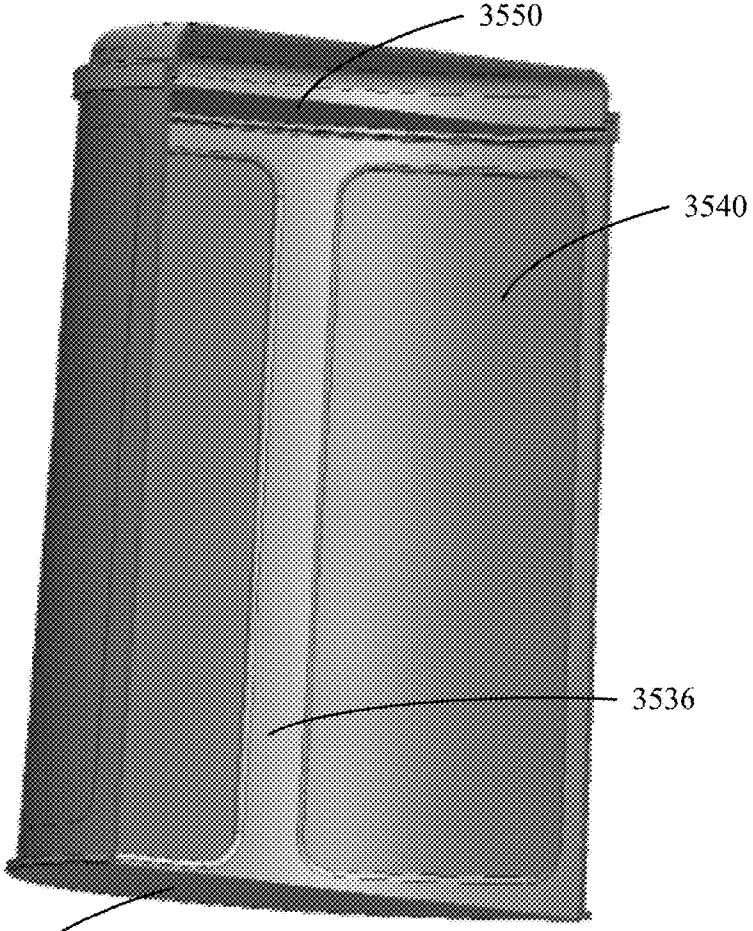
FIG. 35B is a cross-sectional view of the fusion package of FIG. 35A in accordance with implementations.
Figure 35A:
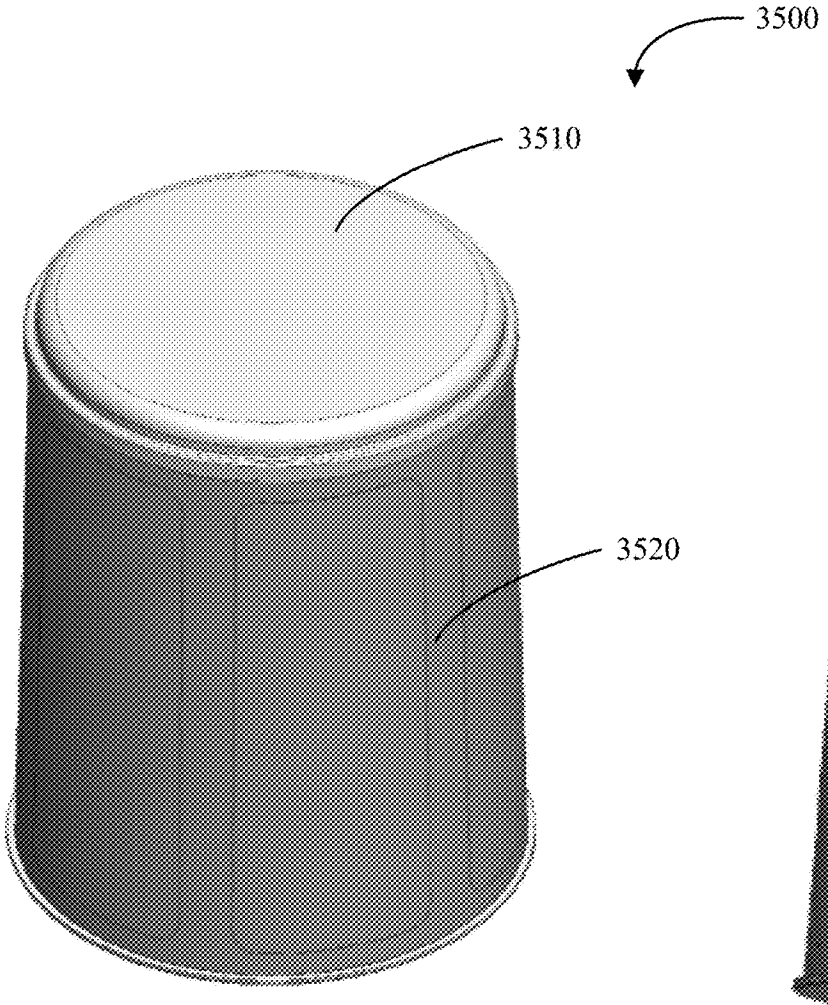
FIG. 35A is a diagram of a fusion package in a closed position in accordance with implementations.
Figure 35C:
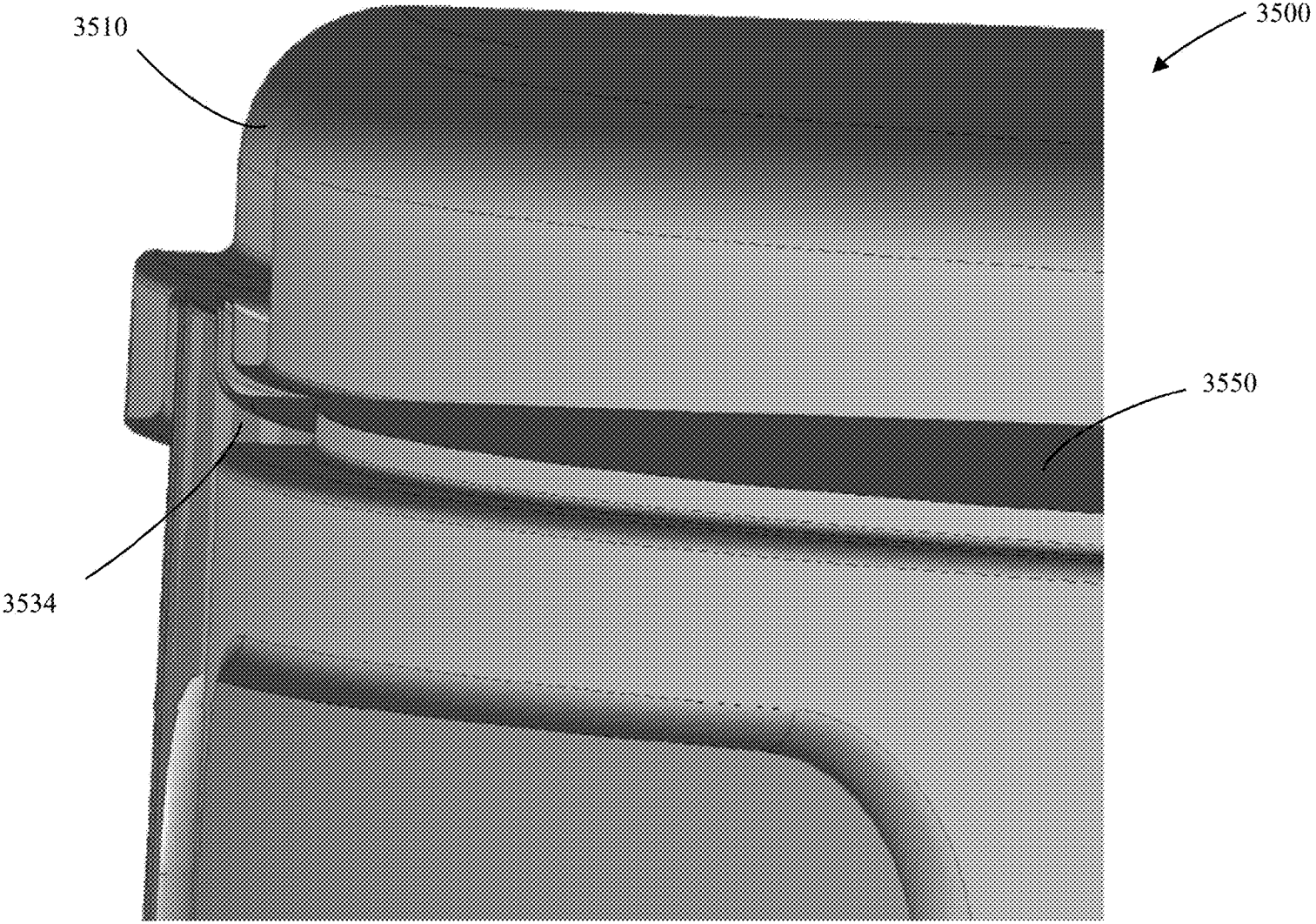
FIG. 35C is an enlarged cross-sectional view of the fusion package of FIG. 35A in accordance with implementations.
Figure 36:
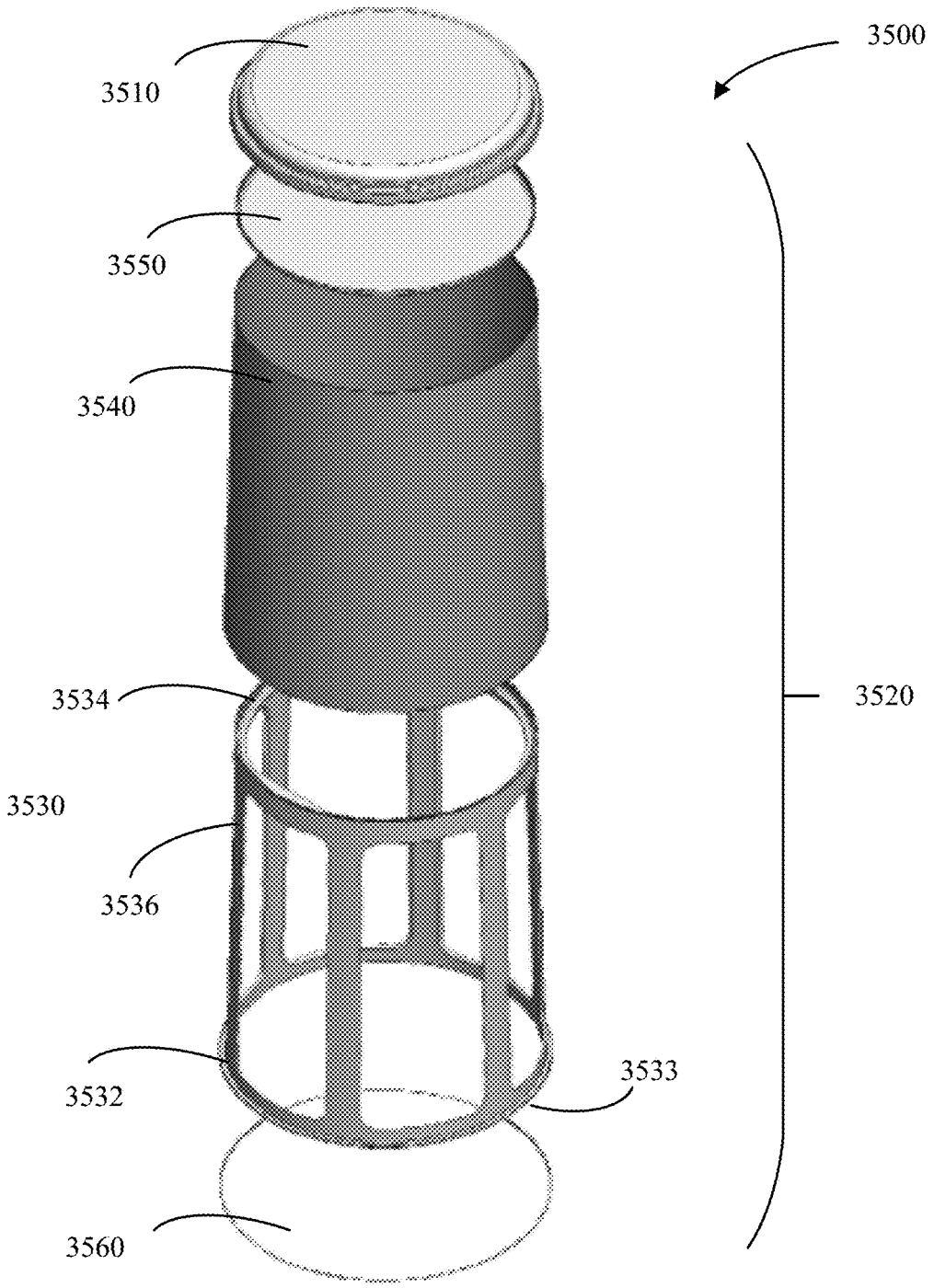
FIG. 36 is an exploded view of a fusion package in accordance with implementations.
Figure 37:
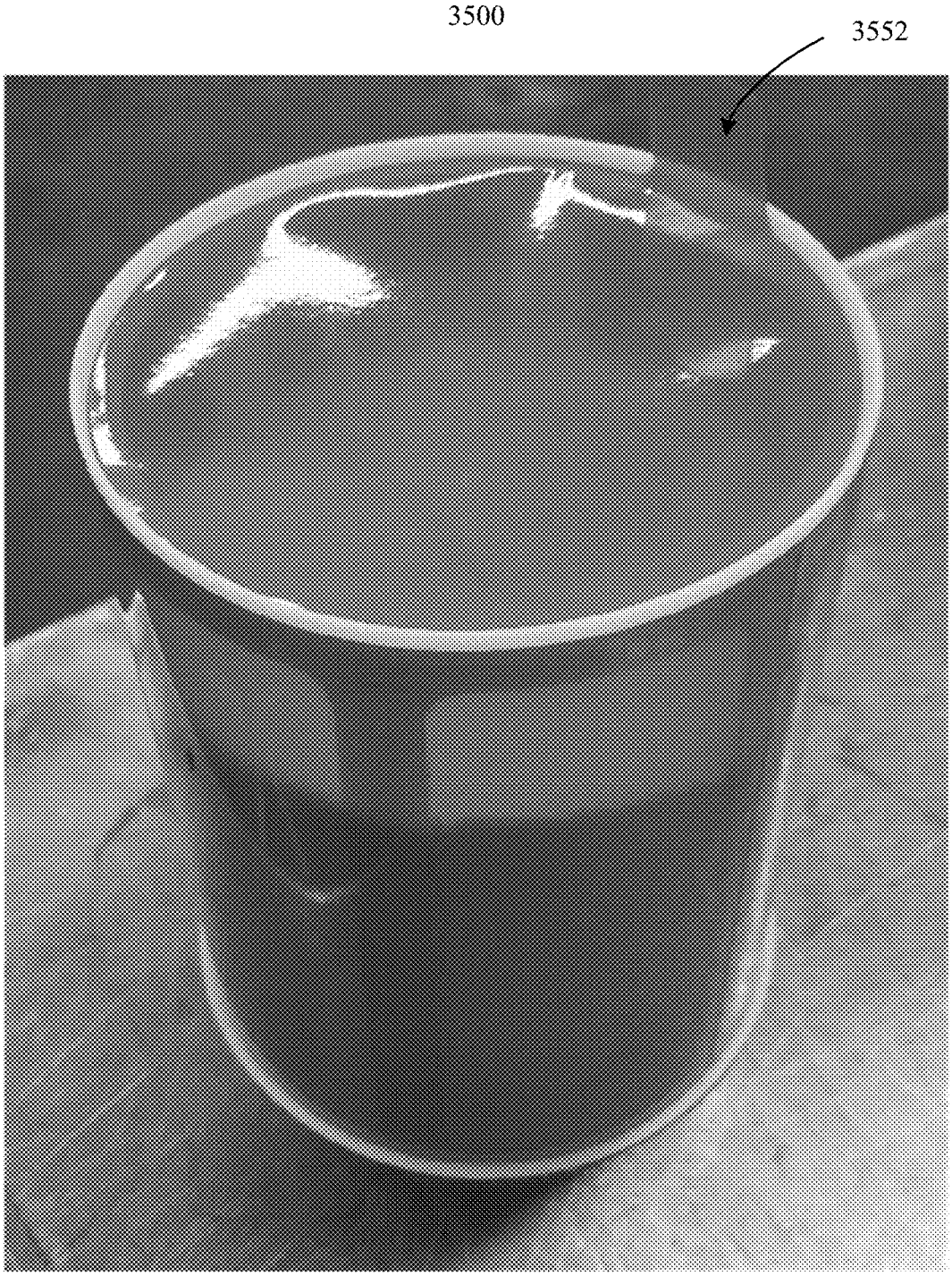
FIG. 37 is a photo of an example frame with sidewall of FIG. 35A in accordance with implementations.

FIG. 35A is a diagram of a fusion package 3500 in a closed position in accordance with implementations. FIG. 35B is a cross-sectional view of the fusion package of FIG. 35A in accordance with implementations. FIG. 35C is an enlarged cross-sectional view of the fusion package of FIG. 35A in accordance with implementations. The fusion package 3500 includes a cap 3510 and a package body 3520. FIG. 36 is an exploded view of the fusion package 3500 in accordance with implementations. FIG. 37 is a photo of an example frame with sidewall of FIG. 35A in accordance with implementations.

The package body 3520 includes a frame 3530, a sidewall 3540, a peelable seal 3550, and a seal 3560. The frame 3530 includes a bottom 3532, a neck 3534, and legs 3536 for connecting the bottom 3532 and the neck 3534. The bottom 3532 includes a flange 3533. The seal 3560 is configured to engage the flange 3533 when closing the fusion package 3500. The peelable seal 3550 includes a tab 3552 to remove the peelable seal 3550 and permit access to the content. In implementations, the sidewall 3540 can be made from heavy film, paperboard, pressed pulp, and the like materials as described herein. In implementations, the sidewall 3540 can include a barrier layer or film on an internal or inside surface. In implementations, the sidewall 3540 can include an integrated barrier layer, film, and/or material. In implementations, the frame 3530 can be made using the structure forming processes described herein using the materials described herein.

The fusion package 100 uses the join processing to fuse the sidewall 3540 with the frame 3530 and the peelable seal 3550 to the neck 3534. The cap 3510 is snapped into place on the neck 3534 of the frame 3530. The fusion package 3500 is filled from a bottom and then the seal 3560 is fused to the flange 3533 after filling is complete. The fusion package 3500 is opened by opening the cap 3510. The peelable seal 3550 is removed by pulling on the tab 3552 to obtain access to the content. The cap 3510 can be closed after obtaining the content.

Figure 38:
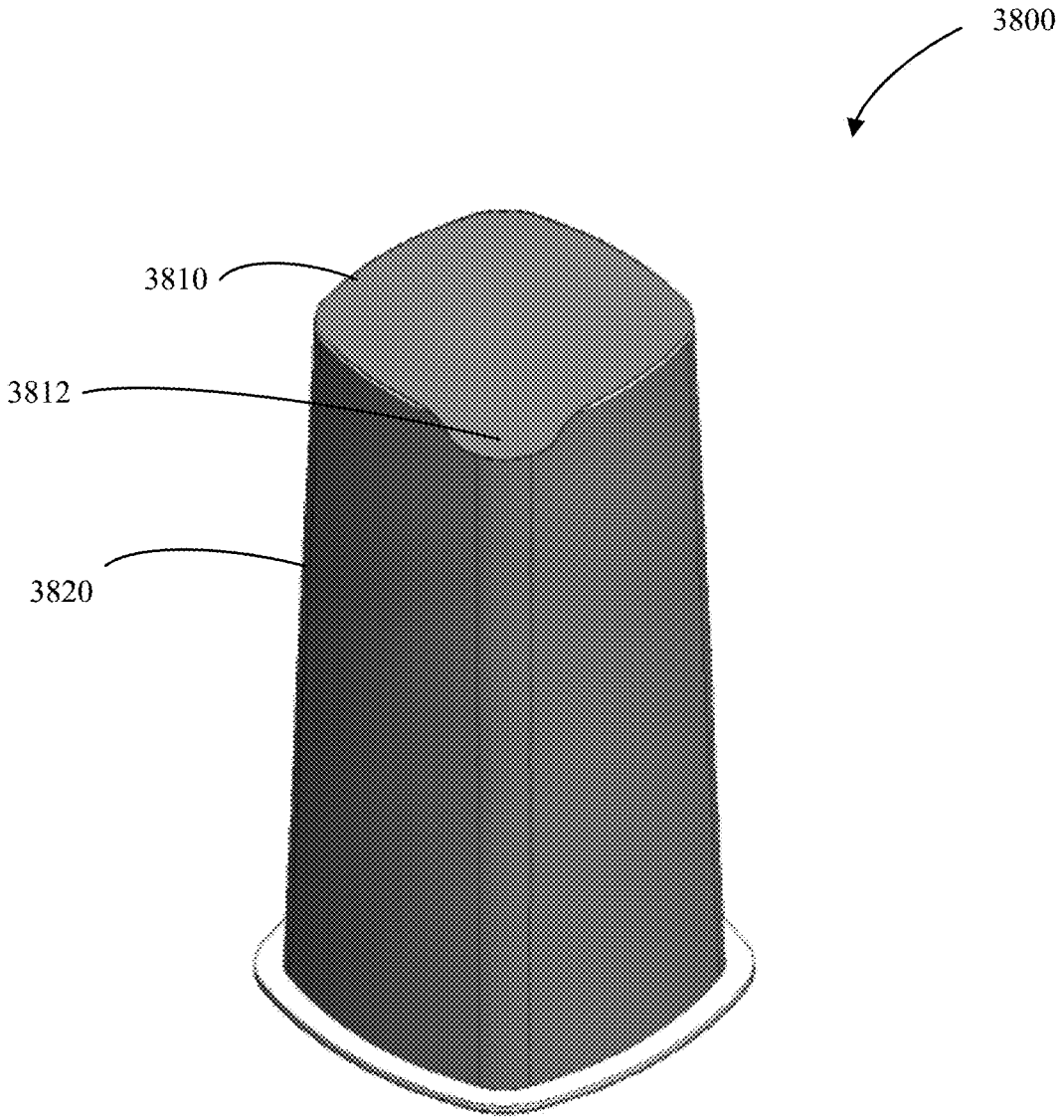
FIG. 38 is a diagram of a fusion package in a closed position in accordance with implementations.
Figure 39:
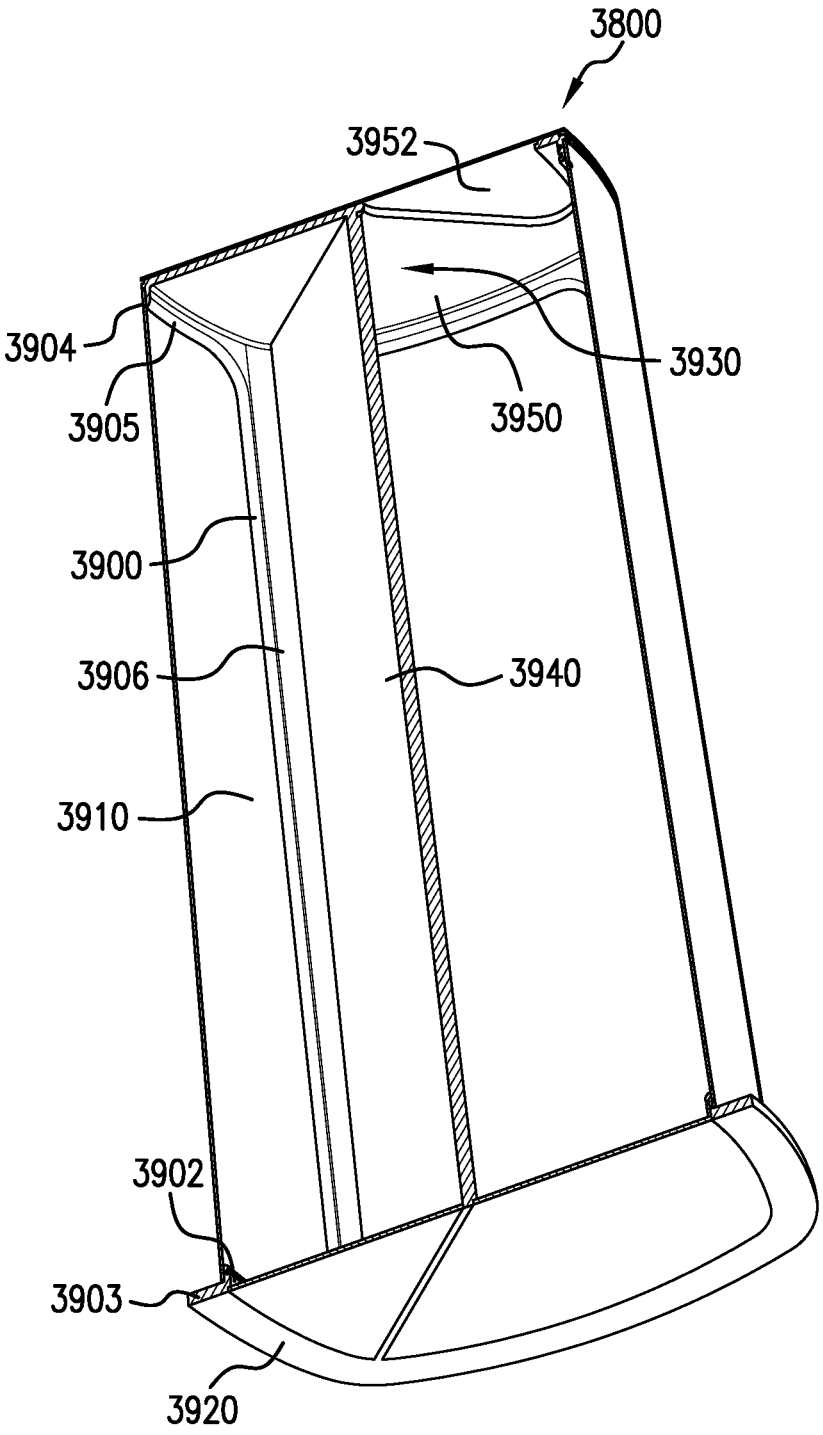
FIG. 39 is a cross-sectional view of the fusion package of FIG. 38 in accordance with implementations.

FIG. 38 is a diagram of a fusion package 3800 in a closed position in accordance with implementations. FIG. 39 is a cross-sectional view of the fusion package 3800 in accordance with implementations.

The fusion package 3800 includes a peelable seal 3810 and a package body 3820. The peelable seal 3810 includes a pull tab 3812. The package body 3820 includes a frame 3900, a sidewall 3910, a seal 3920, and a divider structure 3930. The frame 3900 includes a bottom 3902, a neck 3904, and legs 3906. The legs 3906 connect the bottom 3902 and the neck 3904. The bottom 3902 includes a flange 3903 for fusing with the seal 3920. The neck 3904 includes a rim 3905. The divider structure 3930 divides the fusion package 3800 into two sections. The divider structure 3930 includes a compartment divider 3940 and an access divider 3950. The compartment divider 3940 is connected or fused to two opposite legs of the legs 3906 of the frame 3900. The access divider 3950 is connected or fused to the rim 3905. The access divider 3950 includes a first access opening 3952 and a second access opening (only the first access opening 3952 is shown). In implementations, the frame 3900 and the divider structure 3930 can be an integrated structure. In implementations, the sidewall 3910 can be made from heavy film, paperboard, pressed pulp, and the like materials as described herein. In implementations, the sidewall 3910 can include a barrier layer or film on an internal or inside surface. In implementations, the sidewall 3910 can include an integrated barrier layer, film, and/or material. In implementations, the frame 3900 can be made using the structure forming processes described herein using the materials described herein.

The fusion package 100 uses the join processing to fuse the sidewall 3910 to the frame 3900 and the peelable seal 3810 to the frame 3900 and/or the divider structure 3930, as appropriate. The fusion package 3800 is filled from a bottom and then the seal 3920 is fused to the flange 3903. In implementations, fusing of the seal 3920 can be done at a content or material production site. That is, a non-sealed fusion package 3800 can be shipped to a manufacturer of the material, who can then fill and seal the fusion package 3800. The fusion package 3800 is opened by peeling the peelable seal 3810 using the tab 3812.

Figure 40B:
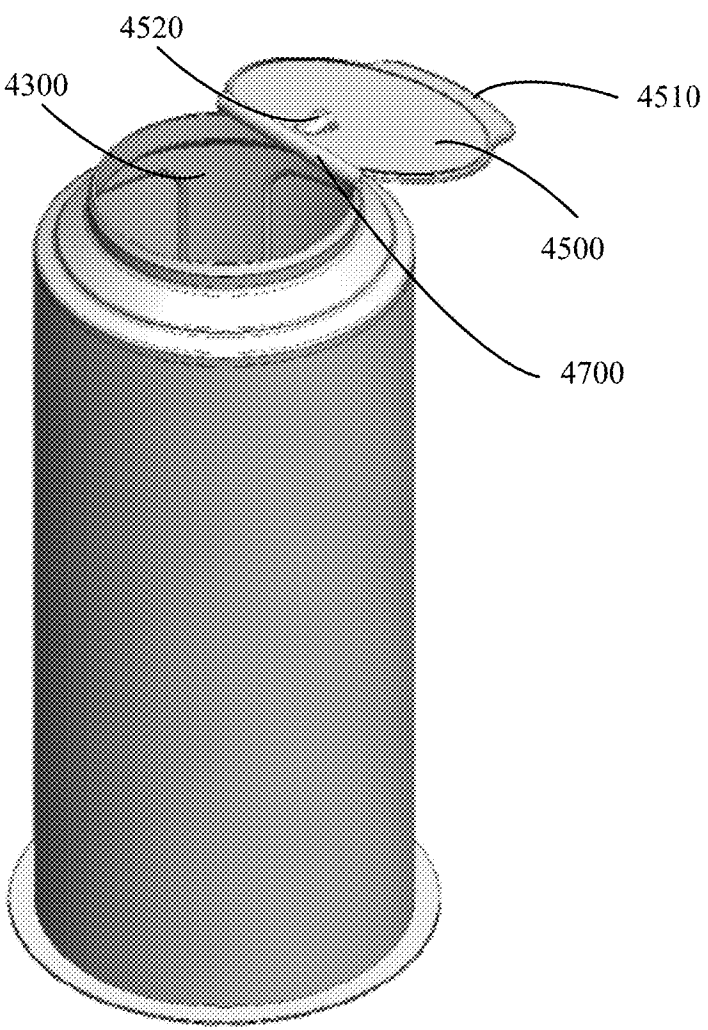
FIG. 40A, FIG. 40B, and FIG. 40C are diagrams of a fusion package in a closed position and an open position, respectively, in accordance with implementations.
Figure 40A:
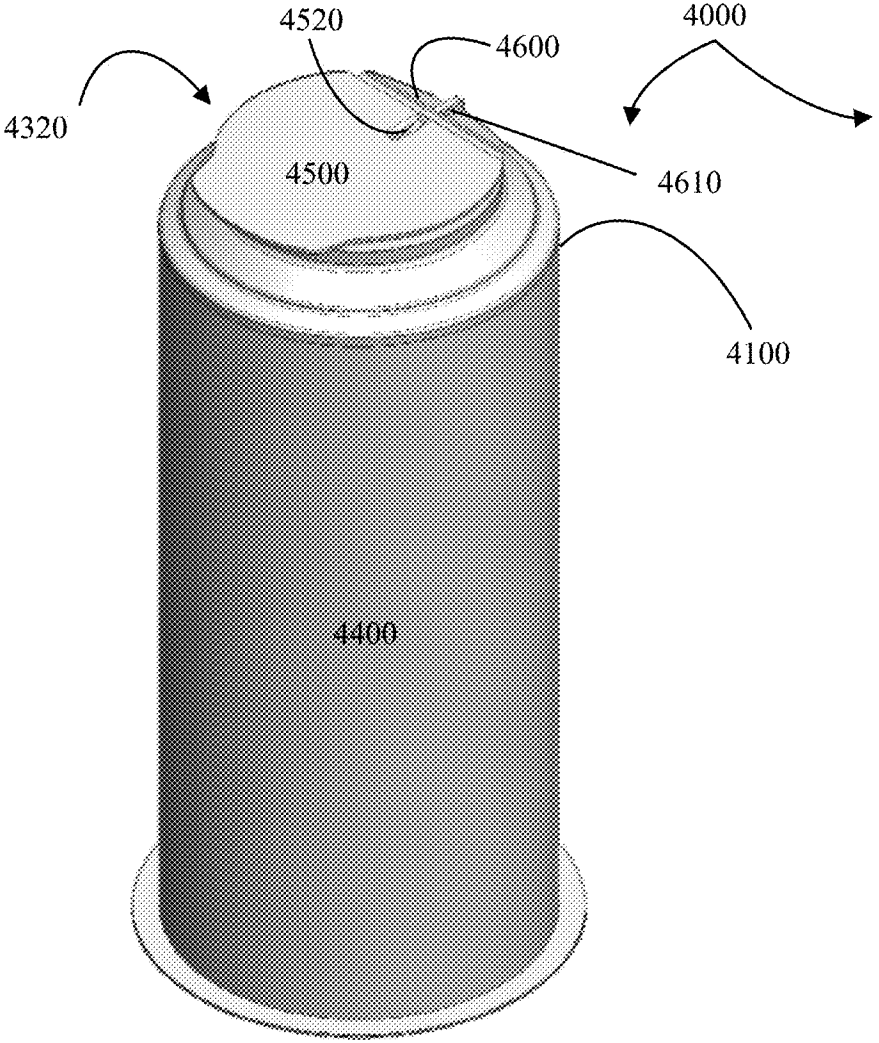
Figure 40C:
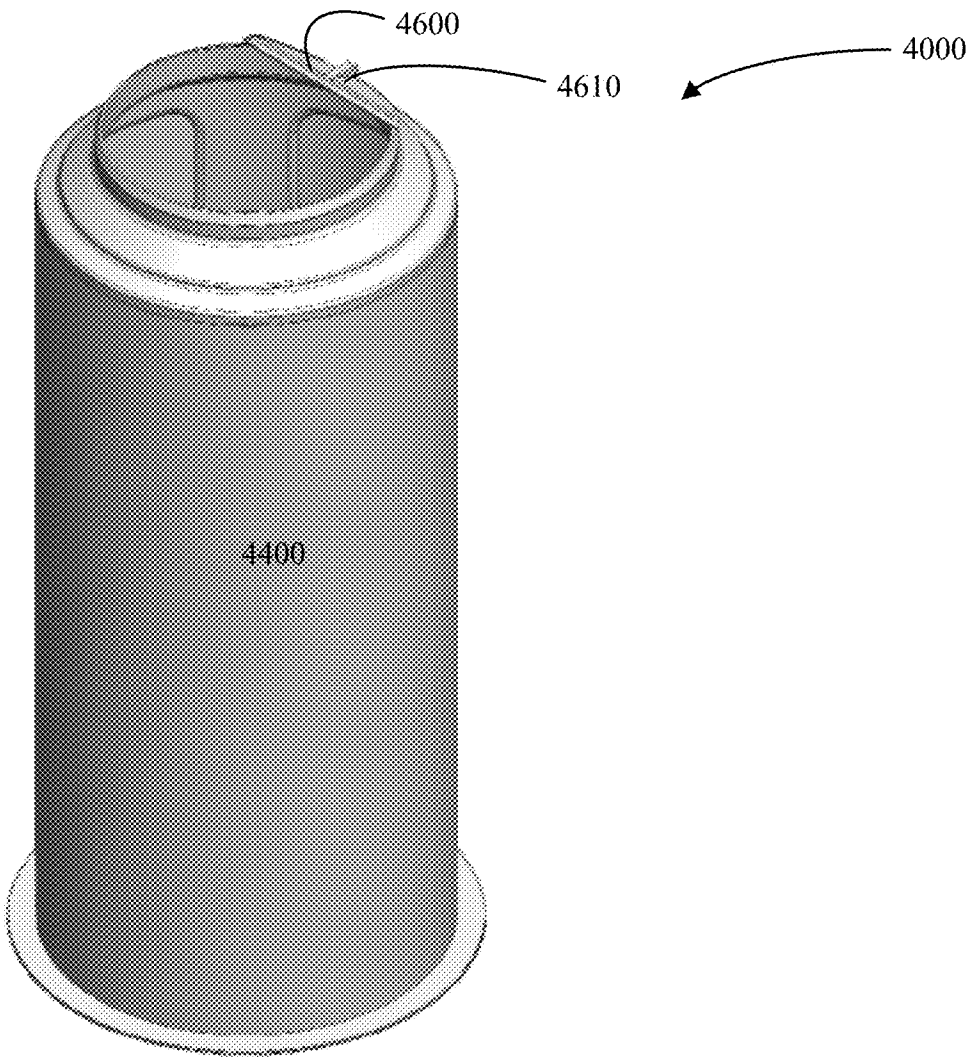
Figure 41:
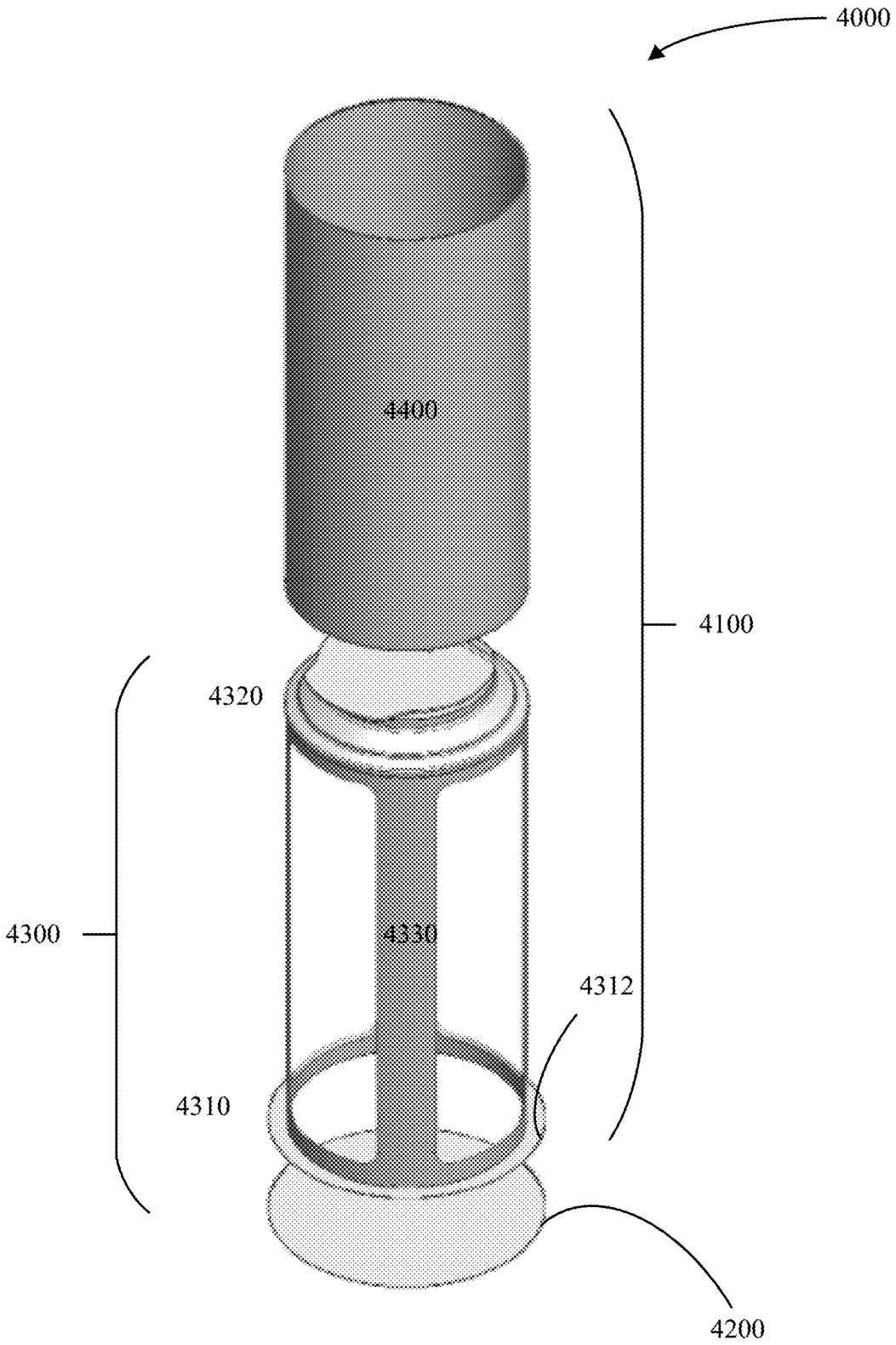
FIG. 41 is an exploded view of the fusion package of FIG. 40A in accordance with implementations.

FIG. 40A, FIG. 40B, and FIG. 40C are diagrams of a fusion package 4000 in a closed position, an open position, and with a peelable seal removed, respectively, in accordance with implementations. FIG. 41 is an exploded view of the fusion package 4000 of FIG. 40A in accordance with implementations. The fusion package 4000 includes an integrated package body 4100 and a seal 4200. The integrated package body 4100 includes a frame 4300 and a sidewall 4400. In implementations, the sidewall 4400 can be made from heavy film, paperboard, pressed pulp, and the like materials as described herein. In implementations, the sidewall 4400 can include a barrier layer or film on an internal or inside surface. In implementations, the sidewall 4400 can include an integrated barrier layer, film, and/or material. In implementations, the frame 4300 can be made using the structure forming processes described herein using the materials described herein.

The frame 4300 includes a bottom 4310, a cap portion 4320, and legs 4330 for connecting the bottom 4310 and the cap portion 4320. The bottom 4310 includes a flange 4312. The seal 4200 is configured to engage the flange 4312 when closing or sealing the fusion package 4000. The cap portion 4320 includes a peel portion 4500, a retain portion 4600, and a hinge portion 4700. The peel portion 4500 has a tab portion 4510 and a retain groove 4520. The retain portion 4600 includes a retain projection 4610 for engagement with the retain groove 4520. The hinge portion 4700 flexibly or hingedly connects the peel portion 4500 and the retain portion 4600. In implementations, the cap portion 4320 is a peel portion only which can be removed for access to the content.

The fusion package 4000 uses the join processing to fuse the frame 4300 with the sidewall 4400. The fusion package 4000 is filled from a bottom and then the seal 4200 is fused to the flange 4312 using the join processing processes. In implementations, fusing of the seal 4200 can be done at a content or material production site. That is, a non-sealed fusion package 4000 can be shipped to a manufacturer of the material, who can then fill and seal the fusion package 4000. The fusion package 4000 is opened by pulling up on the tab portion 4510 to peel the peel portion 4500 away from the frame 4300 until hitting the hinge portion 4700, which prevents environmental disposal issues and enables sustainability. In implementations, the retain projection 4610 can engage the retain groove 4520 to keep peel portion 4500 from interfering in accessing the content or material in the fusion package 4000. In implementations, the peel portion 4500 can be torn away at the hinge portion 4700 with only the retain portion 4600 remaining as shown in FIG. 40C.

As described herein a fusion package includes a structure and a flexible part. The structure, which can include a frame, ribbed frame, vertical frame, cap, neck, or collar structure, is fused with the flexible part using the join processing to create the fusion package which is sealed to hold content or materials. The flexible part, for example, can be a sidewall, a seal, a peelable seal, a cap, or a dispensing seal. The fusing of the flexible part with the structure results in edge(s) of the flexible part being intermingled, impregnated, encapsulated, embedded, or coated with the material of the structure to form a sealed edge at junctions between the structure and the flexible part. The sealed edges prevent leakage of content from the fusion package. This is illustrated with respect to FIGS. 42-45 and is applicable to the fusion package implementations described herein.

Figure 42:
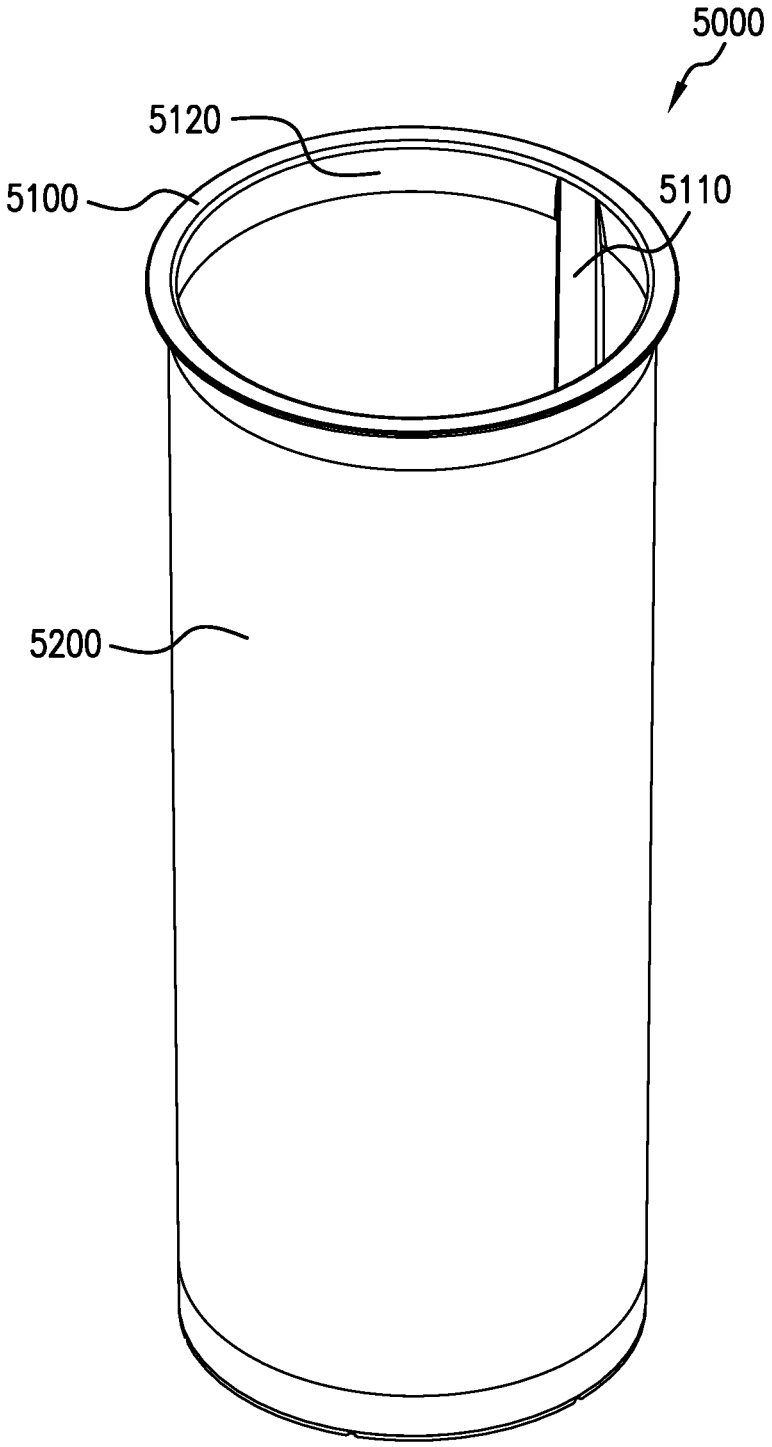
FIG. 42 is a diagram of a fusion package in accordance with implementations.

FIG. 42 is a diagram of a fusion package 5000 in accordance with implementations. The fusion package 5000 includes a frame 5100 and a sidewall 5200. In implementations, the sidewall 5200 can be made from heavy film, paperboard, pressed pulp, and the like materials as described herein. In implementations, the sidewall 5200 can include a barrier layer or film on an internal or inside surface. In implementations, the sidewall 5200 can include an integrated barrier layer, film, and/or material. In implementations, the frame 5100 can include one or more legs or ribs 5110 connected to a neck 5120. In implementations, the frame 5100 can be made using the structure forming processes described herein using the materials described herein.

Figure 43:
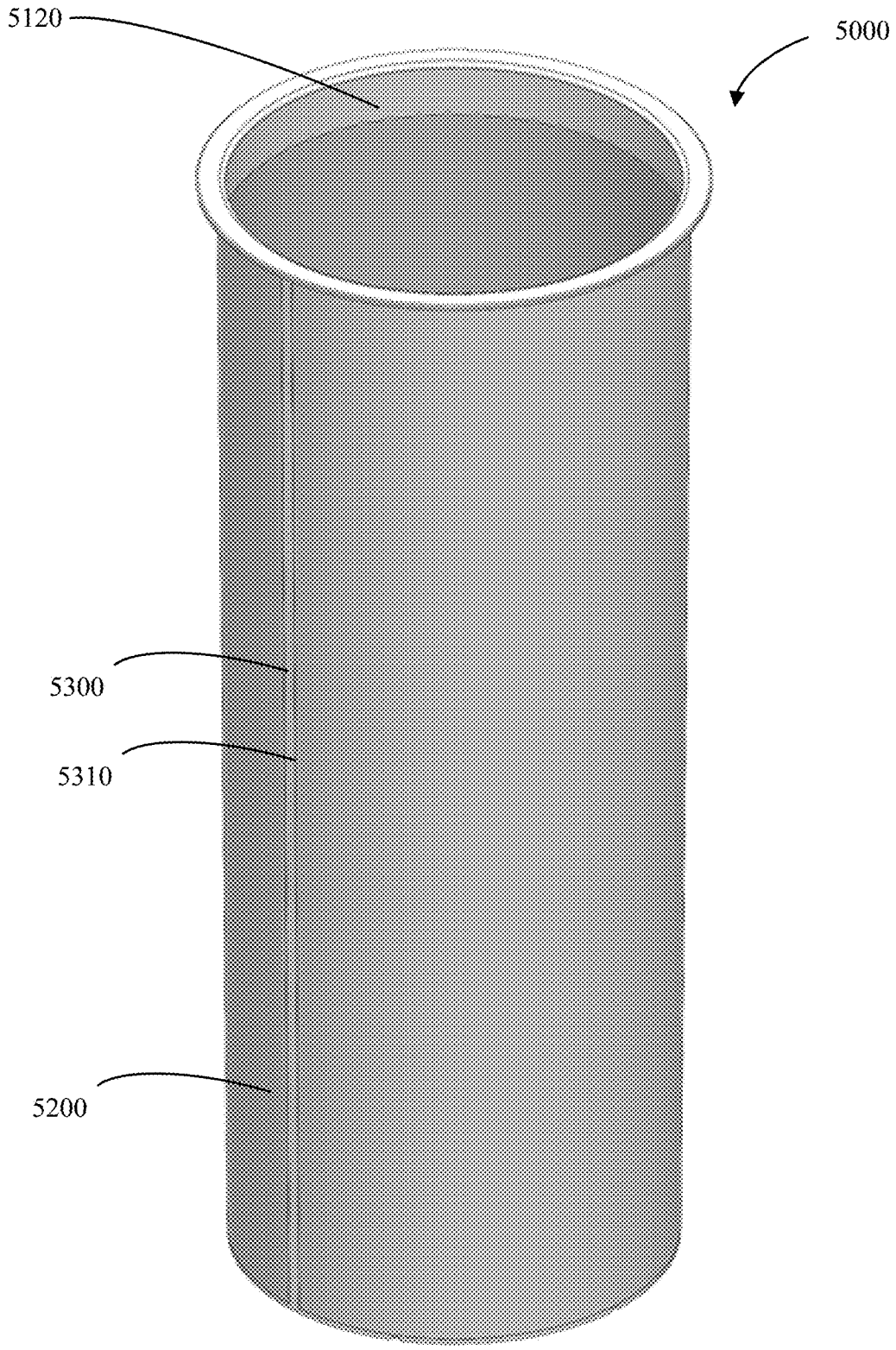
FIG. 43 is a reverse view of the fusion package of FIG. 42 in accordance with implementations.
Figure 43A:
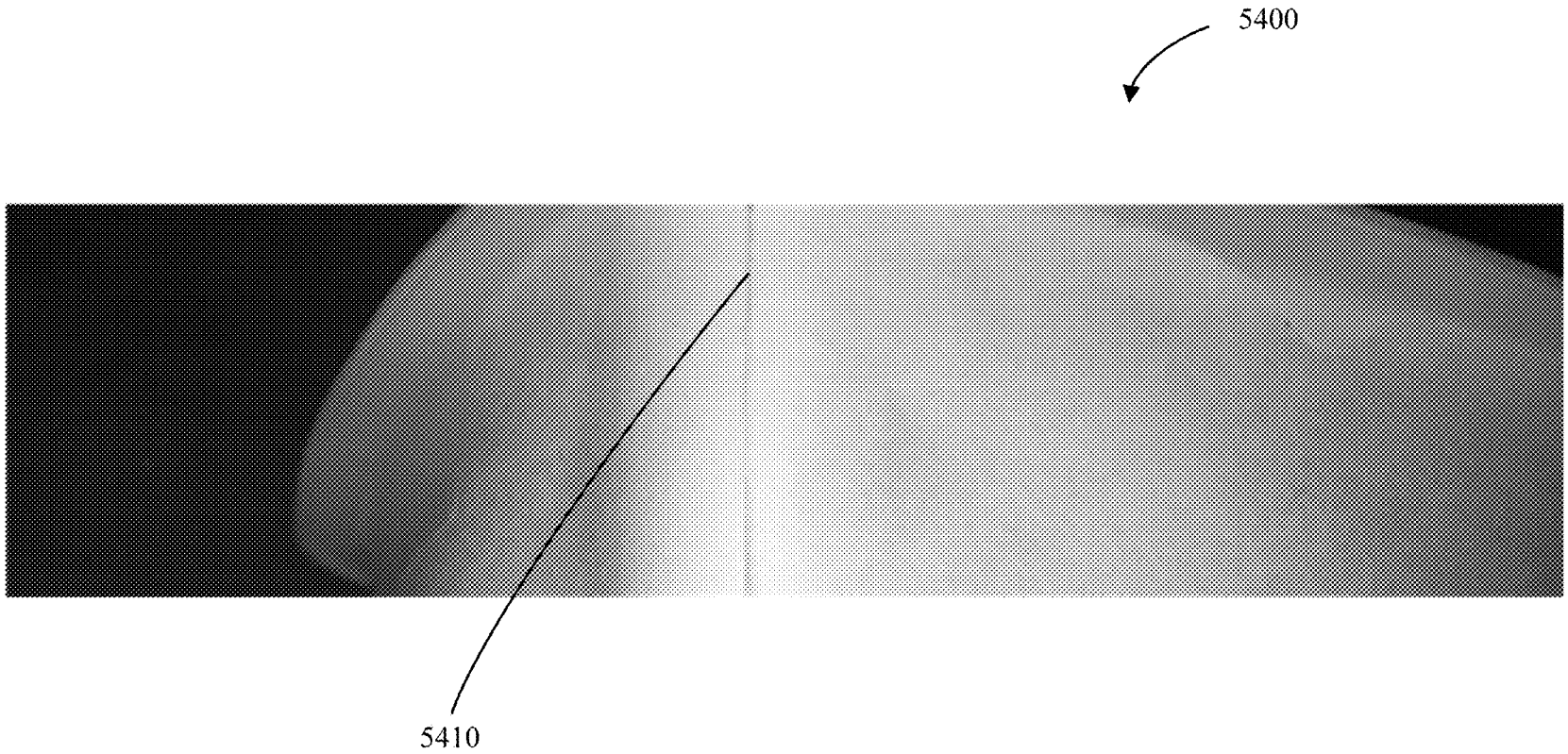
FIG. 43A is a picture of a sealed edge or seam in accordance with implementations.
Figure 43B:
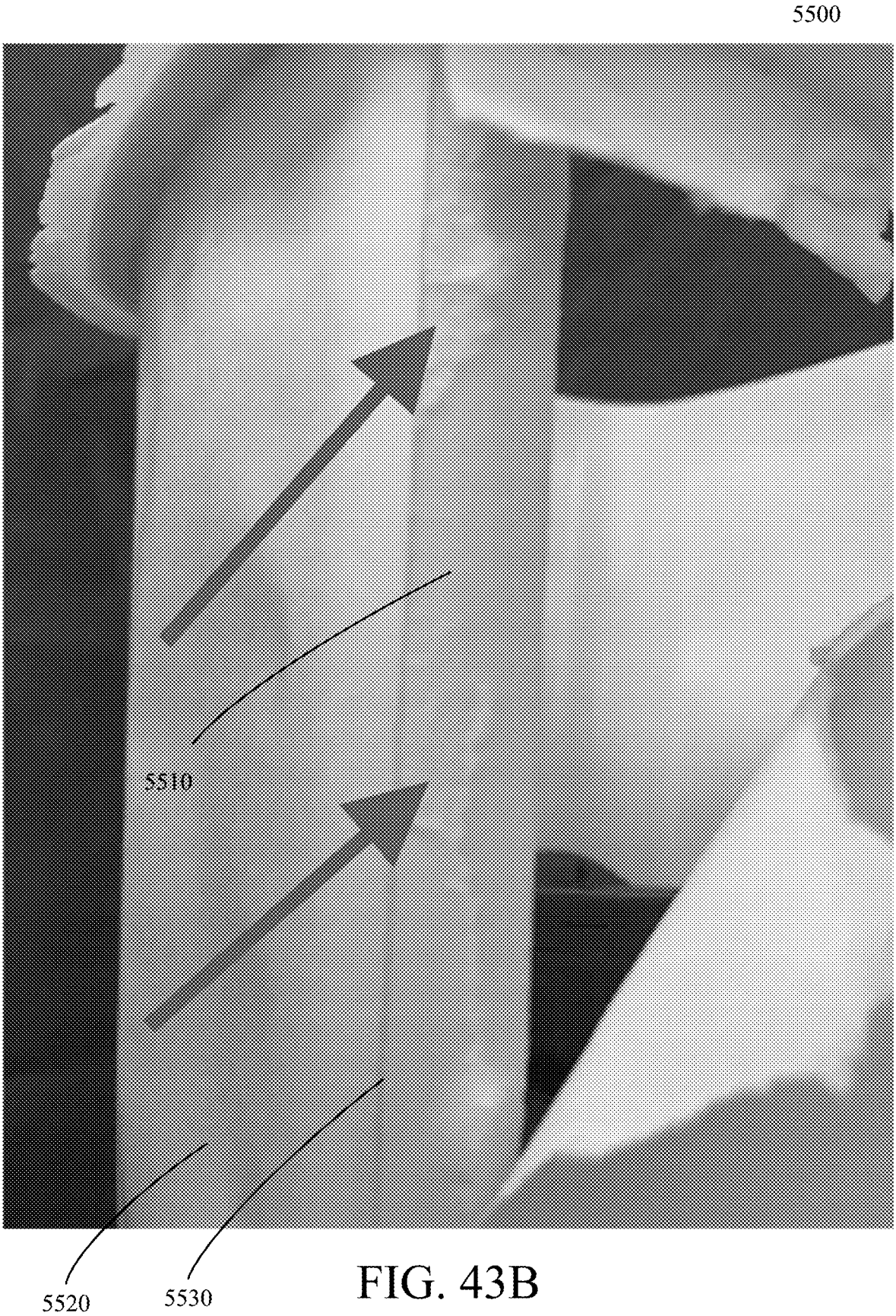
FIG. 43B is a picture of a separated sealed edge or seam in accordance with implementations.
Figure 44:
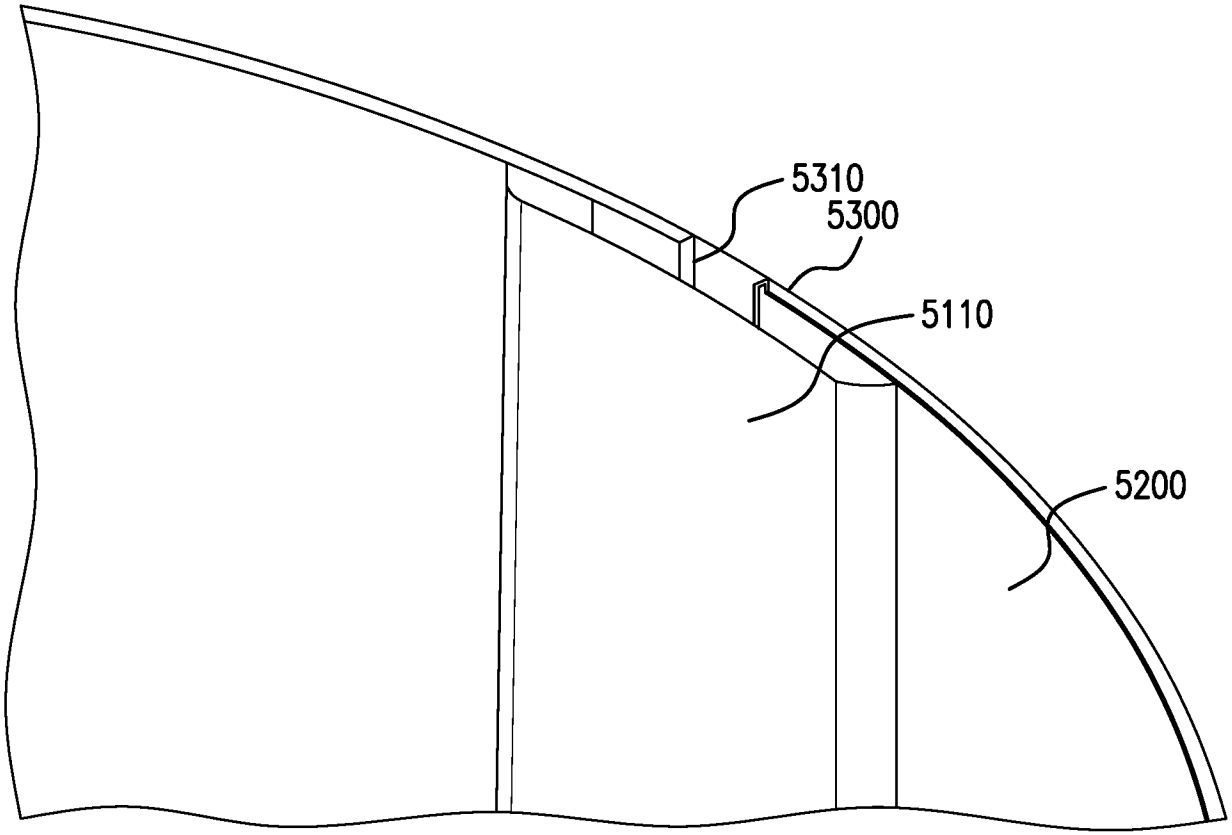
FIG. 44 is an exploded view of the fusion package of FIG. 42 in accordance with implementations.
Figure 45:
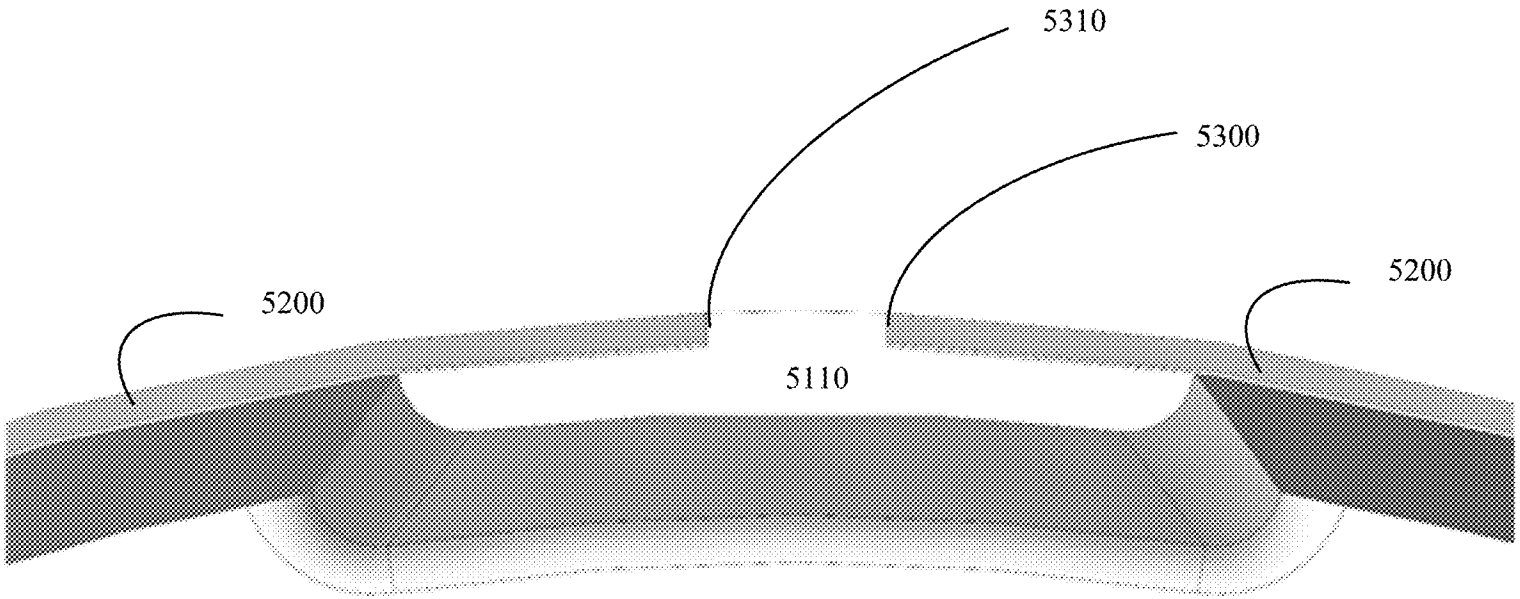
FIG. 45 is an exploded view of the fusion package of FIG. 42 in accordance with implementations.

The fusion package 5100 uses the join processing to fuse the frame 5100 with the sidewall 5200. The resulting sealed edges at the junctions are shown with respect to FIGS. 43-45 where FIG. 43 is a reverse view of the fusion package of FIG. 42 in accordance with implementations, FIG. 43A is a picture of a sealed edge or seam in accordance with implementations, FIG. 43B is a picture of a separated sealed edge or seam in accordance with implementations, FIG. 44 is an exploded view of the fusion package of FIG. 42 in accordance with implementations, and FIG. 45 is an exploded view of the fusion package of FIG. 42 in accordance with implementations. For example, the fusing can result in sealed edges 5300 and 5310 as between the frame 5100 and the sidewall 5200. The sealed edges are also present at a juncture where a sidewall meets a bottom of a frame and where a sidewall meets a neck of the frame. The former can be seen for example in FIG. 15.

FIG. 43A shows a picture of a sealed edge or seam 5410 in a fusion package 5400. FIG. 43B shows a picture of a separated sealed edge or seam 5510 in a fusion package 5500. The separated sealed edge or seam 5510 shows how portions of a sidewall 5520 remain on a frame 5530 even after separation, indicative of the fusing of the materials (as shown by the arrows) of the sidewall 5520 and the frame 5530.

Figures 46A, 46B:
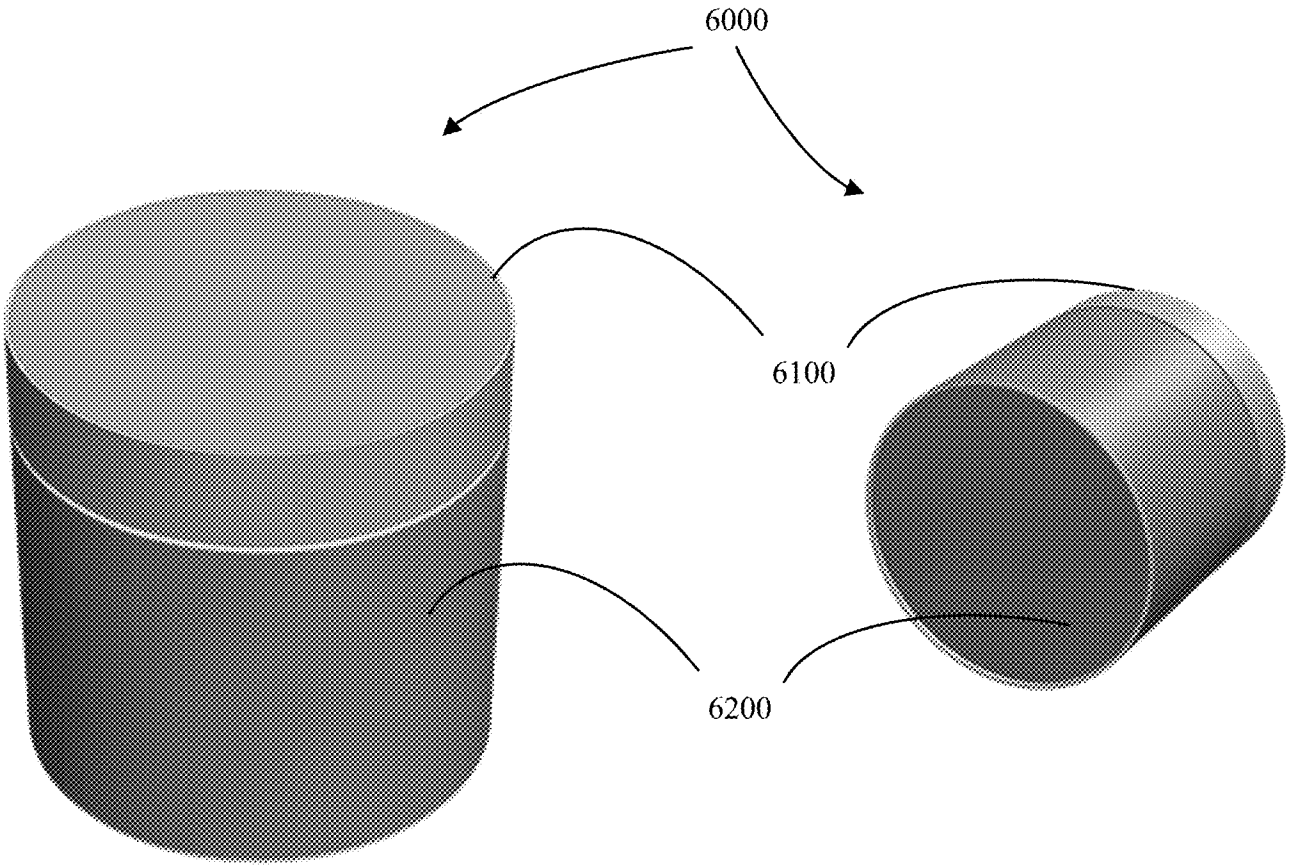
FIG. 46A and FIG. 46B are diagrams of a fusion package in accordance with implementations.
Figure 47:
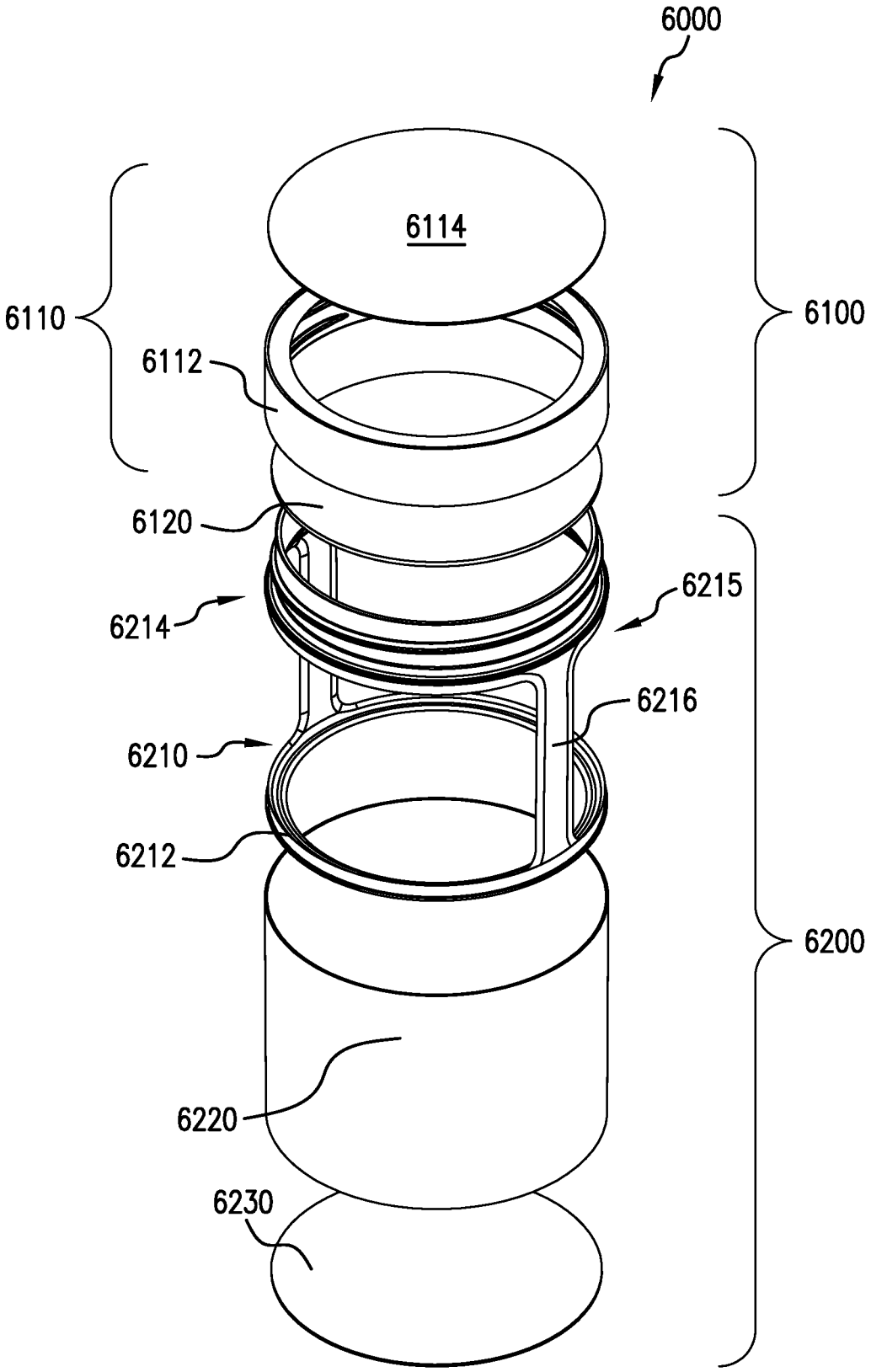
FIG. 47 is an exploded view of the fusion package of FIG. 46A in accordance with implementations.
Figure 48:
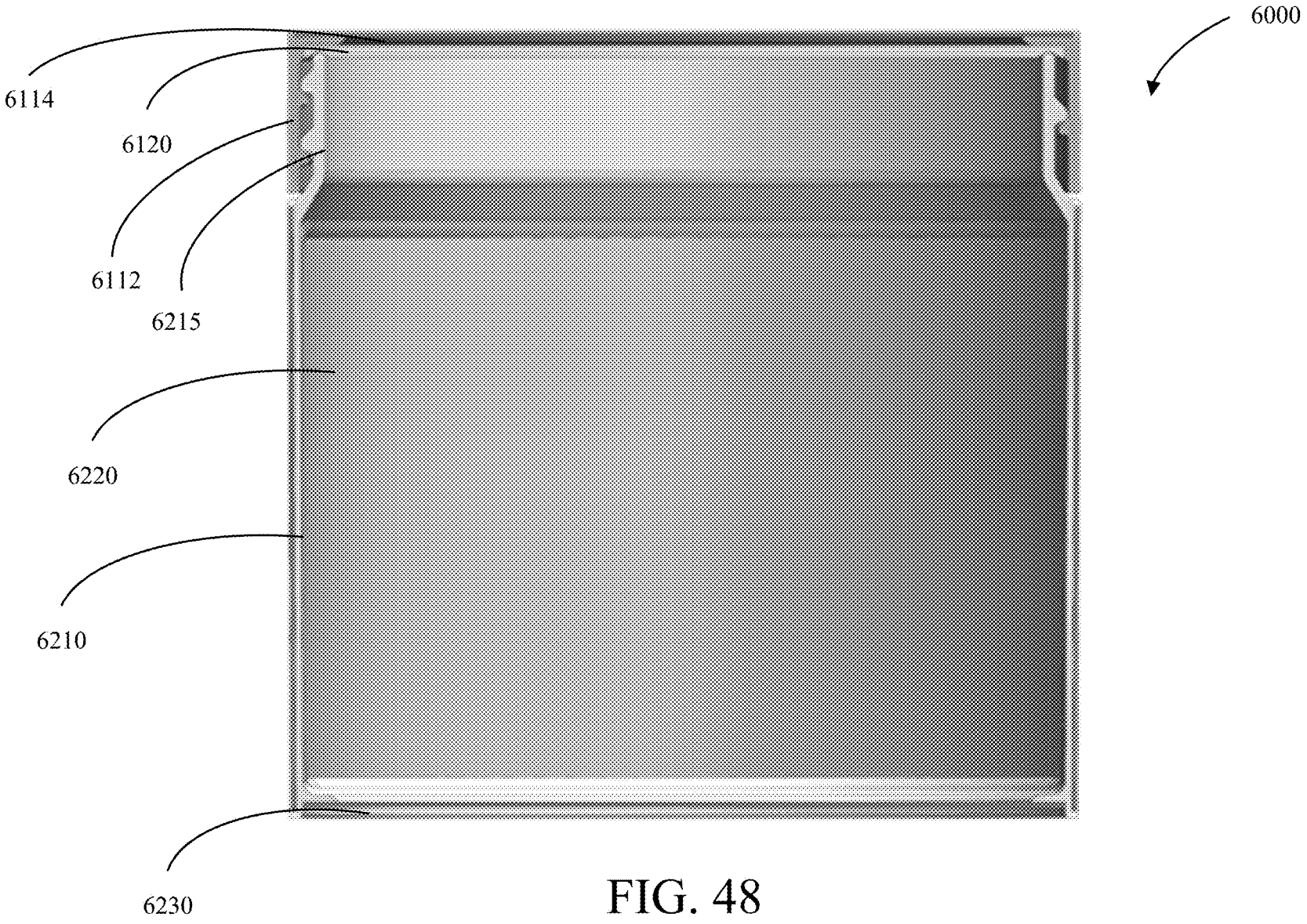
FIG. 48 is an exploded view of the fusion package of FIG. 46A in accordance with implementations.
Figure 50:
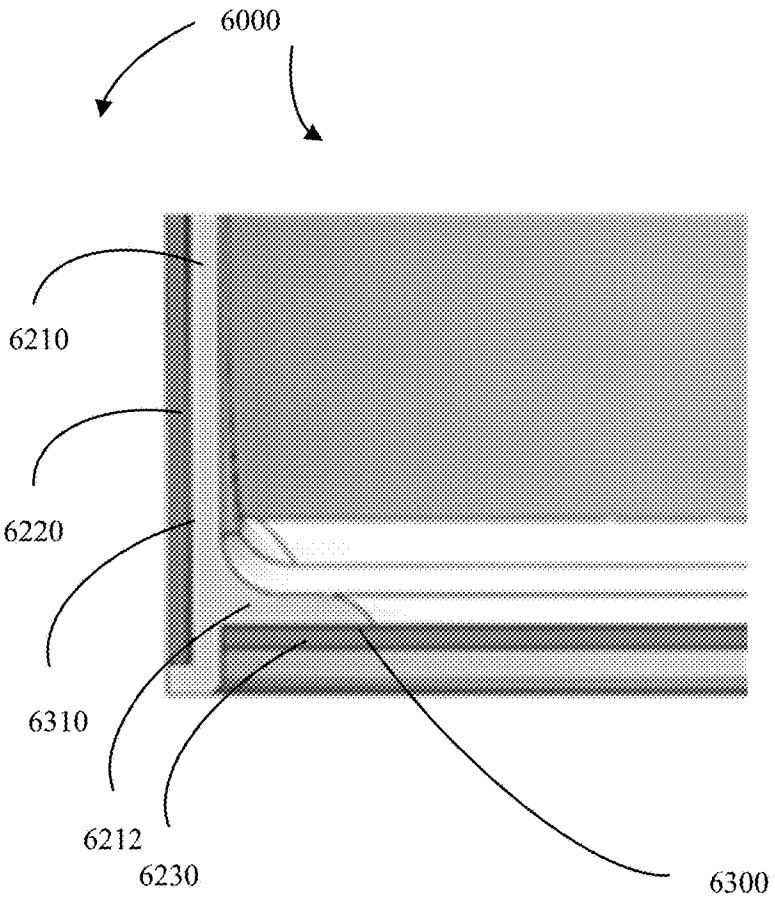
FIG. 50 is an exploded view of the fusion package of FIG. 46A in accordance with implementations.
Figure 49:
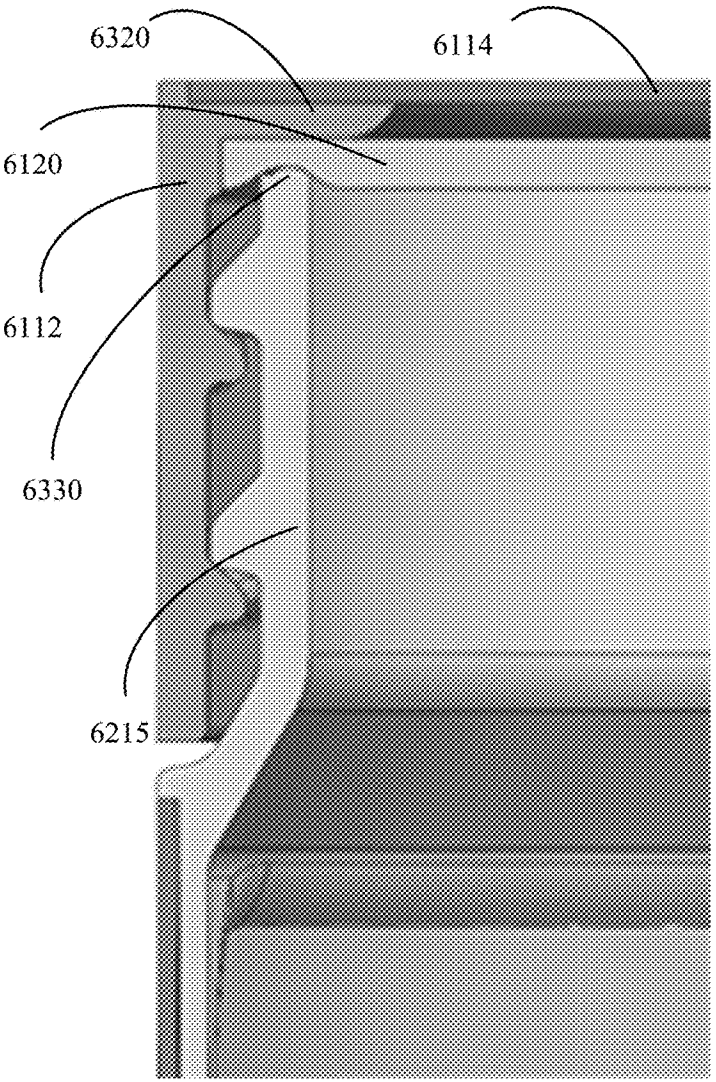
FIG. 49 is an exploded view of the fusion package of FIG. 46A in accordance with implementations.

FIG. 46A and FIG. 46B are diagrams of a fusion package 6000 in accordance with implementations, FIG. 47 is an exploded view of the fusion package 6000, FIG. 48 is an exploded view of the fusion package 6000, FIG. 49 is an exploded view of the fusion package 6000, and FIG. 50 is an exploded view of the fusion package 6000.

The fusion package 6000 includes a cap 6100 and a package body 6200. The cap 6100 includes a threaded, interference fit, or press fit (collectively "refittable") cap 6110 and a sealing lid 6120. The refittable cap 6110 includes a refittable component 6112 and a lid 6114. The lid 6114 can made heavy film, paperboard, pressed pulp, and the like materials as described herein. The lid 6114 can have a barrier layer on an internal surface or content facing surface as described herein. The lid 6114 can be fused to the refittable component 6112 as described herein. The refittable cap 6110 is a structure formed using structure forming processes as described herein. The refittable cap 6110 can be made from polymers, biopolymers, sustainable materials, recyclable materials, biodegradable materials, bio-based resins, weight-optimized biodegradable plastic, and the like as described herein. The sealing lid 6120 can made heavy film, paperboard, pressed pulp, and the like materials as described herein. The sealing lid 6120 can have a barrier layer on an internal surface or content facing surface as described herein. In implementations, the sealing lid 6120 can be fused to the refittable component 6112. In implementations, the sealing lid 6120 can be fused to the a frame 6210.

The package body 6200 includes the frame 6210, a sidewall 6220, and a seal 6230. The frame 6210 includes a bottom 6212, a neck 6214, and legs 6216 for connecting the bottom 6212 and the neck 6214. The neck 6214 includes a counterpart refittable section 6215 corresponding to the refittable component 6112. In implementations, the sidewall 6220 can be made from heavy film, paperboard, pressed pulp, compostable coated paper, and like materials as described herein. In implementations, the sidewall 6220 can include a barrier layer or film on an internal or inside surface. In implementations, the sidewall 6220 can include an integrated barrier layer, film, and/or material. In implementations, the frame 6210 can be made using the structure forming processes described herein using the materials described herein. The seal 6230 can made heavy film, paperboard, pressed pulp, compostable coated paper, and the like materials as described herein. The seal 6230 can have a barrier layer on an internal surface or content facing surface as described herein. In implementations, the frame 6210 can be made using the structure forming processes described herein using the materials described herein.

The fusion package 6000 uses the join processing to fuse the frame 6210 with the sidewall 6200 and the seal 6230. In implementations, the sealing lid 6120 can be fused to a top surface of the frame 6210. Due to the fusing, each juncture where an edge or surface of the sidewall 6200, the seal 6230, and/or the sealing lid 6120 meets the frame 6210, a sealed edge is formed which is a barrier against content leakage. For example, the sealed edges can include sealed edges 6300, 6310, 6320, and 6330.

The fusion package 6000 is filled from a top, for example, and then the refittable cap 6110 is attached to counterpart refittable section 6215, which results in the sealing lid 6120 being compressed therebetween. The fusion package 6000 is opened by detaching the refittable cap 6110 and removing the sealing lid 6120. The fusion package 6000 can be reclosed by reattaching the refittable cap 6110.

Figure 51:
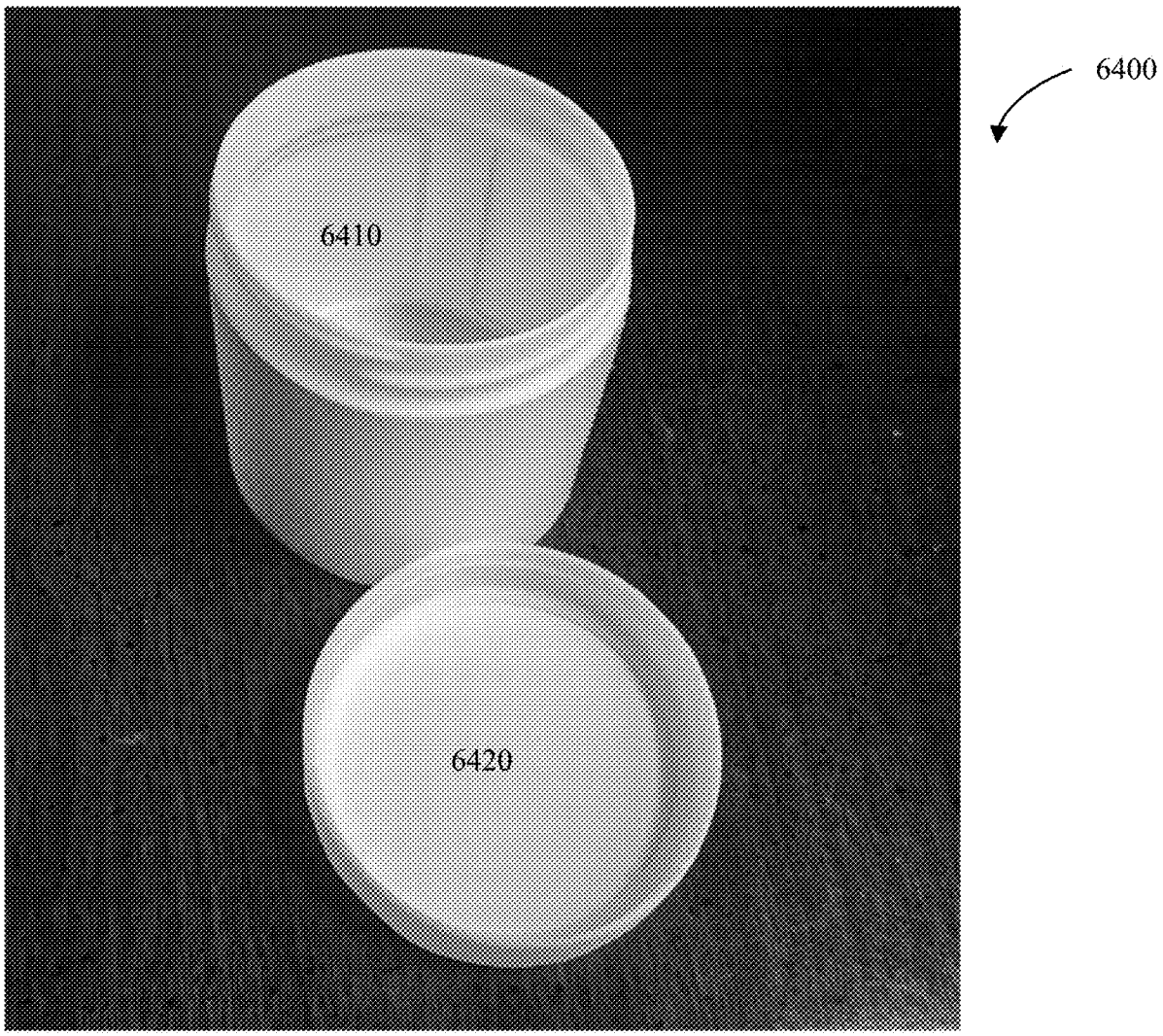
FIG. 51 is a picture of the fusion package of FIG. 46A in accordance with implementations.

FIG. 51 is a picture of a fusion package 6400 similar to the fusion package 6000, which shows a package body 6410 and a cap 6420 after fusing is complete.

Figures 52A, 52B:
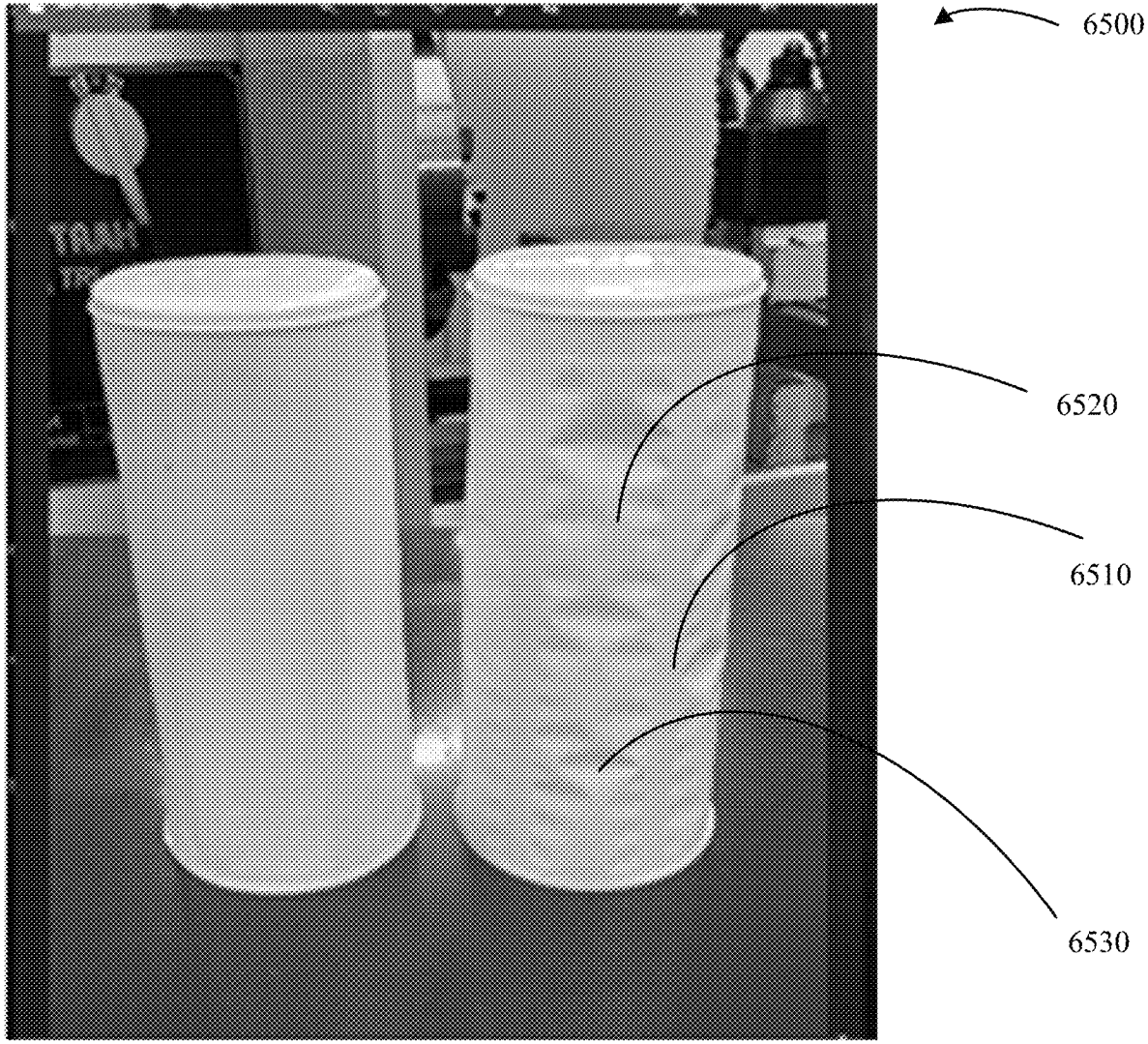
FIGS. 52A and 52B are pictures of a fusion package in accordance with implementations.

FIGS. 52A and 52B are pictures of a fusion package 6500 in accordance with implementations. The fusion package 6500 is representative of any of the fusion packages described herein. As described herein the fusion package 6600 includes a structure such as frame 6510, for example, which is formed using a structure forming process. The fusion package 6600 also includes a flexible part such as film 6520, for example. The film 6520 is placed in the structure forming process mold and hot plastic, for example, is processed via the structure forming process to form the frame 6510 and fuse the film 6520 to the frame 6510 via join processing. This results in the film 6520 fusing to the frame 6510 as described herein. As the frame 6510 cools, there is a defined amount of volumetric shrinkage due to material state change. For example, the defined amount can be 0.2 to 3% of volumetric shrinkage. The film 6520 however does not undergo a material state change and there is no associated shrinkage. This results in wrinkles 6530 in the film 6520 as shown in FIG. 52A.

To substantially overcome the wrinkles, a biaxial oriented film is used for the film 6520. Biaxially oriented film is cold worked or cold formed film that has been stretched or worked at a temperature below the film's melt temperature. In implementations, the biaxially oriented film is cold worked or cold formed film that has been stretched or worked at a temperature below the film's equal cohesive temperature. In implementations, the biaxially oriented film is cold worked or cold formed film that has been stretched or worked at a temperature above the softening point but below the melting point. At this point, the film retains shape memory. After the fusing of the film 6520 to the frame 6510 and the cool down period, the biaxially oriented film can be locally heated (i.e., as required with respect to the wrinkles on the fusion package 6600), which causes the biaxially oriented film to change material state and shrink a defined amount per a biaxial orientation rate. That is, upon reheating, the film will shrink and revert to dimensions approaching its pre-stretch shape. Consequently, the wrinkles substantially disappear as shown in FIG. 52B. In implementations, the local heating can be provided by using ambient, convective, or other forms of directive heating. The biaxial orientation rate of the film can be chosen to substantially match the shrinkage rate of the plastic used for the frame 6510. That is, a stretch ratio of the biaxially oriented film is variable and selectable.

The construction and arrangement of the methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A package comprising:

a frame configured to provide structure for the package;

a sidewall fused to the frame; and a cap connected to one end of the frame, wherein sealed edges are formed at junctures between at least the sidewall and the frame when frame material intermingles with sidewall material such that portions of the sidewall that are fused with the frame to form the sealed edges at the junctures still remain on the frame after separation of the sidewall from the frame to break the sealed edges at the junctures, and wherein the sealed edges prevent leakage of content from the package.

2. The package of claim 1, further comprising:

a seal fused with another end of the frame, wherein a sealed edge is formed at a juncture between the seal and the frame.

3. The package of claim 1, wherein the cap is a refittable cap further comprising:

a refittable component configured to engage a corresponding section of the frame; and a lid fused to the refittable component, wherein a sealed edge is formed at a juncture between the lid and the refittable component.

4. The package of claim 1, further comprising:

a sealing lid fused to the frame, wherein a sealed edge is formed at a juncture between the sealing lid and the frame.

5. The package of claim 4, wherein the sealing lid is configured to be compressed between the frame and a refittable component.

6. The package of claim 1, wherein:

the frame includes a retainment locking element for retaining a retaining element of the cap; and the cap includes a tether mechanism connected to the retaining element.

7. The package of claim 1, wherein the cap comprising:

a tab element configured to enable access to content in the package;

a tearable membrane portion configured to be peeled away by the tab element to expose an opening to access the content;

a tether mechanism configured to connect the tearable membrane portion to a remaining portion of the cap; and a tab element retainer configured to retain the tab element away from the opening.

8. The package of claim 1, wherein the cap comprising:

a tab element configured to enable access to content in the package, wherein the tab element is configured to partly fuse with an outer surface of the sidewall;

a peelable portion configured to be peeled away by the tab element to expose an opening to access the content; and a tether mechanism configured to connect the peelable portion to a remaining portion of the cap.

9. The package of claim 8, wherein the frame comprising a rim having a narrow section and a wide section, the tether mechanism configured to be fused to the wide section.

10. The package of claim 1, wherein:

the cap includes pins configured to engage pin openings on the frame to go from an open position to a close position; and a partially openable seal including a perforated portion configured to allow access to content when the perforated portion is removed and the cap is in the open position, the partially openable seal configured to be fused to the frame, wherein, the cap can be placed in a closed position after accessing the content.

11. The package of claim 1, wherein:

the frame having a defined shrinkage rate; and the sidewall having a biaxial orientation rate substantially matching the defined shrinkage rate, wherein the sidewall as fused to the frame substantially lacks wrinkles after application of localized heating to the sidewall after fusing.

12. A package comprising:

a sleeve configured to provide structure for the package;

a cap fused to one end of the sleeve; and a seal configured to be fused to a remaining end of the sleeve after the package is filled with content, wherein sealed edges are formed at junctures between at least the sleeve and the cap when sleeve material intermingles with cap material such that portions of the cap that are fused with the sleeve to form the sealed edges at the junctures still remain on the sleeve after separation of the cap from the sleeve to break the sealed edges at the junctures, and wherein the sealed edges prevent leakage of content from the package.

13. The package of claim 12, wherein the cap comprising:

a peelable portion configured to provide an opening for access to the content in the package, the peelable portion including a retain groove; and a tethered portion fused to the sleeve and connected to the peelable portion by a hinge portion, the tethered portion including a retain projection, wherein the retain projection and the retain groove lock the peelable portion away from the opening during access to the content.

14. A package comprising:

a frame configured to provide structure for the package;

a film fused to the frame;

a cap connected to one end of the frame, the cap including a structure to reattach to the frame to reclose the package after removal of content from the package; and a seal connected to another end of the frame, wherein one of the cap and seal are connected to the frame after placement of the content, and wherein sealed edges are formed at junctures between at least the film and the frame when frame material embeds with film material such that portions of the film that are fused with the frame to form the sealed edges at the junctures still remain on the frame after separation of the film from the frame to break the sealed edges at the junctures, and wherein the sealed edges prevent leakage of content from the package.

15. The package of claim 14, wherein the cap further comprising:

a peel portion;

a retain portion; and a hinge portion configured to connect the peel portion and the retain portion, wherein the peel portion is retained to the retain portion after peeling the peel portion away from the package.

16. A package comprising:

a frame configured to provide structure for the package, the frame including an integrated cap;

a film fused to the frame; and a seal connected to one end of the frame after material placement, wherein sealed edges are formed at junctures between at least the film and the frame when frame material embeds with film material such that portions of the film that are fused with the frame to form the sealed edges at the junctures still remain on the frame after separation of the film from the frame to break the sealed edges at the junctures, and wherein the sealed edges prevent leakage of content from the package.

17. The package of claim 16, wherein the integrated cap includes a structure to retain a portion of the integrated cap after removal from the frame.

18. The package of claim 17, wherein the portion of the integrated cap can be configured to be detached from the integrated cap.

19. The package of claim 17, wherein a peelable portion of the integrated cap can be configured to be detached from the integrated cap.

20. A package comprising:

a sleeve configured to provide structure for the package;

a cap portion fused to one end of the sleeve, the cap portion including:

a peel portion;

a retain portion; and a hinge portion configured to connect the peel portion and the retain portion, wherein the peel portion is retained to the retain portion after peeling the peel portion from the cap portion; and a seal configured to be fused to a remaining end of the sleeve after the package is filled with content, wherein a sealed edge is formed at a juncture between the sleeve and the cap portion when sleeve material embeds with cap portion material, and wherein another sealed edge is formed at a juncture between the sleeve and the seal when sleeve material embeds with seal material.

* * * * *